US006843531B2

(12) United States Patent
Williams

(10) Patent No.: US 6,843,531 B2
(45) Date of Patent: Jan. 18, 2005

(54) SEATING UNIT HAVING A HORIZONTALLY POSITIONABLE SEAT SECTION

(76) Inventor: James A. Williams, 1435 Walnut Rd., Galion, OH (US) 44833

( * ) Notice: Subject to any disclaimer, the term of this patent is extended or adjusted under 35 U.S.C. 154(b) by 0 days.

(21) Appl. No.: 10/620,980

(22) Filed: Jul. 16, 2003

(65) Prior Publication Data

US 2004/0041452 A1 Mar. 4, 2004

Related U.S. Application Data

(63) Continuation of application No. 09/854,232, filed on May 11, 2001, now abandoned, which is a continuation-in-part of application No. 09/169,498, filed on Oct. 9, 1998, now abandoned, which is a continuation-in-part of application No. 08/914,459, filed on Aug. 19, 1997, now Pat. No. 5,988,749, and a continuation-in-part of application No. 08/708,406, filed on Sep. 4, 1996, now Pat. No. 5,947,559.

(60) Provisional application No. 60/083,170, filed on Apr. 27, 1998, provisional application No. 60/141,480, filed on Jun. 29, 1999, and provisional application No. 60/204,656, filed on May 17, 2000.

(51) Int. Cl.[7] ..... A47C 1/02
(52) U.S. Cl. ..... 297/337
(58) Field of Search ..... 297/337, 311, 297/342, 118; 5/18.1, 12.1, 7; 74/500.5, 501.6

(56) References Cited

U.S. PATENT DOCUMENTS

| | | | |
|---|---|---|---|
| 711,412 | A | 10/1902 | Archambeault |
| 871,022 | A | 11/1907 | Anthony |
| 1,414,637 | A | 5/1922 | Gell |
| 2,025,436 | A | 12/1935 | Brosset |
| 2,240,748 | A | 5/1941 | Bak |
| 2,351,222 | A | 6/1944 | Muskin et al. |
| 2,497,395 | A | 2/1950 | Cramer, Sr. |
| 2,591,426 | A | 4/1952 | Hadley |
| 2,642,584 | A | 6/1953 | Petersen et al. |
| 2,860,691 | A | 11/1958 | Caesar |
| 3,005,997 | A | 10/1961 | Fox |
| 3,235,308 | A | 2/1966 | Conner |
| 3,299,446 | A | 1/1967 | Blise et al. |
| 3,331,408 | A | 7/1967 | Condit |
| 3,458,877 | A | 8/1969 | Edwards |
| 3,567,280 | A | 3/1971 | Bradshaw |
| 3,816,860 | A | 6/1974 | Quakenbush |
| 3,913,152 | A | 10/1975 | Quakenbush |
| 4,001,901 | A | 1/1977 | Quakenbush |
| 4,037,872 | A | 7/1977 | Quakenbush |
| 4,166,299 | A | 9/1979 | DuShane et al. |
| 4,452,486 | A | 6/1984 | Zapf et al. |
| 4,481,684 | A | 11/1984 | Hauck |

(List continued on next page.)

*Primary Examiner*—Milton Nelson, Jr.
(74) *Attorney, Agent, or Firm*—Fay, Sharpe, Fagan, Minnich & McKee, LLP

(57) ABSTRACT

A seating unit with at least one independently movable seat sections, is disclosed which includes a main frame arranged for support of a back rest in fixed relation thereto and one or more seat frames for supporting the seat sections. Support tracks slidably support each seat frame with respect to the main frame. Each seat frame can be moved from a retracted position to an extended position in relation to the main frame. A locking device secures a respective seat frame in relation to the main frame in a plurality of positions between the retracted position and the extended position. Numerous seat frame embodiments are disclosed. In addition, a unique cable-based actuation assembly is described for manually positionable seat configurations. Electrically powered versions are also disclosed in which one or more motors are incorporated in the seating unit and provide powered extension and retraction of one or more individual seats. Remote control systems for electrically powered drives are also disclosed.

17 Claims, 50 Drawing Sheets

U.S. PATENT DOCUMENTS 4,563,784 A 1/1986 Shrock et al.
4,586,206 A 5/1986 Singer
4,733,845 A 3/1988 Maiwald
4,756,034 A 7/1988 Stewart
4,844,541 A 7/1989 Laird
5,098,158 A 3/1992 Palarski
5,129,706 A 7/1992 Ghezzi
5,292,178 A 3/1994 Loose et al.
5,575,449 A 11/1996 Shinbori et al.
5,575,535 A 11/1996 Burchett et al.
5,607,204 A 3/1997 Gryp
5,735,573 A 4/1998 Vredevoogd
5,988,749 A 11/1999 Williams

FIG. IOC

FIG. IOA

FIG. IOB

SEATING UNIT HAVING A HORIZONTALLY POSITIONABLE SEAT SECTION

CROSS REFERENCE TO RELATED APPLICATIONS

This application is a continuation of U.S. application Ser. No. 09/854,232, filed May 11, 2001 entitled "Seating Unit Having A Horizontally Positionable Seat Section",now abandoned is a continuation-in-part of; which U.S. application Ser. No. 09/169,498 filed Oct. 9, 1998 entitled "Seating Unit Having Multiple Sliding Seat Sections", now abandoned; which is a continuation-in-part of U.S. application Ser. No. 08/708,406 filed Sep. 4, 1996 entitled "Seating Unit With Movable Seat", now U.S. Pat. No. 5,947,559; and is a continuation-in-part of U.S. application Ser. No. 08/914,459 filed Aug. 19, 1997 entitled "Couch With Sliding Seat", now U.S. Pat. No. 5,988,749; U.S. provisional application Ser. No. 60/083,170 filed Apr. 27, 1998 entitled "Sliding Seat Assembly"; U.S. provisional application Ser. No. 60/141,480 filed Jun. 29, 1999 entitled "Sliding Seat Assembly"; and U.S. provisional application Ser. No. 60/204,656 filed May 17, 2000 entitled "Furniture Pieces with One or More Extendable Seat sections Activated Via Remote Control."

FIELD OF THE INVENTION

This invention pertains to furniture. More particularly, the present invention pertains to a seating system, such as a couch, sofa, love seat or chair having a movable seat section. Specifically, the invention pertains to a seating system having one or more seat sections, each of which is independently movable or slidable between an extended position, a retracted position, and any position therebetween.

BACKGROUND OF THE INVENTION

Convertible seat bed units of various constructions and useable both for seating and sleeping are well known in the art. In many of these, a flexible bed platform is held in a curved condition in a sofa portion of the seat bed unit. Once the seat cushions are removed, the bed platform can be pulled out of the sofa portion and is straightened out. Convertible sofa-bed units are also known in which a rigid seat support frame is mounted on a main frame for movement of the seat between a rearward seating position—in which a rear edge of the seat is located under a back rest—and a forward sleeping position, in which the rear edge of the seat is located forwardly of the backrest and is raised to level the bed. A typical patent disclosing such an embodiment is the Quakenbush U.S. Pat. No. 3,816,860 patent. Another such sofa-bed unit is disclosed in the Fox U.S. Pat. No. 3,005,997 patent. A convertible sofa-bed unit utilizing a flexible support frame that may be extended from, or retracted into, the unit is disclosed by Singer in U.S. Pat. No. 4,586,206. Although satisfactory in most respects, these sofa-beds are primarily for sleeping and are unsuitable as furniture seating units.

In U.S. Pat. No. 4,166,299 for an extendable bed mechanism, DuShane et al. describe an extendable bed that may be placed in either a fully extended position or in a fully retracted position. Although satisfactory for a sleeping unit, the extendable bed mechanism of DuShane et al. would be entirely unsatisfactory for use as a seating unit. First, DuShane et al.'s system does not enable the bed or support structure to be secured at an intermediate position, that is between a fully retracted position and a fully extended position. Second, DuShane et al. utilize a first movable bed panel that is pulled across the top of a second panel. The resulting minimal distance between these panels would not allow the incorporation of cushioning provisions between the panels, such as coil springs, expanded metal devices, S springs, or fabric supports. Third, it is doubtful that the mechanism of DuShane et al. would properly operate or at least smoothly, if one or two persons remained laying on the bed while attempting to extend the bed outward. Accordingly, there is a need for a mechanism, particularly one adapted for use in a seating unit, that allows a seat or other support structure to be placed in any one of numerous positions between a fully retracted and a fully extended position. It would also be desirable that such a movable support panel accommodate cushioning provisions under the support panel. And, as will be appreciated, the movable support panel and its related assembly should operate smoothly as the support panel is moved from one position to another, particularly when supporting the weight of one or more persons.

Another problem with conventional couches and seats is that the extension of the seat frame in relation to the main frame cannot be controlled so that the seat frame can be locked in relation to the main frame at a number of positions between a fully retracted position and a fully extended position. Rather, in the sofa-bed units disclosed in the Quakenbush '860 patent and the Fox '997 patent, there is only a fully retracted position and a fully extended position. This is understandable since the thrust of these patents is to a sofa which converts into a bed rather than a sofa having a slidable seat section. The sofa-bed unit disclosed by Singer in the '206 patent is positionable only between a "bed" (extended) position and a "sofa" (retracted) position. The extendable bed mechanism disclosed by DuShane, et al. is similar in that it only provides a fully retracted position and a fully extended position.

In addition, the known sofa-bed units do not allow a sliding motion of the seat frame in relation to the main frame when a person is seated on the seat frame. Rather, the person has to get up to move the seat frame. This is understandable because the seat frame is being turned into a bed. The mechanism of DuShane, et al. exhibits a similar difficulty.

It would be desirable to have a seat frame that can be moved while the person remains seated and that can be locked into a number of positions between a fully retracted position and a fully extended position so that the person can regulate the length of the seat portion.

Accordingly, it has been considered desirable to develop a new and improved seating system which can be used on couches, sofas, love seats or chairs which would overcome the foregoing difficulties and others, meet the above stated needs and provide better and more advantageous overall results.

BRIEF SUMMARY OF THE INVENTION

The present invention achieves all of the foregoing objectives and provides, in a first aspect, a seating unit having a movable seat and comprising a seating unit base, a backrest member that extends upward from the base, a movable seat member situated on the base, and a locking assembly. The seating unit base includes a support frame, first and second side walls, and a rear wall that extends between the first and second side walls. The backrest member constitutes at least a portion of the rear wall of the seating unit base. The movable seat member is positioned on the support frame and between the first and second side walls. The seat member is movably coupled or attached to the support frame of the seating unit base so that the seat member may be moved within a horizontal plane outward from the base support frame to one of several extended positions relative to the base. The locking assembly of the seating unit serves to selectively engage the seat member to the support frame of the seating unit base to thereby secure the seat to the support frame after positioning the seat to the desired extended position.

In another aspect, the present invention provides a seating unit that defines an interior chamber within its interior for storing a movable seat. The seating unit comprises a base that includes first and second sides, a rear wall that extends between the sides, and a support frame generally extending between those components. The seating unit also comprises a movable seat that is coupled to the support frame, the seat being sized to generally span between the first and second side walls. The seating unit also comprises a coupling assembly that secures the seat to the base and enables the seat to be moved relative to the base, between a fully retracted position in which at least a portion of the seat is positioned within the interior chamber, and a fully extended position in which a majority of the seat is outside of the chamber. The coupling assembly further enables the seat to be positioned to one of a desired position between a fully retracted position and a fully extended position.

In yet another aspect, the present invention provides a seating unit that includes a stationary base, and a linearly positionable seat that is coupled to the base. The seat is movable within a horizontal plane, and further movable between a fully retracted position and a fully extended position. When the seat is in a fully extended position, at least a portion of the seat is cantilevered out from the base. The seat is selectively positionable to one of a plurality of positions between a fully retracted position and the fully extended position.

In a further aspect, the present invention provides a seating unit having a remotely controlled movable seat. The seating unit comprises a base frame, a movable seat, an electrically operated drive system, and a remote control unit. The movable seat is supported by the base frame and coupled to the base frame such that the seat may be moved within a horizontal plane to one of numerous positions. The drive system is electrically operated and governs movement of the seat within the horizontal plane. The remote control unit is preferably wireless and is configured to selectively operate the drive system to thereby result in movement of the seat within the horizontal plane.

In a further aspect, the present invention provides an electrically powered seating unit having two or more independently movable seats. Specifically, the seating unit comprises a stationary base, at least two seats retained and supported by the base such that each of the seats is independently movable with respect to the other seat. The seating unit further includes electrically powered drive systems for each seat. Upon actuation of the drives, the corresponding seat moves. The seating unit further includes a remote control unit that includes provisions to activate at least one of the drive systems, and preferably all of the drive systems to thereby effect movement of the seats.

And in yet another aspect, the present invention provides a seating unit comprising a frame, a movable seat coupled to the frame, an assembly for coupling the seat to the frame and allowing movement of the seat between various positions, an electrically powered drive assembly, and a wireless remote control. The seat may be moved between an extended position in which the seat is located generally horizontally outward from the frame and a retracted position in which the seat is disposed next to a backrest portion of the seating unit. The wireless remote control unit is adapted to activate the drive assembly to thereby selectively move the seat.

Still other benefits and advantages of the invention will become apparent to those of average skill in the art upon a reading and understanding of the following detailed specification.

BRIEF DESCRIPTION OF THE DRAWINGS

The invention may take physical form in certain parts and arrangements of parts, several preferred embodiments of which will be described in detail in this specification and illustrated in the accompanying drawings, which form a part hereof and wherein.

It should be appreciated that many of the foregoing noted figures are schematic in nature and not necessarily to scale.

DETAILED DESCRIPTION OF THE PREFERRED EMBODIMENTS

In all of the various preferred embodiment seating units described herein, the one or more seats or seat frames are movable with respect to the base or support frame of the seating unit. The range movement is such that the seat or seat member may be displaced within a horizontal plane, or substantially so, outward from the seating unit. The seat may be displaced to one of a plurality of extended positions relative to the seating unit. Once the seat is moved or displaced to the desired position, it may be locked or otherwise secured to remain in that position by a locking assembly until the user releases the locking assembly and re-positions the seat or moves it back into its retracted position.

A significant feature of the present invention seating unit relates to the range and degree of movement of one or more seats or seat members in the seating unit. In a preferred embodiment, the seat or seat member moves within a single plane, typically horizontal or approximately so, defined about or along the front of the seating unit. This type of movement is different than conventional prior art seating units such as recliners, in which the seat unit, although movable, does not remain in a single horizontal plane as it moves, but instead passes through an arc or other curved path, or at least a plane that is other than horizontal. These features of the present invention are described and illustrated more fully below.

Figure 1:
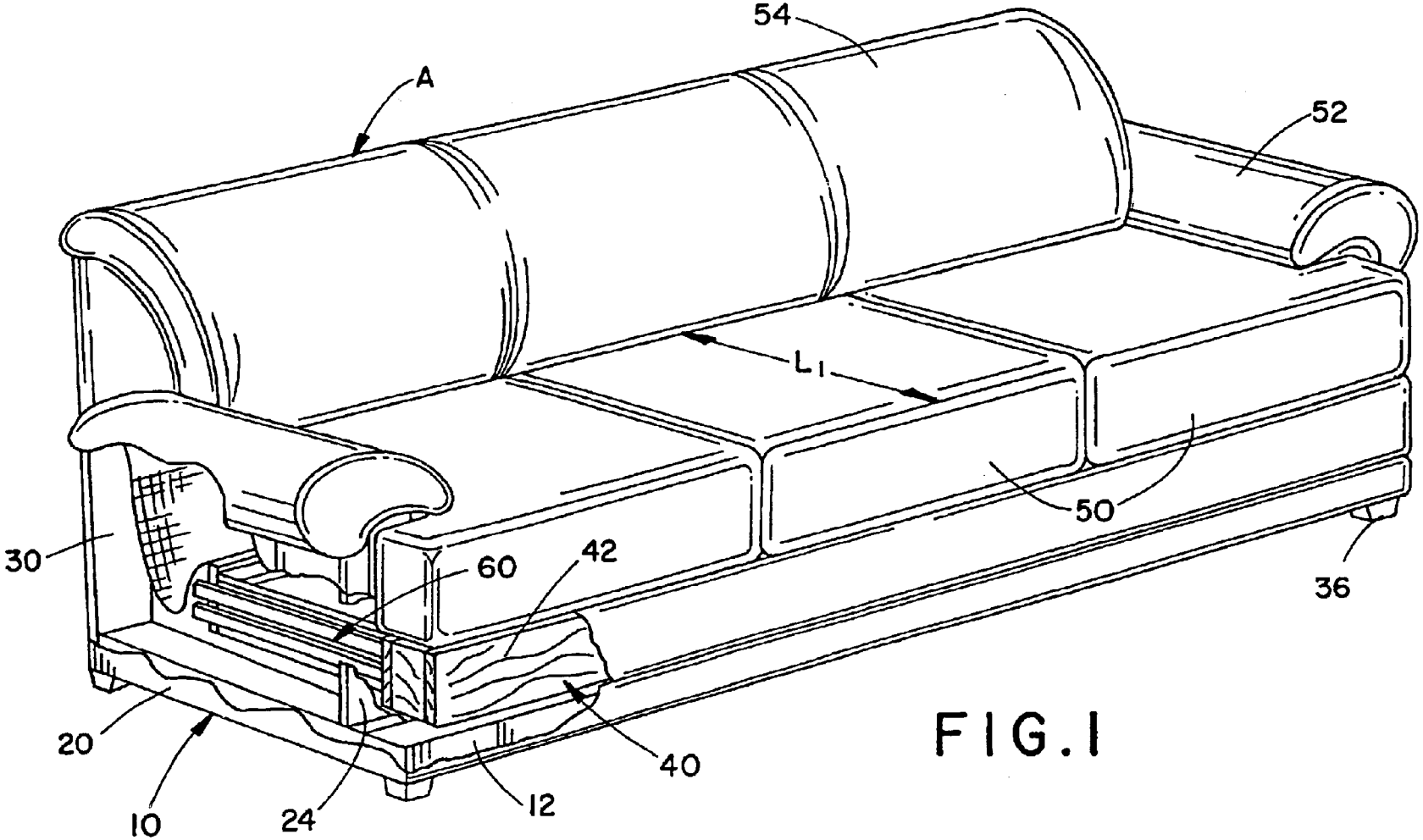
FIG. 1 is a perspective view, partially broken away, of a sofa according to the present invention in a retracted position.
Figure 5:
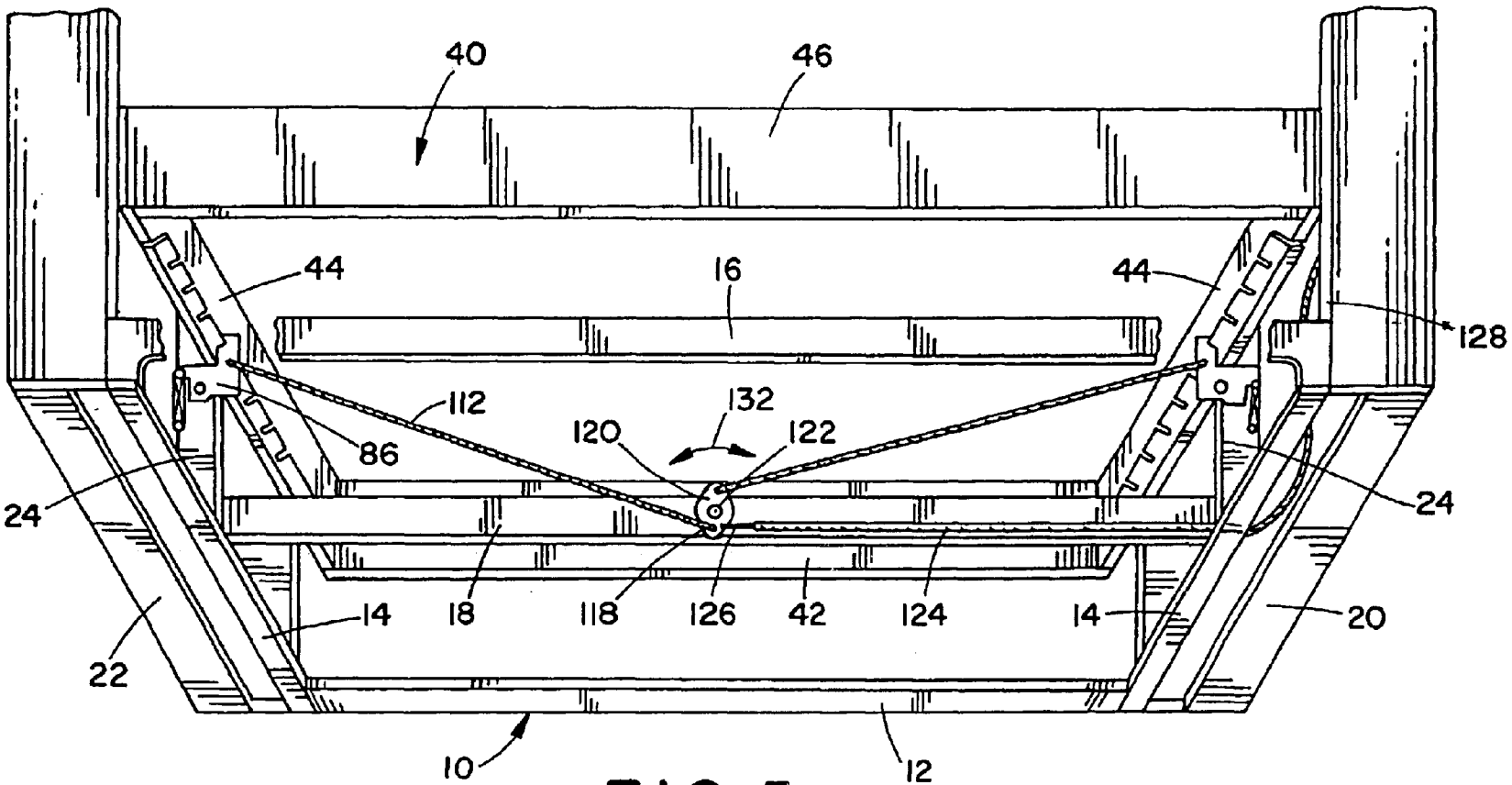
FIG. 5 is a perspective view from the bottom rear of the sofa of FIG. 1 with many portions of the sofa broken away for clarity.
Figure 6:
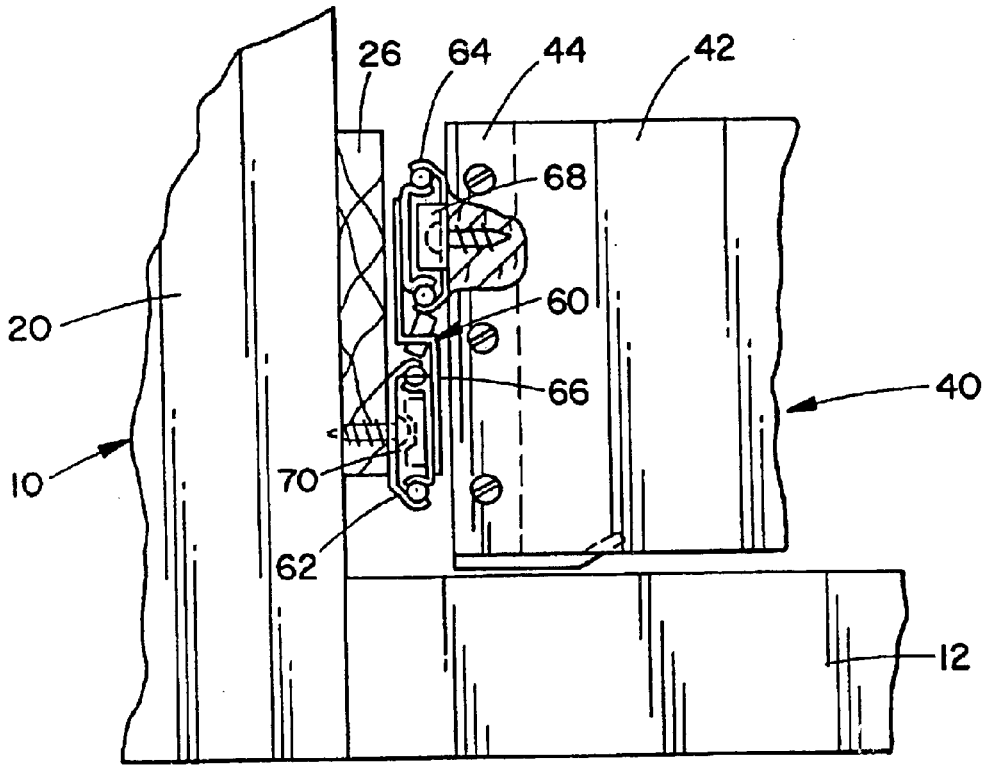
FIG. 6 is an enlarged front elevational view of a portion of the sofa of FIG. 1 with certain parts thereof removed for clarity.

Referring now to the drawings, wherein the showings are for purposes of illustrating several preferred embodiments of the invention only and not for purposes of limiting same, FIG. 1 shows a sofa A according to the present invention. The sofa includes a main frame 10 for supporting a backrest section and a seat section, as well as the arm sections of the sofa. With reference now also to FIG. 5, the main frame 10 comprises a front rail 12, a pair of spaced side rails 14 and a rear rail 16. A central rail 18 extends between the side rails 14 and is positioned between the front and rear rails to stiffen the main frame 10. Secured to a respective side rail 14 are left and right arm support truss members 20 and 22. A vertical brace 24 extends upwardly from each of the side rails 14 such that the central rail 18 is secured thereto. As best illustrated in FIG. 6, a horizontal brace member 26 is secured to each of the left and right arm support trusses 20 and 22.

Figure 3:
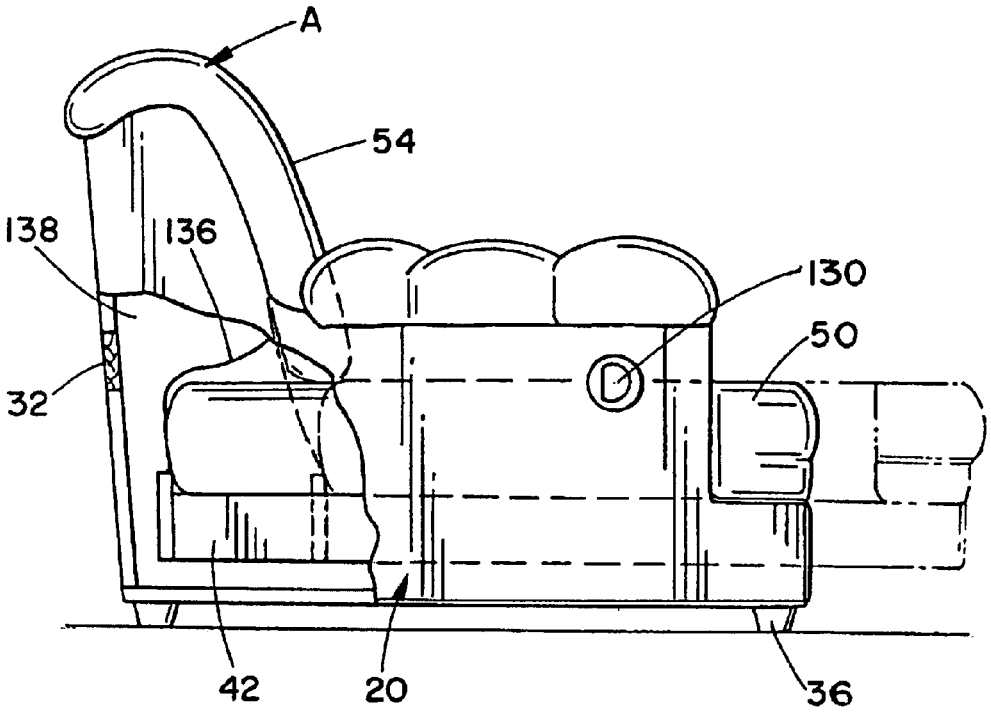
FIG. 3 is a side elevational view, partially broken away, of the sofa of FIG. 1.

With reference now again to FIG. 1, the main frame 10 also has a backrest truss 30 which extends vertically from the rear rail 16. As best shown in FIG. 3, a horizontal brace 32 is fastened between opposing ends of the backrest truss 30 to stiffen same. Normally, a support foot 36 is provided at each corner of the main frame 10 to elevate the sofa A from the subjacent floor surface.

Figure 2:
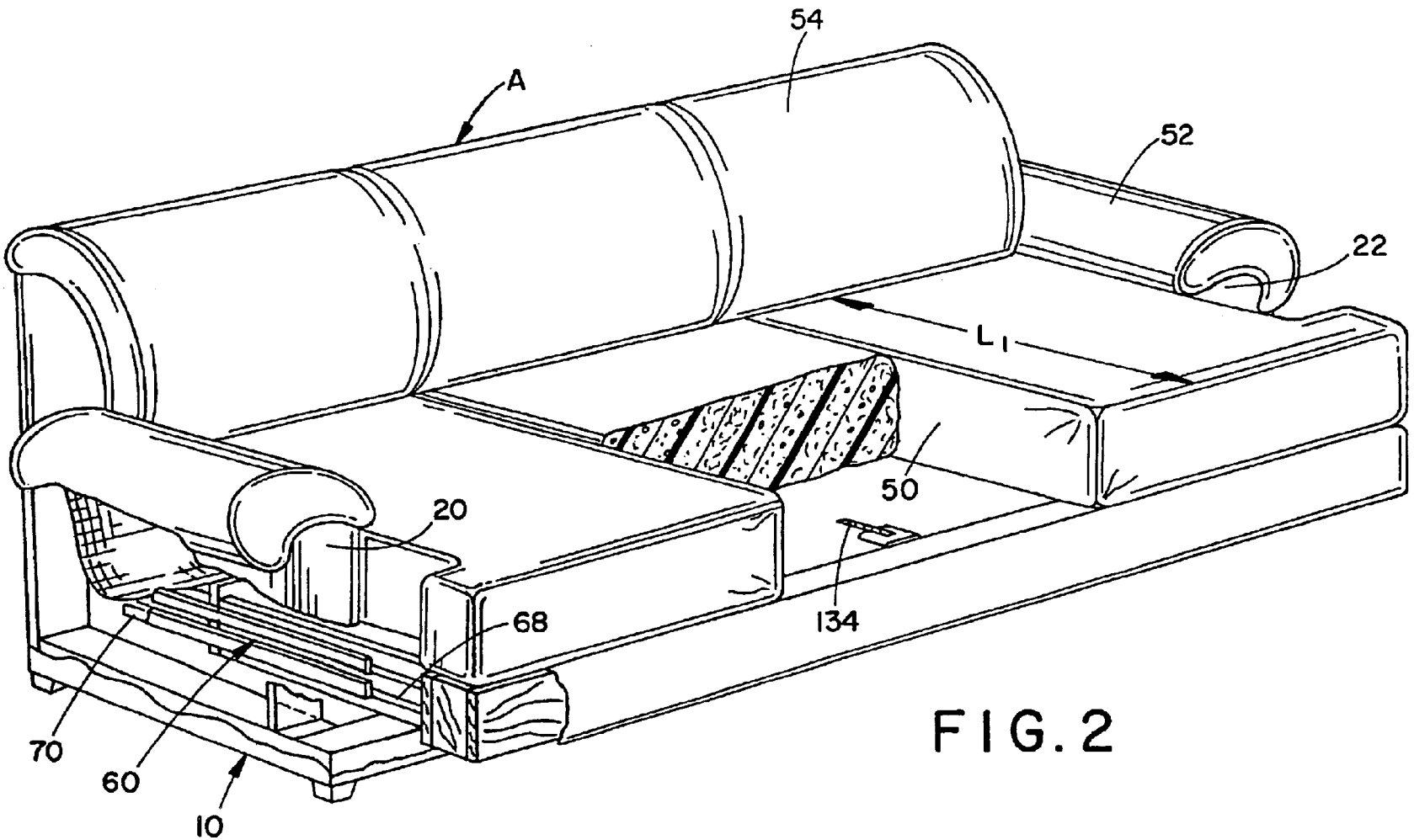
FIG. 2 is a perspective view, partially broken away, of the sofa of FIG. 1 in an extended position.

Slidably mounted on the main frame 10 is a seat frame 40. Although many of the seats and seat frames described herein are referred to as being slidably mounted or otherwise providing sliding movement, it will be understood that these references include other movements or mounting configurations besides a slide configuration. For example, roller, ball, and glide assemblies are included. With reference now again to FIG. 5, the seat frame comprises a front rail 42, a pair of side rails 44 and a rear rail 46 which are all secured together to form a box frame. Supported on the seat frame are a plurality of cushions 50 as illustrated in FIG. 2. It can be seen from FIGS. 1 and 2 that the two end cushions have arms which extend sideways so that they protrude in front of the arm supports 20 and 22. To this end, the seat frame 40 also has lateral extensions to support these portions of the cushions. Arm padding 52 is provided atop the left and right arm supports 20 and 22 and an upholstered back 54 is secured to the backrest section 30 of the main frame 10.

All of the frames, frame components, and frame subcomponents described herein, that is in all preferred embodiments described herein, may be formed from nearly any suitable material. Representative examples of such materials include, but are not limited to, nearly all types and grades of wood if sufficiently strong, steel, aluminum, and related alloys, composite materials, and plastic or polymeric materials. Steel frame construction techniques are known. It is also contemplated that a tubular frame construction could be employed for forming either or both of the main frame and seat frame(s) described herein. Tubular frames generally utilize a hollow metal member, preferably having a circular or square cross section, which is bent or otherwise formed into the desired shape or configuration. Generally, the selection of the material is dictated by factors such as cost, weight, and strength.

With reference now to FIG. 6, the seat frame 40 is slidably supported on the main frame 10 by a support track 60. The track can comprise a first track member 62 fastened to the horizontal brace 26, which is secured to the right arm section 20 of the main frame 10, and a second track member 64 fastened to the side rail 44 of the seat frame 40. A somewhat S-shaped connecting element 66 joins a pair of slide elements 68 and 70 which are mounted in respective ones of the track members 62 and 64. As best illustrated in FIG. 2, the slide elements of the first and second track members enable the seat frame 40 to slide from a retracted position to an extended position in relation to the main frame 10. The support tracks can be conventional drawer slides of the type manufactured by Knape & Vogt of Grand Rapids, Mich. under model No. 8500P. Of course, a variety of other known slides, which can have single tracks, triple tracks or any other desired number of tracks, could also be used.

Figure 4:
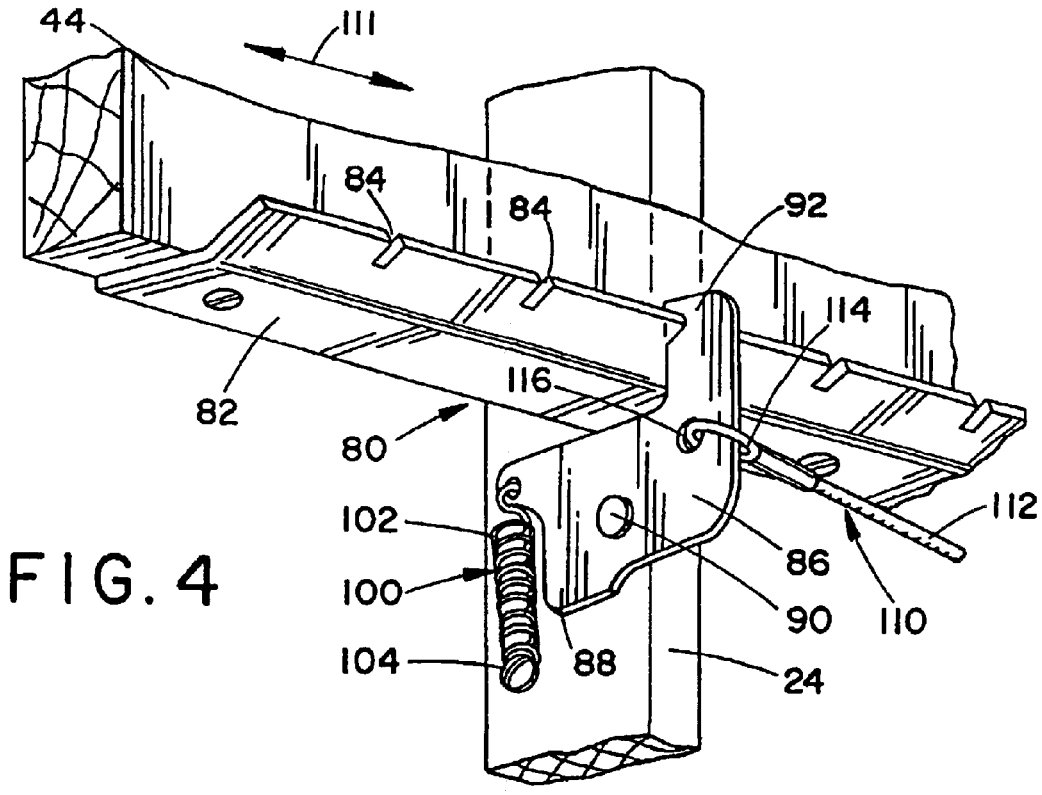
FIG. 4 is a greatly enlarged perspective view of a portion of the sofa of FIG. 1.

With reference now to FIG. 4, a locking means is provided for securing the seat frame 40 in relation to the main frame 10 in a plurality of positions between the retracted position illustrated in FIG. 1 and the extended position illustrated in FIG. 2. The locking means can comprise a plate 82 which is conventionally fastened—by screws or the like—to one of the side rails 44 of the seat frame 40. The plate has a plurality of horizontally spaced slots 84 therein. For example, the slots can be spaced from each other at 1 inch intervals, or at other desired intervals. Cooperating with the plate 82 is an arm 86. The arm has a first section 88 which is secured via a pivot fastener 90 to the vertical brace 24 of one of the right and left arm supports 20, 22. The locking plate 86 also has a second section 92 which is adapted to fit into any of the slots 84.

A biasing means 100 is employed to urge the plate 82 into an end position such that the plate second section 92 extends into one of the slots 84. The biasing means can comprise a spring 102 having a first end secured via a conventional fastener 104 to the vertical brace 24 and a second end secured in an aperture 106 of the plate first section 88. A control means 110 acts on the plate to rotate it around pivot 90 in opposition to the biasing means 100 so as to remove the plate second section 92 from the slots and thereby enable a horizontal movement of the seat frame 40 in relation to the main frame 10 as illustrated by arrow 111. The control means can comprise a cable 112 having a first end 114 secured in an aperture 116 defined in the plate 82. As illustrated in FIG. 5, the cable 112 has a second end 118 which is secured in a suitable aperture in a pivot plate 120. The pivot plate is secured via a fastener 122 to the central rail 18 of the main frame. It is evident from FIG. 5 that a pair of locking means 80 and its attendant biasing means and control means are provided so that each side rail 42 of the seat frame 40 has a respective plate 82 fastened thereto. Similarly, each of the vertical braces 24 has a respective arm 86 pivotally fastened thereto.

A control cable 124 is used to rotate the pivot plate 120. The cable has a first end 126 fastened to the pivot plate 120 and a second end 128 which is secured to a control knob 130 (see FIG. 3). Pulling the knob will pull the control cable 124 thereby pivoting the pivot plate 120 as illustrated by arrow 132. The rotating motion of the pivot plate 120 will cause the respective cables 112 to pull on the respective arms 86 in opposition to the respective biasing means 100 thereby removing the arm second sections 92 from the respective slots 84. This will enable the seat frame 40 to be then slid on the support track 60 in relation to the main frame 10. With the structure of the present invention, such sliding can take place even if a person is seated on the seat frame. Alternatively, a pull strap 134, as illustrated in FIG. 2, can be employed to pull on the control cable 124 and rotate the pivot plate 120.

As mentioned, the slots 84 in the plate 82 could be spaced apart at one inch intervals, one half inch intervals, two inch intervals or the like, if desired. There could be, for example, thirteen such slots on the plate 82. This enables a sequential movement of the seat frame 40 in relation to the main frame 10 by the chosen number of intervals. In sum, the seat can be slid forward in relation to the base of the sofa by a predetermined amount to suit the comfort of the occupant. In a prototype of a couch built according to the present invention, the length of the seat portion can be increased from 24.75 inches to 33.75 inches by the sequential movement of the seat frame forwardly from its retracted position to its extended position. Even in its extended position, the seat frame 40 is fully supported by the main frame 10 due to support track 60 which has elements fastened to each of the main frame and the seat frame.

It should be evident that with this arrangement, the cushions 50 are preferably deeper than they are on a conventional sofa or chair so as to accommodate the forward sliding motion of the seat frame in relation to the main frame, as best shown in FIG. 3. The cushions 50 in a retracted position of the seat frame, have a rear end extending beneath the upholstered back 54 of the sofa A. In order to insure that no articles fall between the upholstered back 54 and the rear edges of the seat cushions 50 when the seat frame is slid to its forward most position—as illustrated in dashed outline in FIG. 3—there is provided an apron 136 having one edge secured to the upholstered back 54 and another edge secured to the seat frame rear rail 46. In the retracted position of the seating unit, the apron 136 is hidden in a cavity 138 defined below the upholstered back 54 of the sofa A and the rear ends of the cushions 50 protrude into the cavity. In conventional couches and sofas, the cavity can have a depth of between five and thirteen inches and this space is unused. The apron 136 also keeps the cushions 50 from being pushed back into the cavity 138.

Figure 7:
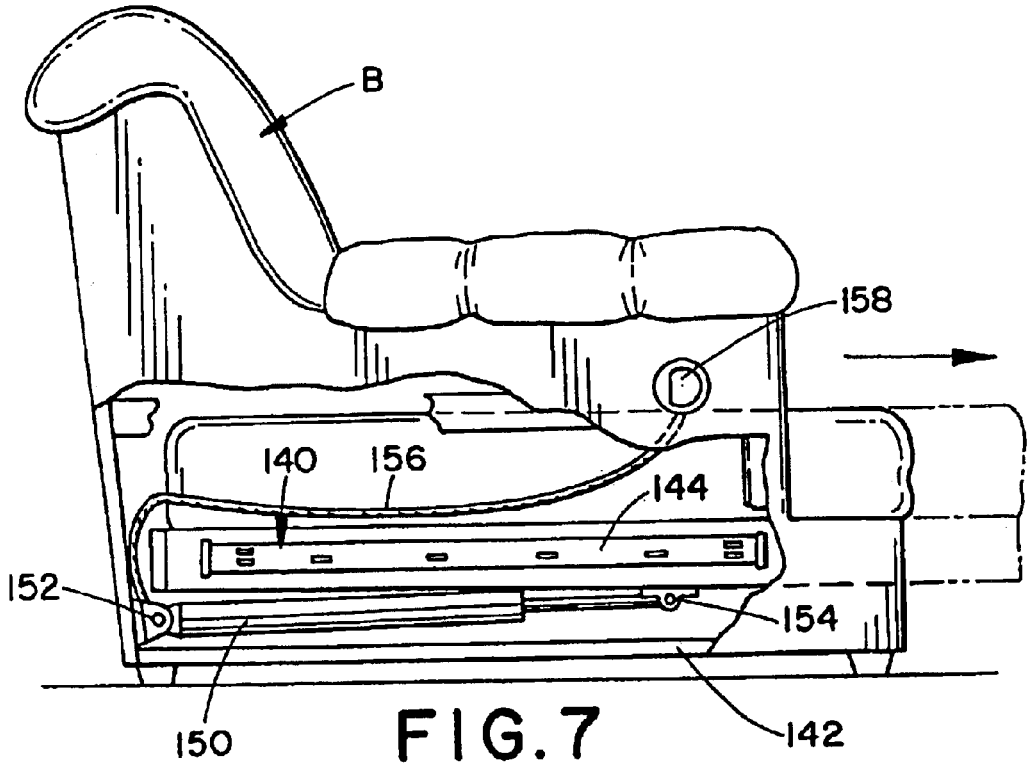
FIG. 7 is a side elevational view, partially broken away, of a chair according to a second preferred embodiment of the present invention.

With reference now to FIG. 7, there is shown a different means for extending a seat frame portion 140 in relation to a main frame portion 142 of a chair B. In this embodiment, while the same type of support track 144 is employed as in the embodiment of FIGS. 1–6, a means is provided for urging the seat frame to move in relation to the main frame. The means comprises a cylinder 150 having a cylinder end 152 pivotally secured to the main frame 142 and having a piston rod end 154 pivotally secured to the seat frame 140. A control cable 156 is actuated by a control knob 158 to actuate the cylinder and allow the piston and rod thereof to move in relation to the cylinder thereby allowing the seat frame 140 to slide in relation to the main frame 142. The chair B can employ the same type of locking mechanism as illustrated above in connection with FIG. 4.

Alternately, the cylinder 150 can be employed as a locking means. If the seat frame 140 is extended from the main frame 142 manually, the cylinder 150 can be used only as a locking means for selectively securing the seat frame in relation to the main frame at one of a plurality of positions. With the cylinder and piston rod arrangement, an infinite number of positions can be provided between a retracted position, as illustrated in solid outline in FIG. 7 and an extended position illustrated in dashed outline.

Figure 8:
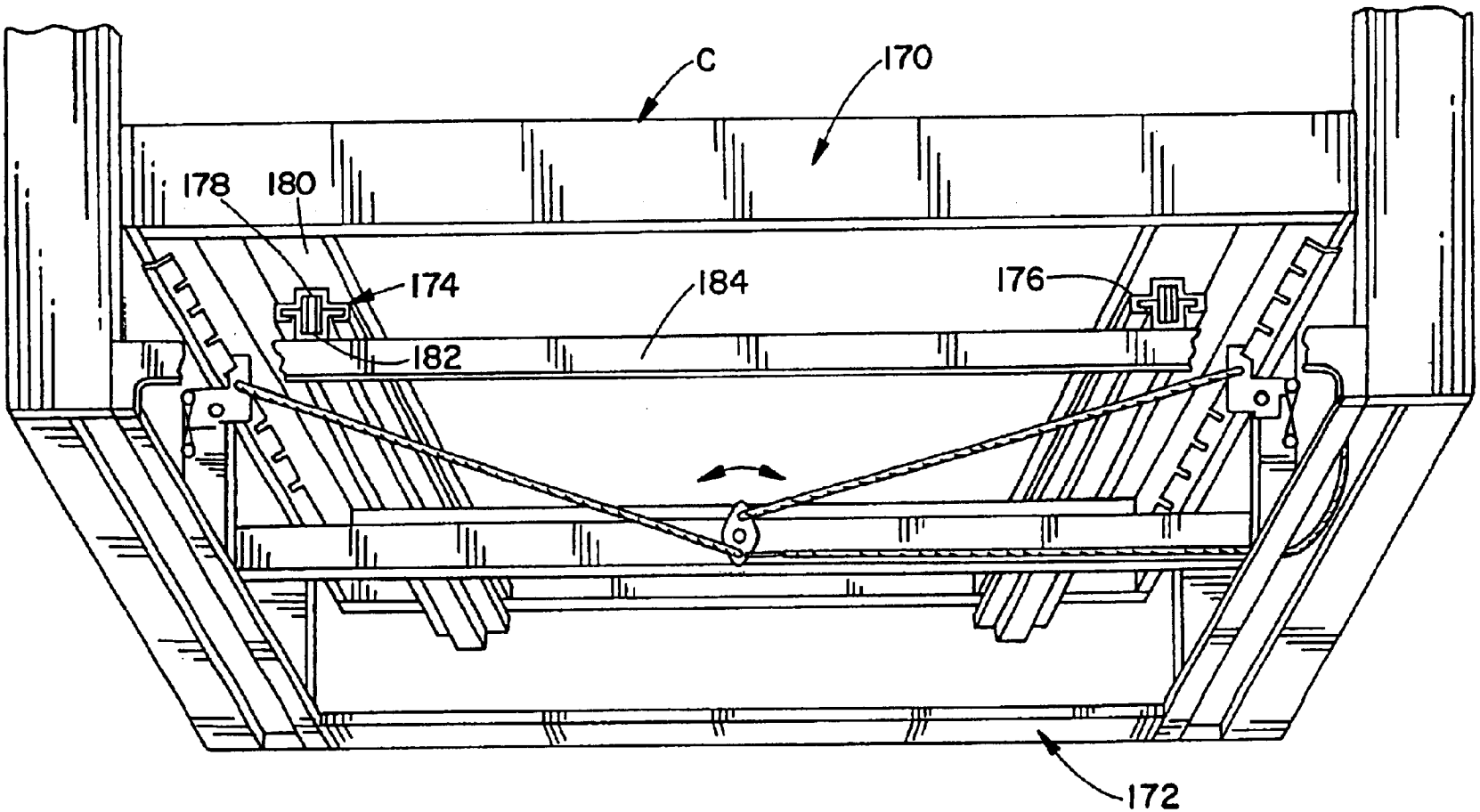
FIG. 8 is a perspective view of a sofa according to a third preferred embodiment of the present invention.

With reference now to FIG. 8, there is shown a sofa C having a seat frame 170 and a main frame 172. In this embodiment, rather than employing the support track illustrated in FIGS. 1–6, there are provided a pair of spaced glide tracks 174 and 176 located beneath the seat frame. The glide tracks are conventional and are identical to each other. Therefore, only one will be discussed in detail herein. The glide track 174 has a first element 178 fastened to a support member 180, which in turn is fastened to the seat frame 170 and extends parallel to the side rails thereof, and a second element 182 which is fastened to a cross brace 184 of the main frame 172. The glide tracks enable a smoother gliding effect on pulling out the seat frame.

Figure 9:
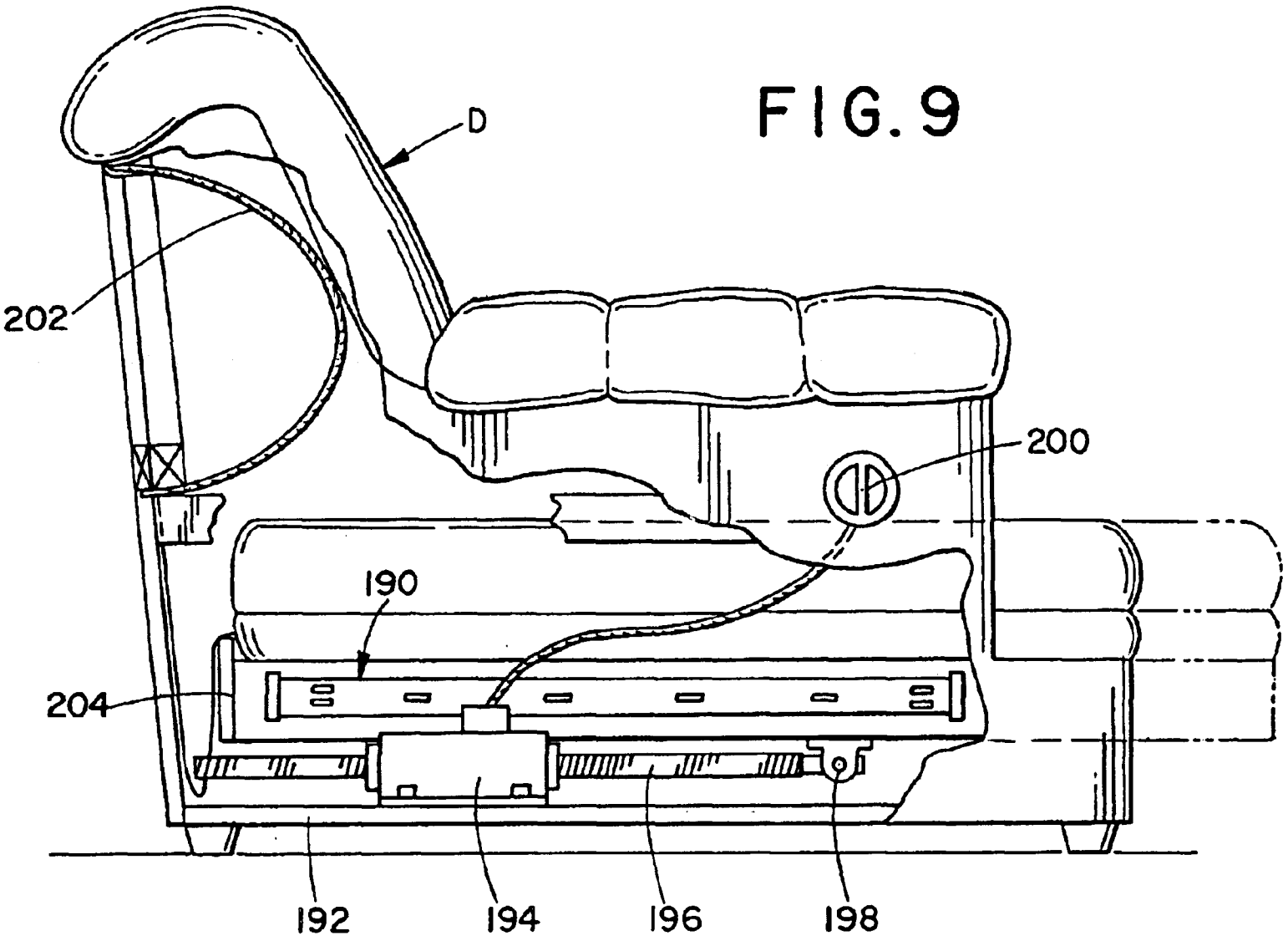
FIG. 9 is a side elevational view of a love seat according to a fourth preferred embodiment of the present invention.

With reference now to FIG. 9, there is shown a love seat D having a seat frame 190 that is slidably mounted on a main frame 192. A means for moving the seat frame 190 in relation to the frame 192 comprises a motor 194 which selectively operates a screw shaft 196 such as a conventional acme screw thread shaft having a first end 198 which is pivotally secured to the seat frame. A conventional handle control 200 enables a rotation of the motor 194 either in a forward direction, so as to extend the seat frame out of the main frame, or rearwardly so as to retract the seat frame back into the main frame. The motor 194 can be located at a desired location along the depth of the love seat. Obviously with this embodiment, electrical power is necessary to the motor 194. While one such motor is illustrated in FIG. 9, it should be appreciated that two motors can be provided, one on each end of the love seat D if so desired.

FIG. 9 further illustrates a flat "S" spring 202 which is suitably secured to the main frame 192. A plurality of such S springs are used to urge the backrest outwardly and provide support for the back of the seat's occupant.

Figure 10:
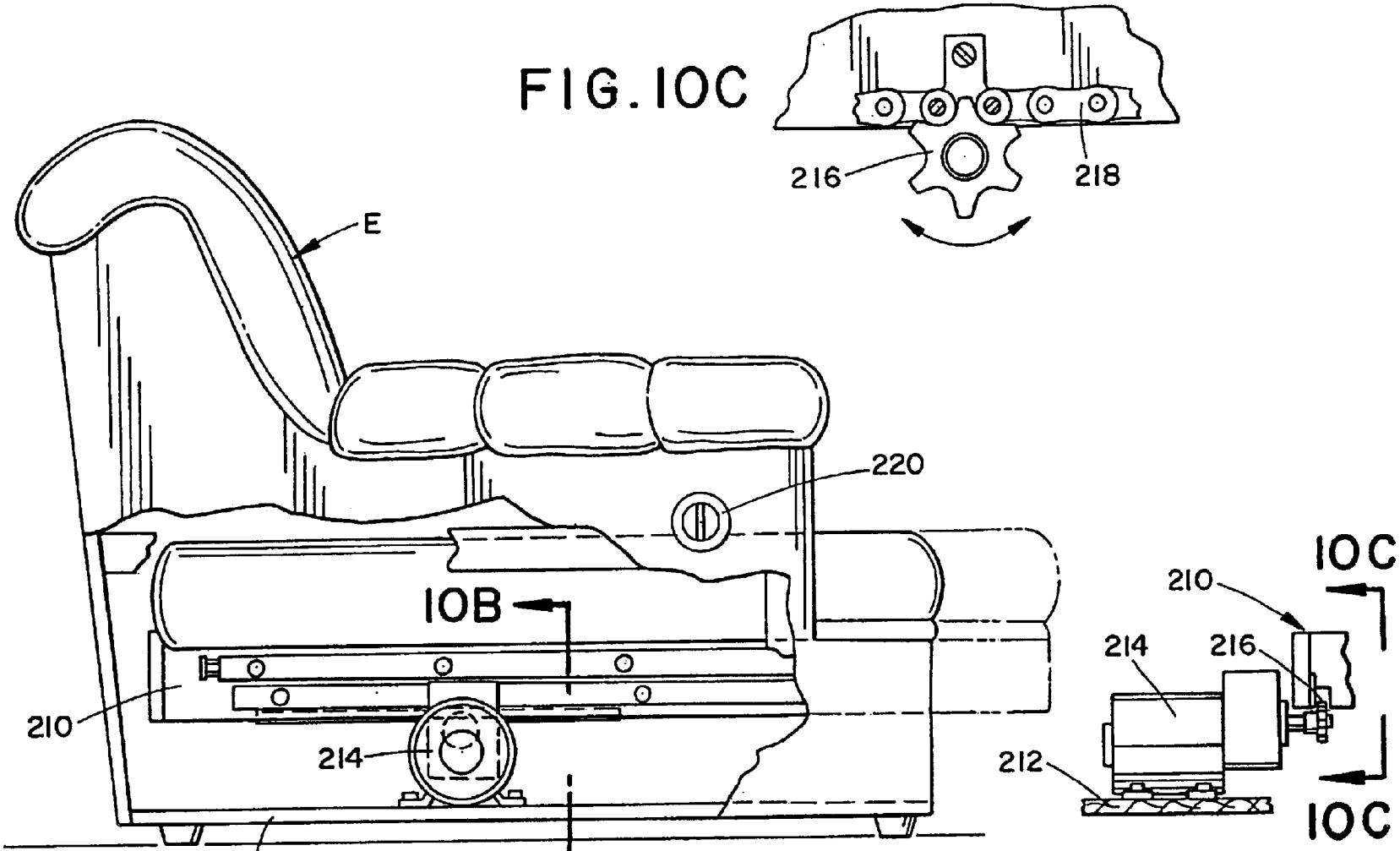
FIG. 10A is a side elevational view, partially broken away, of a sofa according to a fifth preferred embodiment of the present invention.
FIG. 10B is a front elevational view of a portion of the sofa of FIG. 10A.
FIG. 10C is a side elevational view of a portion of the sofa taken along lines 10C—10C.

With reference now to FIG. 10A, another sofa E is there illustrated having a seat frame 210 and a main frame 212. The seat frame is slidably mounted on the main frame via a rail assembly as has been previously described. The seat frame is moved in relation to the main frame via a pair of electric motors 214 (see FIG. 11). Each motor includes a sprocket gear 216 as illustrated in FIG. 10B. The sprocket gear cooperates with a respective rigid chain-like element 218 which is fastened to the seat frame 210 as shown in FIG. 10C. For control purposes, a control knob 220 is mounted on one of the arms of the sofa E. In this embodiment as with the embodiment of FIG. 9, electrical power is necessary to operate the motors.

Figure 11:
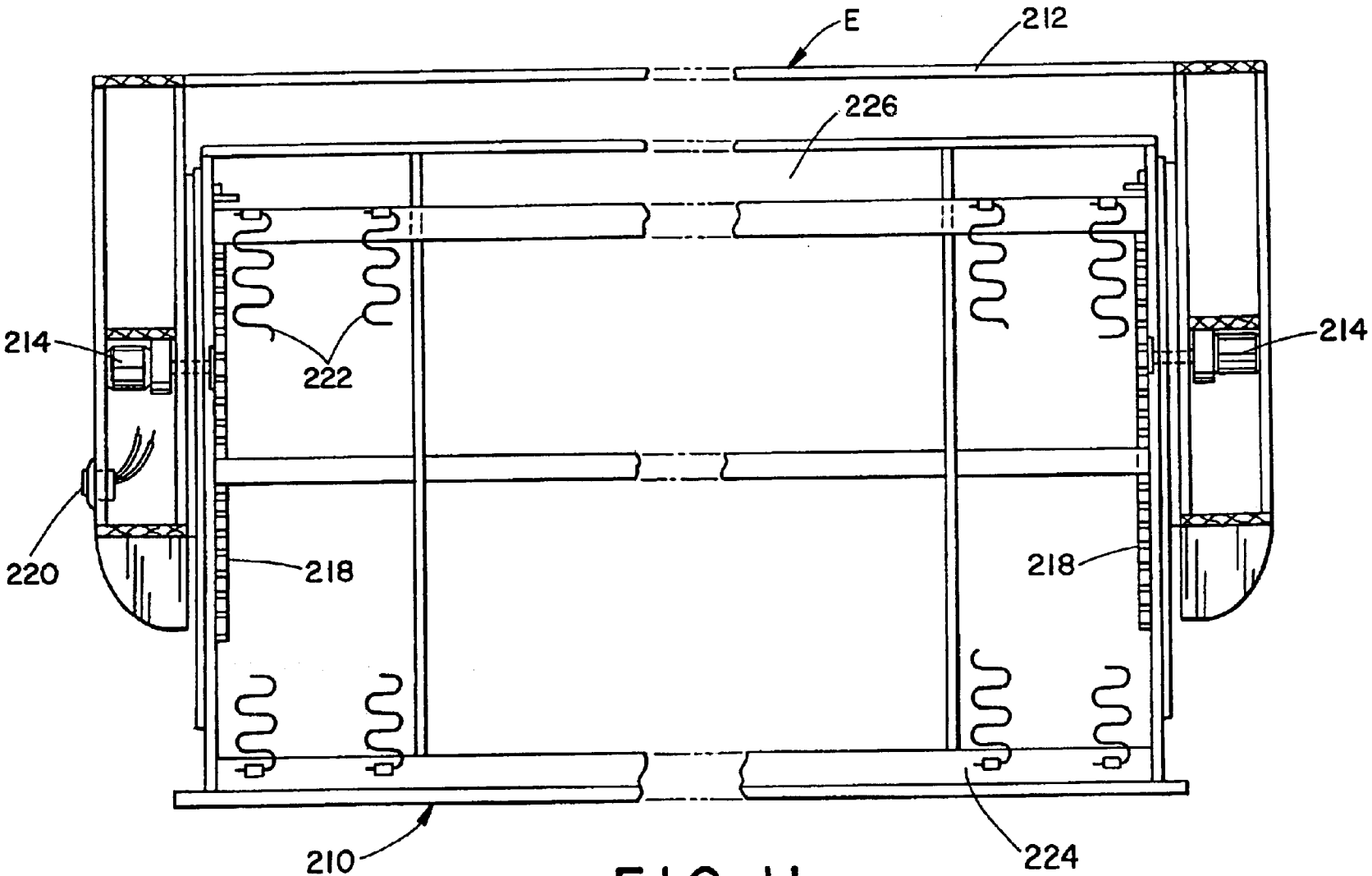
FIG. 11 is a bottom plan view of the sofa of FIG. 10A, partially broken away.

As illustrated in FIG. 11, supporting the cushions on the seat frame 210 are a plurality of spaced flat S springs 222. Each of these is secured to a front support member 224 and a rear support member 226 fastened to the seat frame 210. The support members are preferably boards that are secured by conventional means to the other elements of the seat frame 210. Such springs and boards can be used to support the cushions in the other embodiments illustrated previously.

Figure 12A:
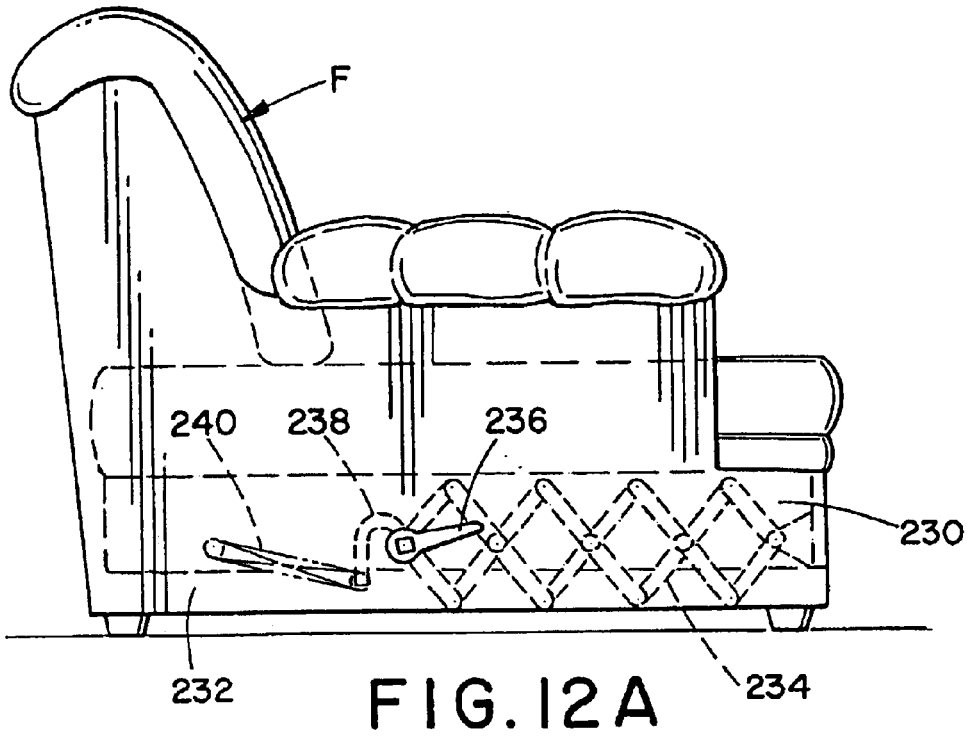
FIG. 12A is a side elevational view of a chair or sofa according to a sixth preferred embodiment of the present invention in a retracted position.
Figure 12B:
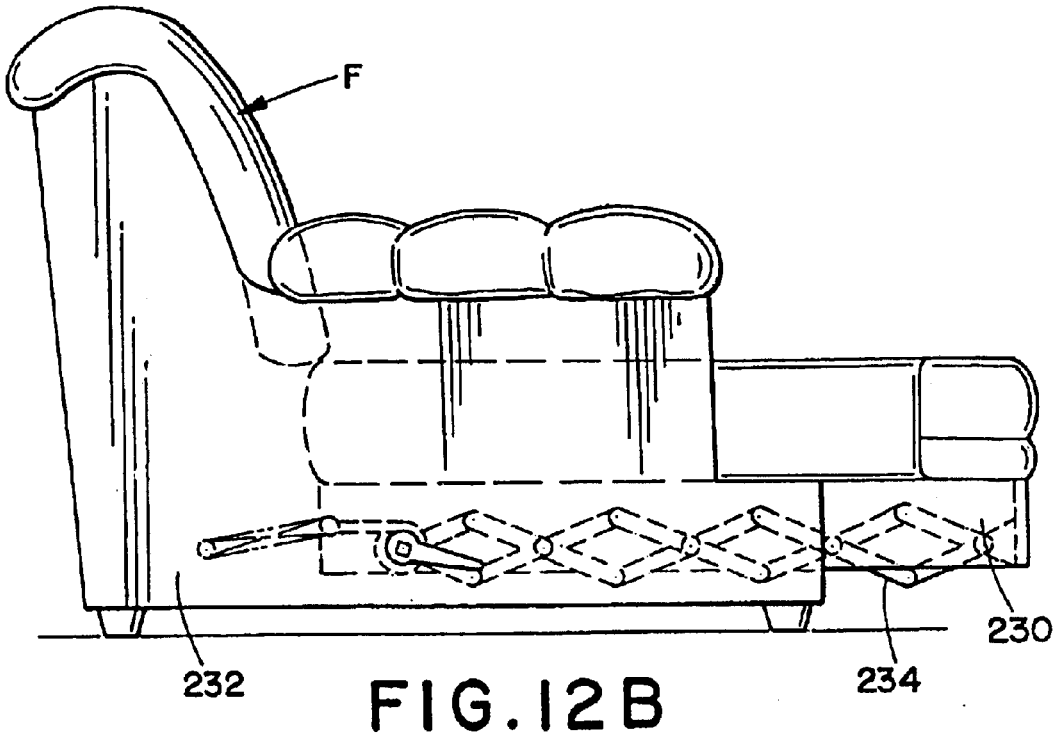
FIG. 12B is a side elevational view of the chair of FIG. 12A in an extended position.

With reference now to FIG. 12A, a chair F includes a seat frame 230 which is slidably mounted in relation to a main frame 232. A control means for actuating the seat frame in relation to the main frame comprises a scissor mechanism 234 which is actuated by a handle 236. The handle is connected to an A-hook 238 which is biased by a spring 240. This mechanism is conventional and enables a movement of the seat frame 230 from the retracted position illustrated in FIG. 12A to the extended position illustrated in FIG. 12B.

Figure 13:
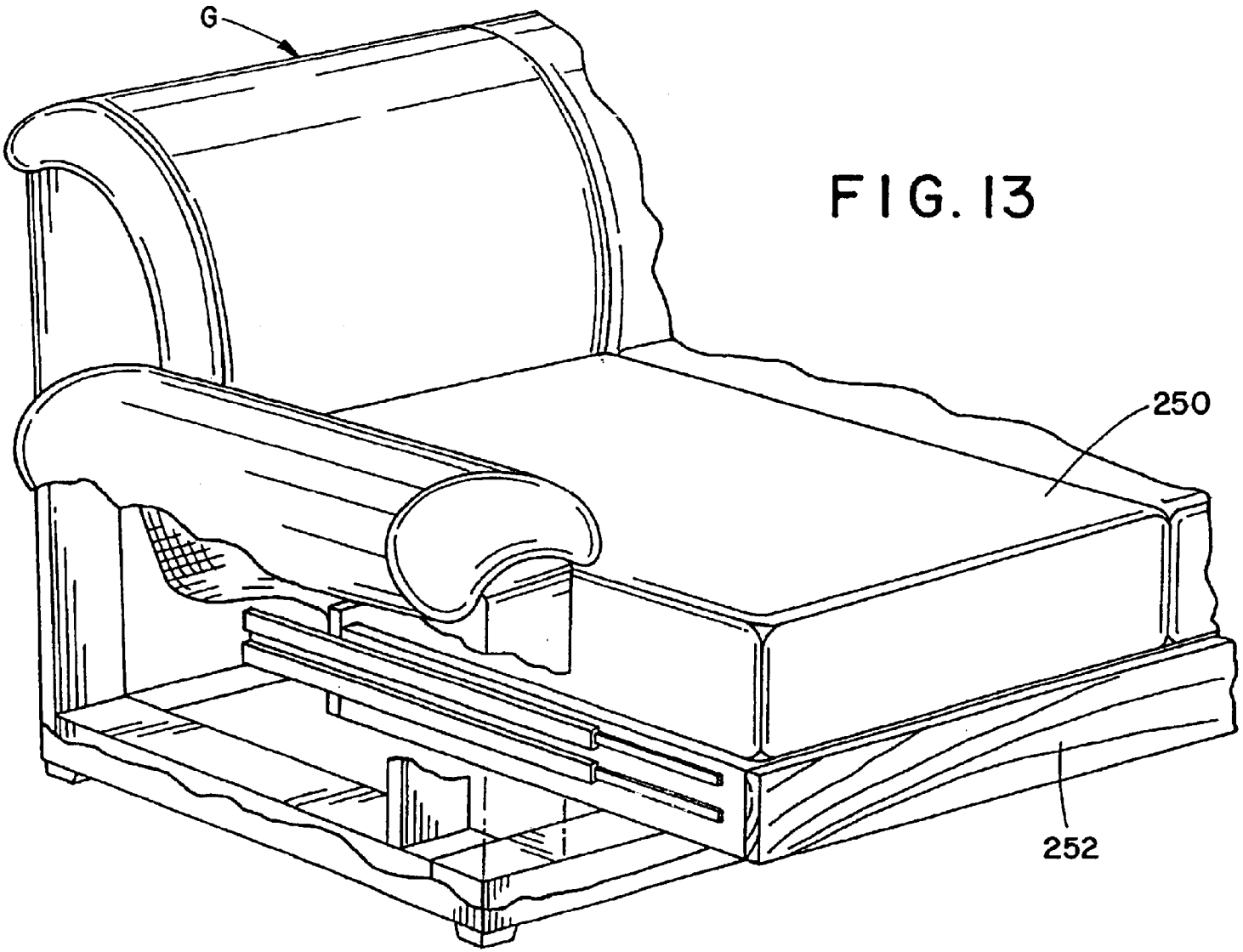
FIG. 13 is a perspective view, partially broken away, of a couch according to a seventh preferred embodiment of the present invention.

FIG. 13 illustrates a couch in which a plurality of cushions 250 are supported on a seat frame 252. Unlike the embodiment illustrated in FIGS. 1 and 2, the cushions 250 are all substantially rectangular and do not have the sidewardly extending protrusions illustrated in FIGS. 1 and 2. Therefore, the seat frame 252 similarly does not have a sidewardly extending section on each end.

Figure 14:
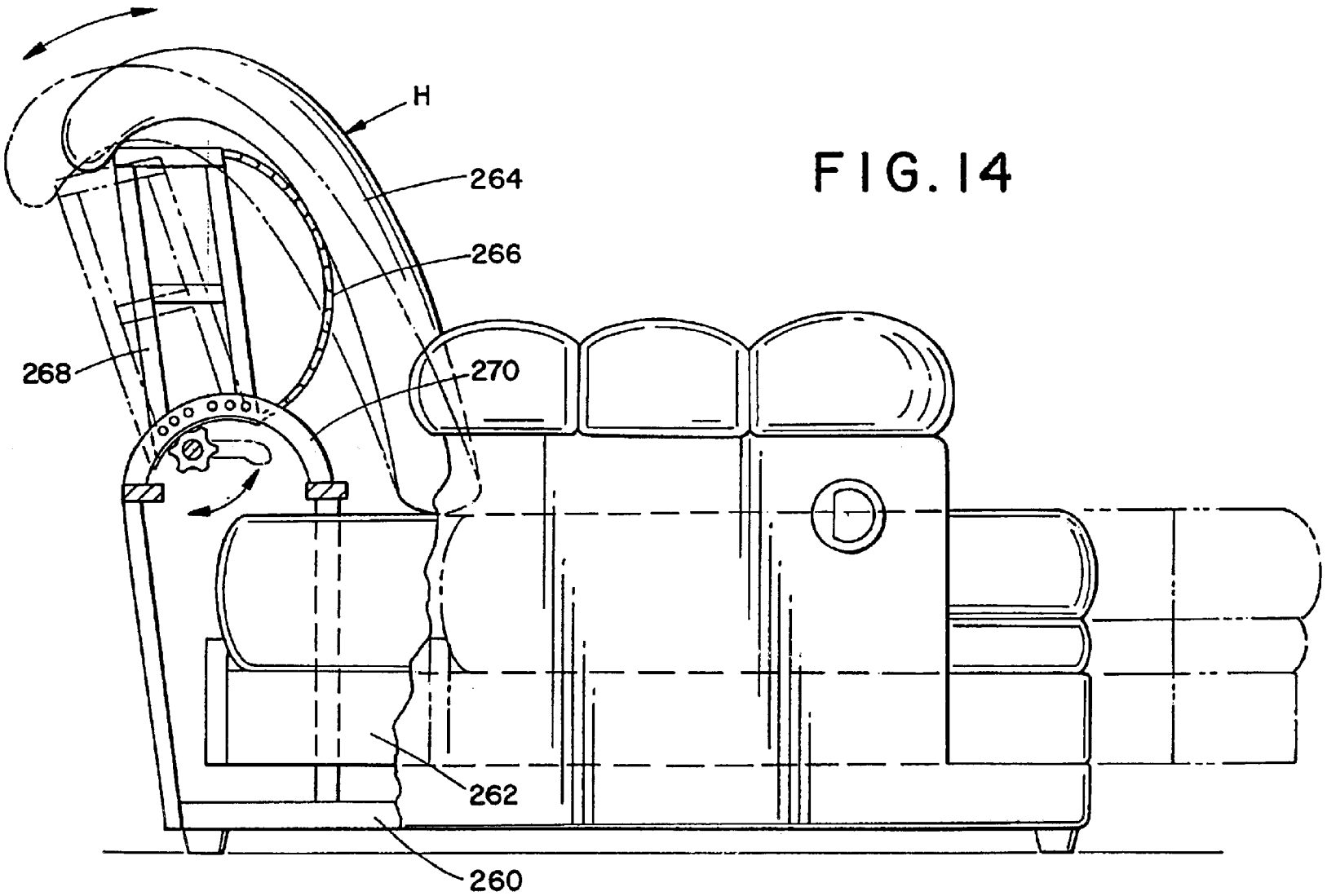
FIG. 14 is a side elevational view, partially in cross-section, of a couch according to an eighth preferred embodiment of the present invention.
Figure 15:
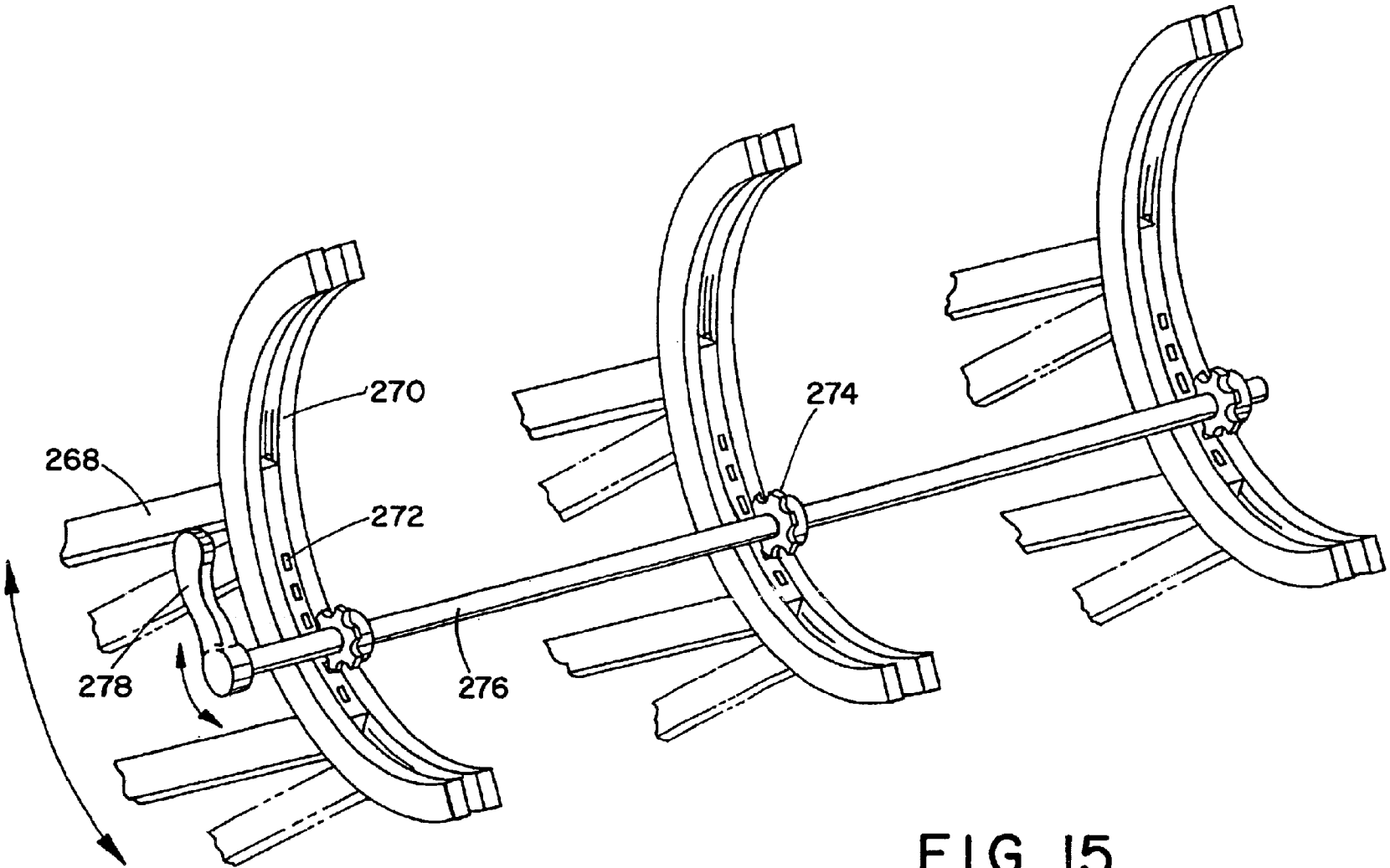
FIG. 15 is a bottom plan view of a backrest reclining mechanism for the couch of FIG. 14.

While all of the foregoing embodiments illustrated a design in which a backrest portion of the couch or seat was fixed, FIG. 14 illustrates an embodiment in which both the backrest and the seat portion of a couch H can move. The couch H comprises a main frame 260 on which a seat frame 262 is slidably supported. The main frame includes a backrest section 264. A set of flat S springs 266 resiliently supports the backrest 264. The springs 266 are mounted on a set of support braces 268. The support braces are, in turn, each fastened to a track 270. As is evident from FIG. 15, a plurality of such tracks are provided with each track being substantially U-shaped. Each track includes a central area having a number of longitudinally spaced slots 272 which are meant to accommodate gear teeth of respective sprockets 274. The sprockets are mounted on a rod 276. One end of the rod has fastened thereon a handle 278 which protrudes out of the backrest portion 264 of the couch so as to be manually engageable. With this embodiment, not only can the seat frame 262 be moved, as illustrated in dashed outline in FIG. 14, but the upper end of the backrest can also be lowered somewhat as similarly illustrated in dashed outline in FIG. 14. Therefore, this embodiment illustrates a movable back support section for a couch which also has a movable seat section.

Figure 16:
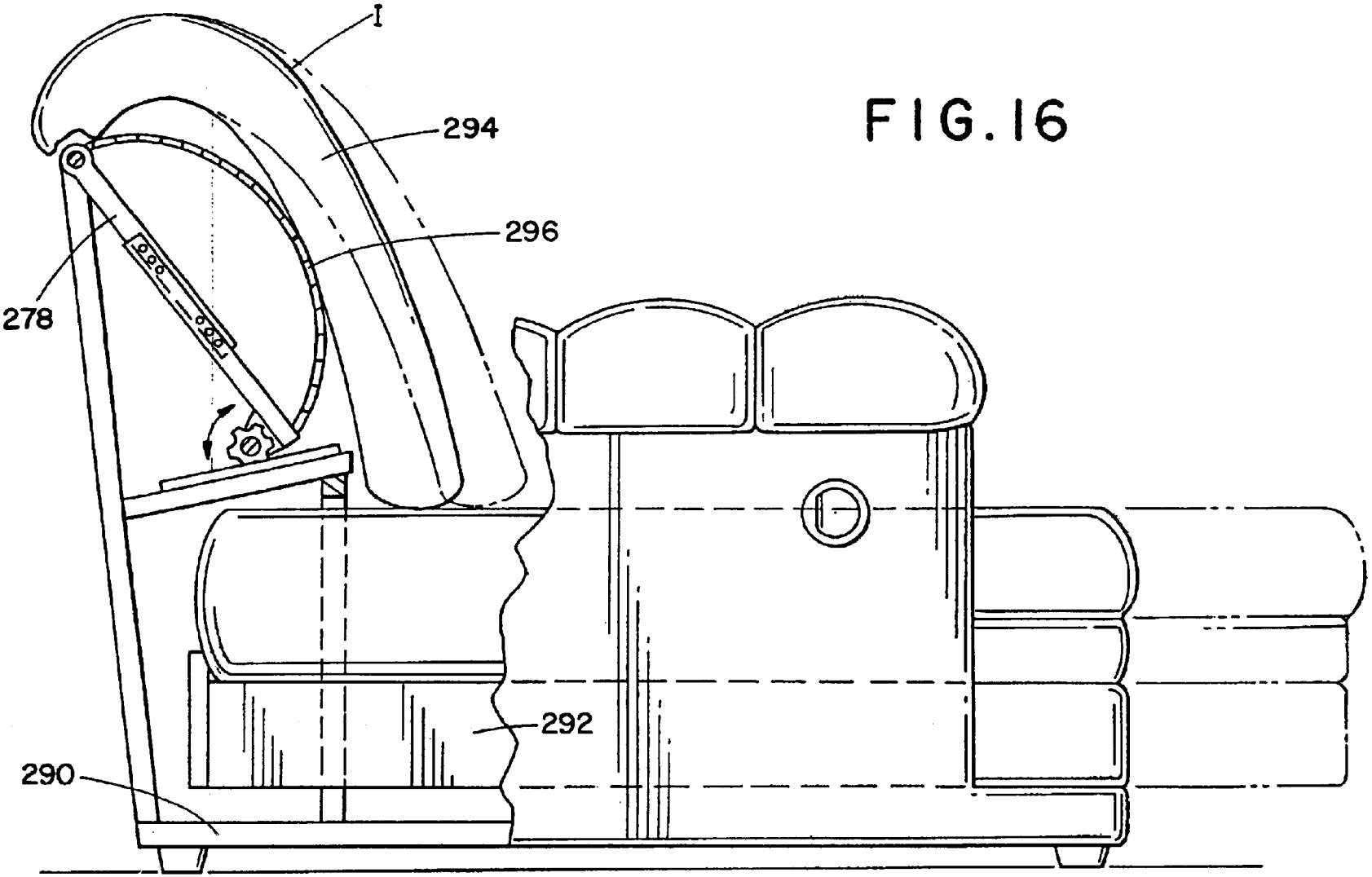
FIG. 16 is a side elevational view, partially broken away, of a couch according to a ninth preferred embodiment of the present invention.
Figure 17:
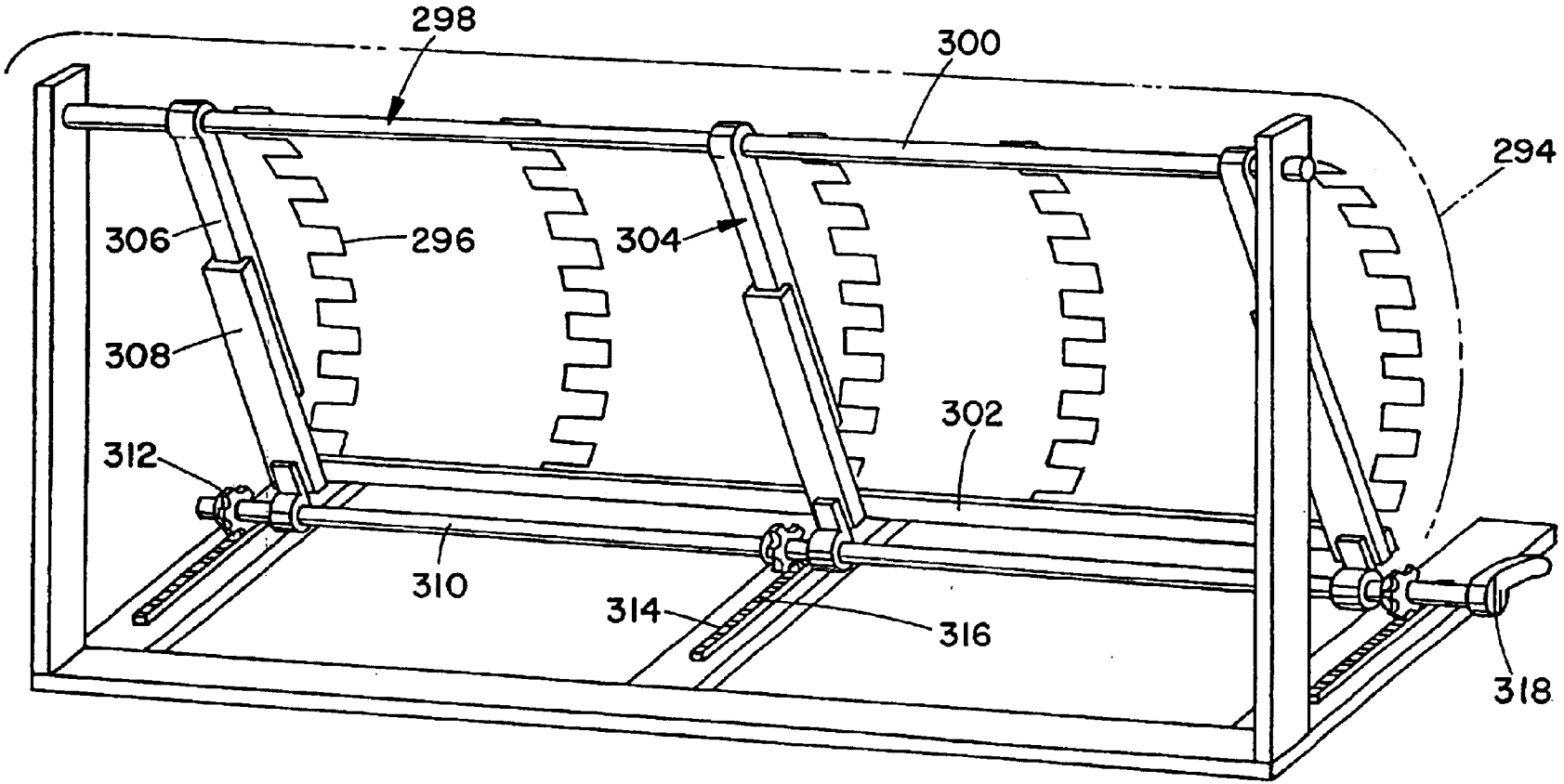
FIG. 17 is a perspective view from the rear of a lumbar backrest reclining mechanism for the couch of FIG. 16.

With reference now to FIG. 16, a couch I is there illustrated which has a movable seat and a movable backrest. In this embodiment, a main frame 290 has slidably mounted thereon a seat frame 292. The main frame comprises a backrest section 294 which is resiliently biased by a plurality of spaced flat S springs 296, as can be best seen from FIG. 17. The S springs are mounted on a support frame 298. The support frame comprises an upper rod 300 for holding a first end of each spring 296 and a support bar 302 for holding a second end of each spring. The rod 300 and support bar 302 are joined together by a plurality of spaced brace members 304. These each comprise a first telescopic element 306 and a second telescopic element 308. The set of second elements 308 are secured to a rod 310. Mounted on the rod are a plurality of sprockets 312. The sprockets each travel on a respective track 314 which includes a plurality of longitudinally spaced openings 316 for accommodating the teeth of the sprockets. The rod 310 is actuated by a handle 318 which is mounted on one end thereof so as to extend away from the backrest. With this embodiment of the invention, the bottom end of the backrest support can move inwardly and outwardly as is illustrated in dashed outline in FIG. 16.

Figure 18:
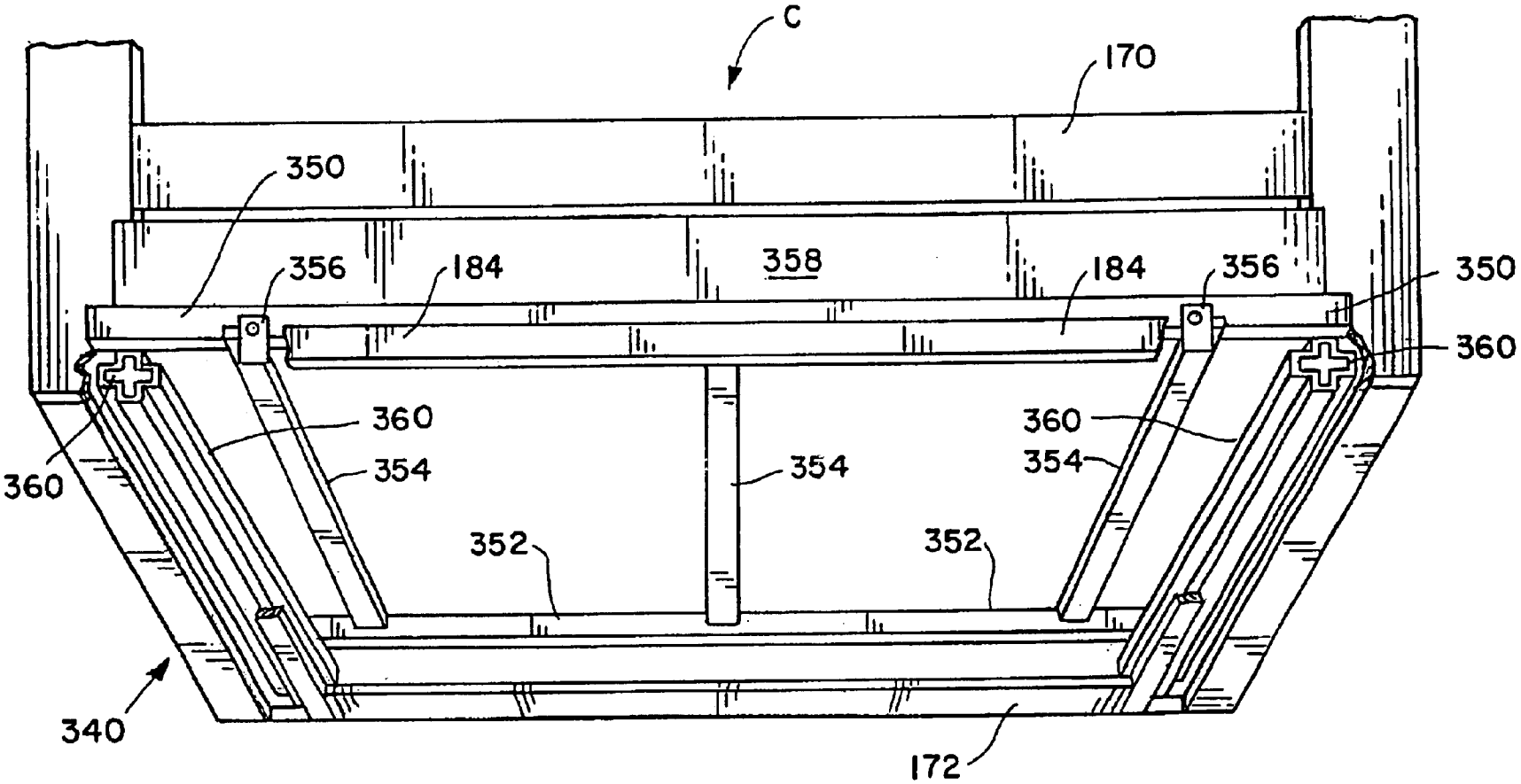
FIG. 18 is a perspective view of the third preferred embodiment sofa utilizing a first alternate frame assembly according to the present invention.

The present invention further provides an alternate frame assembly for use with any of the seating units described herein. For purposes of discussion, this first alternate frame assembly 340 will be described in conjunction with sofas A, C, and E. FIG. 18 illustrates the underside of the third preferred embodiment sofa C utilizing the first alternate frame assembly 340. The frame assembly 340 comprises a longitudinal rear frame member 350, a longitudinal front frame member 352, and one or more transverse frame members 354, preferably extending between the frame members 350 and 352. The longitudinal rear frame member 350 is disposed along the rear portion of the seating unit, preferably parallel to a cross brace 184. Similarly, the front frame member 352 is disposed along the front region of the seating unit, and most preferably oriented parallel to the rear frame member 350. The one or more transverse frame members 354 extend between the frame members 350 and 352 and are preferably oriented perpendicular thereto. One or more brackets 356 can be used to secure the frame members 350, 352, and/or 354 to one another. The frame members 350, 352, and 354 form a rigid assembly that may be extended from the front of the seating unit, preferably by sliding along one or more tracks.

Extension of the frame assembly 340 is facilitated by a pair of sliding track assemblies 360 affixed to the seat frame 170 and/or main frame 172. The track assemblies 360 are preferably oriented perpendicular to the longitudinal frame members 350 and 352. The track assemblies may be horizontally oriented, or oriented at an acute angle relative to a horizontal floor surface. As will be appreciated, the track assemblies may be inclined relative to the floor by several degrees to provide a comfortable seating surface regardless of whether the seat frame 170 is retracted or extended relative to the main frame 172. alternatively, the track assemblies may be oriented parallel with the floor. Each track assembly 360 preferably comprises a first section that is secured to a stationary portion of the seating unit such as the main frame 172. Each track assembly also preferably comprises a second section that is secured to a movable portion of the seating unit such as the seat frame 170. The first and second sections are preferably slidably engaged with each other so that the second section may be easily moved relative to the first section, yet maintained or held in alignment therewith. A wide array of friction-reducing components such as bearings and lubricants may be used in the track assemblies 360 as known in the art.

Figure 19:
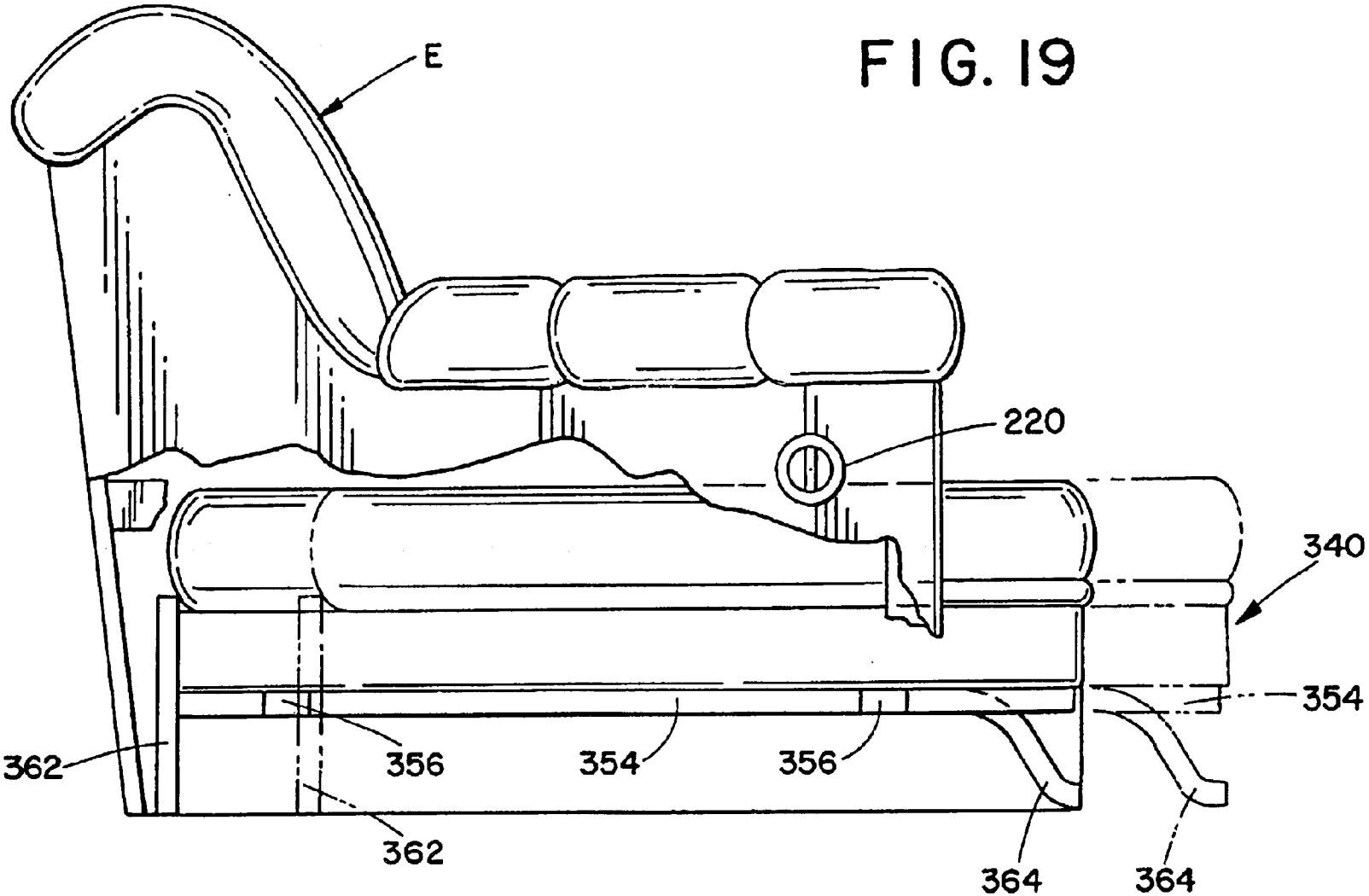
FIG. 19 is a side elevational view, partially broken away, of the fifth preferred embodiment sofa utilizing the first alternate frame assembly according to the present invention.

As previously noted, the frame assembly 340 may be used in any of the seating units described herein. FIG. 19 illustrates the fifth preferred embodiment sofa E utilizing the first alternate frame assembly 340. It is most preferred to provide one or more rear interior legs and one or more front interior legs for the frame assembly 340 to provide additional support for the frame assembly 340. FIG. 19 illustrates a rear interior leg 362 and a front interior leg 364, both extending downwardly from the underside of the frame assembly 340. As shown in FIG. 19, when the seat and accompanying frame assembly 340 is extended from the front of the seating unit to an extended position shown as dashed lines in FIG. 19, the front and rear interior legs 364 and 362, respectively, are also moved forward. It is contemplated to provide a wheel or roller assembly (not illustrated) at the distal end of each interior leg to facilitate movement of the interior legs with the seat as the seat is extended or retracted. This feature significantly increases the stability and support capacity of the seating unit, particularly when in an extended configuration.

As previously noted, it may in some instances be desirable to orient the movable seat at a slight inclination for comfort purposes. Regardless of the seat configuration, the track assemblies are preferably horizontally oriented, particularly when used in conjunction with the front and rear interior legs 364 and 362. As will be appreciated, the movable seat is preferably configured such that it extends outward in a plane parallel to the floor surface. And so, in this preferred configuration, the distance between the underside of the seat or interior legs, and the floor is the same regardless of whether the seat is extended, retracted, or at some position therebetween.

Figure 20:
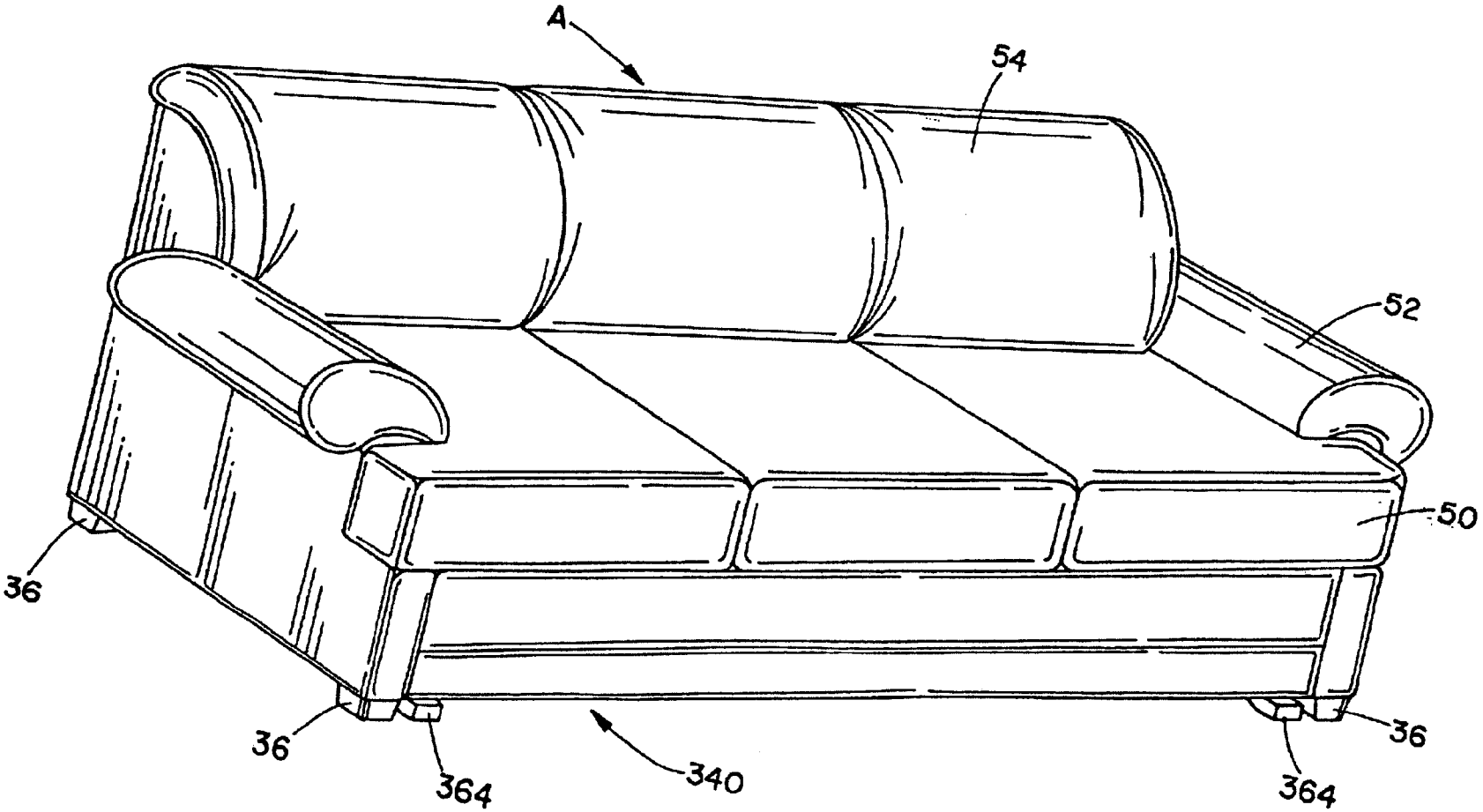
FIG. 20 is a perspective view of the first preferred embodiment sofa utilizing the first alternate frame assembly according to the present invention.

FIG. 20 illustrates the first preferred embodiment sofa A utilizing the alternate frame assembly 340. This view illustrates the relative position of the interior legs, such as front interior legs 364, relative to the support feet 36 of the sofa A.

It is also contemplated to provide one or more center support legs (not shown) between the front interior legs 364. In addition, one or more center support legs (not shown) could also be provided between the rear interior legs 362. Such center support legs provide additional load bearing capacity of the seating unit and enable the use of lighter and less bulky frame components.

Figure 21:
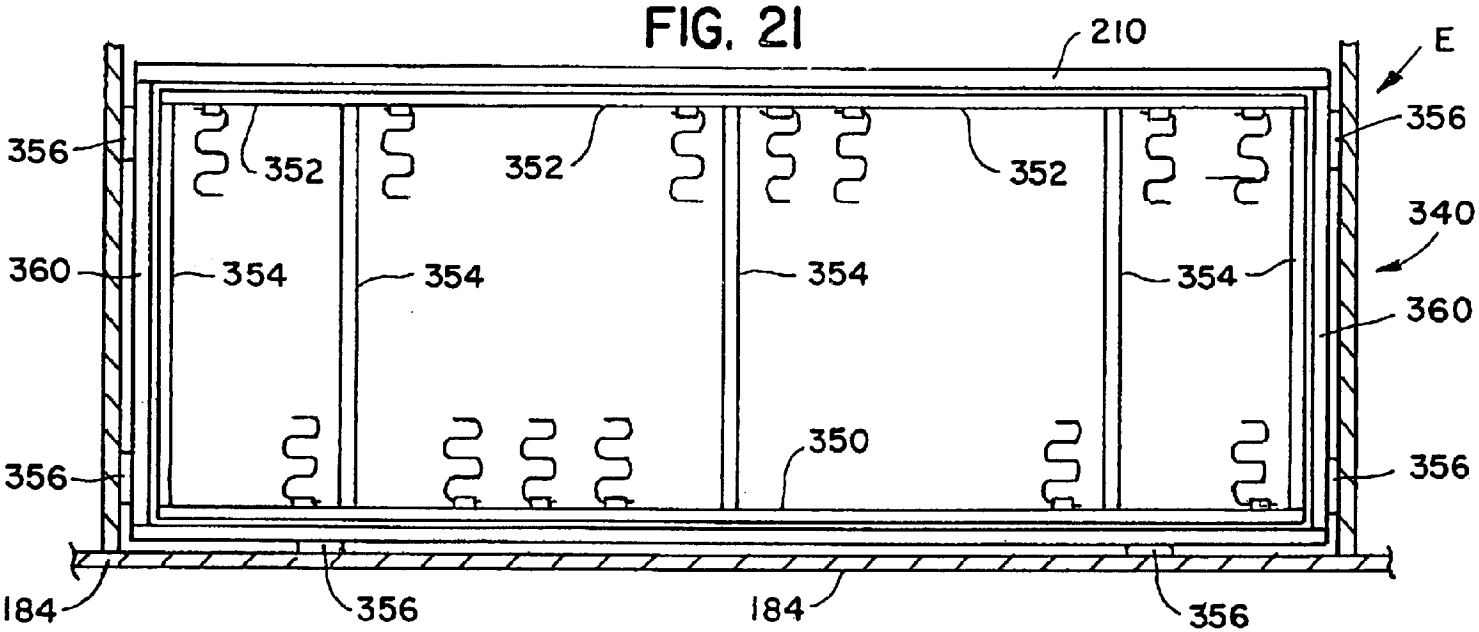
FIG. 21 is a bottom plan view of the fifth preferred embodiment sofa utilizing the first alternate frame assembly according to the present invention.
Figure 22:
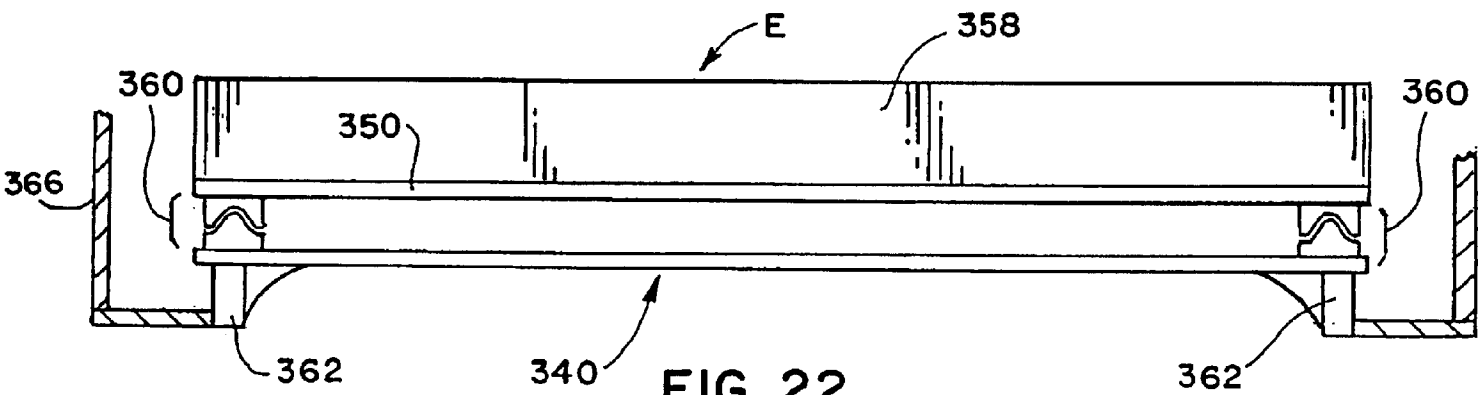
FIG. 22 is a partial rear elevational view of the fifth preferred embodiment sofa utilizing the first alternate frame assembly according to the present invention.

FIGS. 21 and 22 further illustrate the alternate frame assembly 340. FIG. 21 is a bottom plan view of the fifth preferred embodiment sofa E utilizing the frame assembly 340. In this version, a plurality of transverse frame members 354 are utilized, including positioning such members at both distal ends of the sofa E. FIG. 22 illustrates the rear of the fifth preferred embodiment sofa E and the frame assembly 340. FIG. 22 illustrates a riser member 358 preferably disposed on the top surface of the longitudinal rear frame member 350 and extending to, or constituting, part of a movable seat section. The riser member 358, is also shown in FIG. 18. It is also contemplated to use a similar riser member disposed along the top of the longitudinal front frame member 352. A pair of sliding track assemblies 360 are shown schematically. As shown in FIG. 22, it is also desirable to dispose the interior legs, such as the rear interior legs 362, directly below the sliding track assemblies 360, to provide support for the seating portion, particularly when the seat portion is an extended position. The interior legs, such as the rear interior legs 362 may also be configured such that when the seat portion is retracted within the seating unit, the legs 362 are proximate to, or immediately adjacent to, a side arm frame 366.

Figure 23:
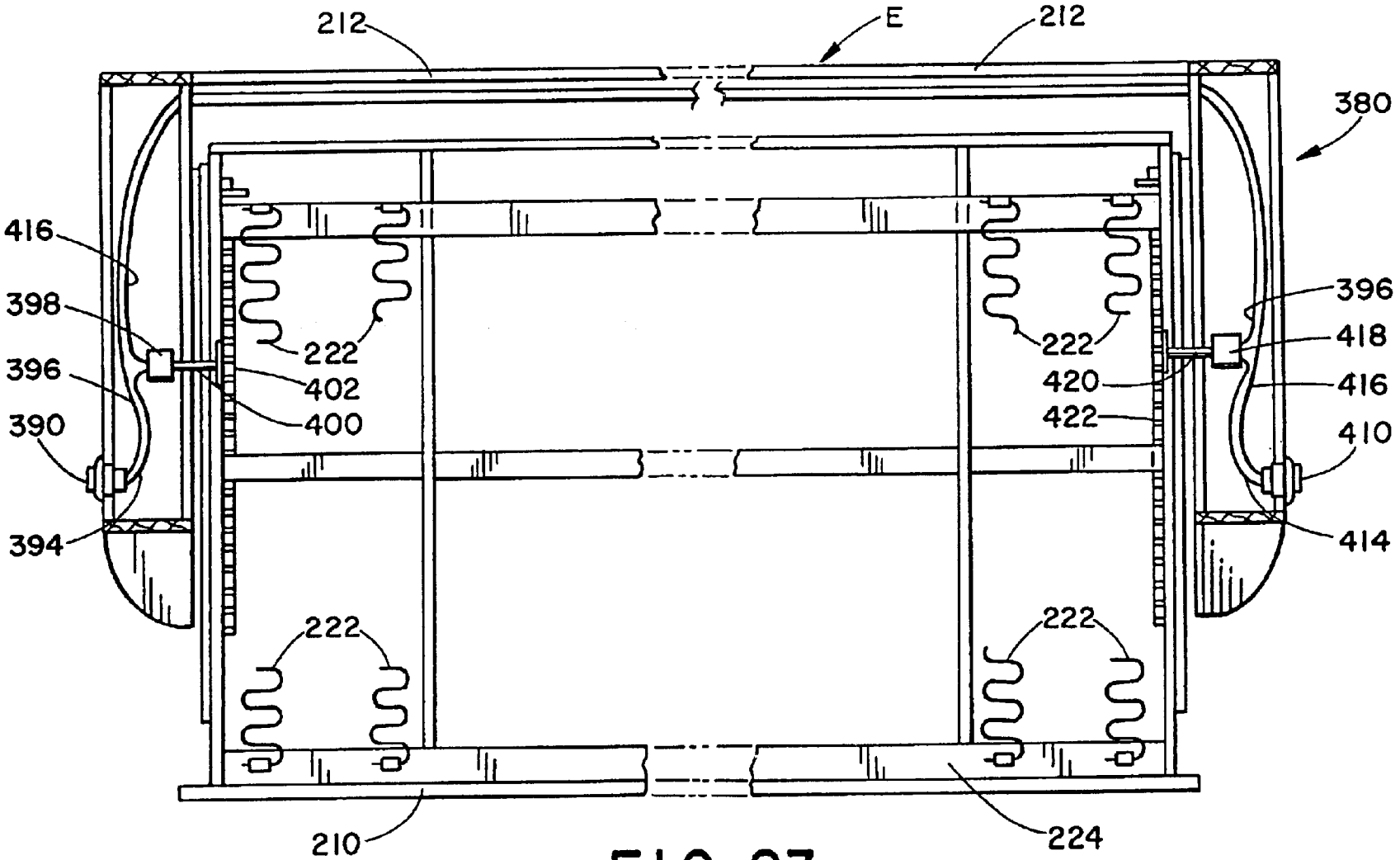
FIG. 23 is a bottom plan view of the fifth preferred embodiment sofa utilizing a first alternate actuation mechanism according to the present invention.

The present invention also provides numerous actuation mechanisms for enabling or effecting extension of the seat portion from the main seating unit. In addition to the various embodiments previously described herein, FIG. 23 illustrates an alternate actuation mechanism 380 utilized in the preferred embodiment sofa E. This alternate actuation mechanism 380 comprises one or more actuators or control knobs, one or more dual cable control adapters, one or more latching assemblies, and associated cabling. Specifically, and referring to FIG. 23, the alternate actuation mechanism 380 comprises a first control knob 390 disposed on one side or end of the sofa E. That control knob 390, upon proper or appropriate actuation, may activate or disengage, one or more latching assemblies, such as latching assemblies 400 and 420 described in greater detail herein, to enable the seat portion to be extended from or retracted within the seating unit. In the configuration shown in FIG. 23, a first side direct cable 394 extends between the first control knob 390 and a first side dual cable control adapter 398. A first side remote cable 396 extends between the first control knob 390 and a second side dual cable control adapter 418. All cabling utilized in conjunction with the actuation mechanism 380 preferably comprises an outer sheath or flexible housing, and an inner cable member, slidable therein. A first side latching assembly 400 is in operable engagement with the first side dual cable control adapter 398, preferably by a first side latch cable 404 (more fully described in conjunction with FIGS. 24–26). Disposed at the other end or side of the sofa E is a second control knob 410. A second side direct cable 414 extends between the second control knob 410 and the second side dual cable control adapter 418. A second side remote cable 416 extends between the second control knob 410 and the first side dual cable control adapter 398. A second latching assembly 420 is provided proximate the second side dual cable control adapter 418. The second latching assembly 420 is preferably in operable engagement with the second side dual cable control adapter 418 via a second side latch cable 424 (also described and shown in greater detail below). Upon actuation at either control knob 390 or 410, the seat portion may be extended from or retracted within the seating unit by disengagement of both latching assemblies 400 and 420. Each latching assembly is operably engageable with a latch rail 402 or 422, preferably affixed to the movable seat.

Figure 24:
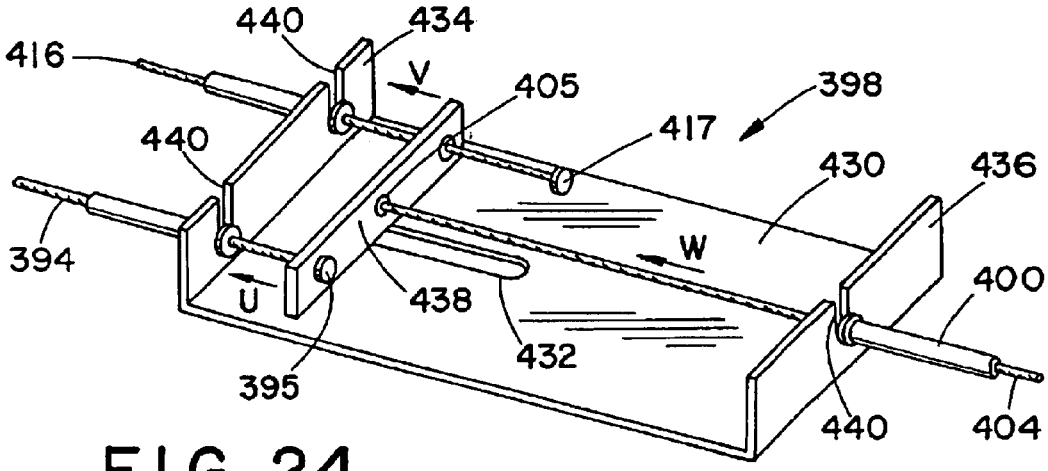
FIG. 24 is a perspective view of a preferred dual cable control adapter utilized in the first alternate actuation mechanism according to the present invention, and illustrating the adapter during actuation from one side or end of a seating unit.
Figure 25:
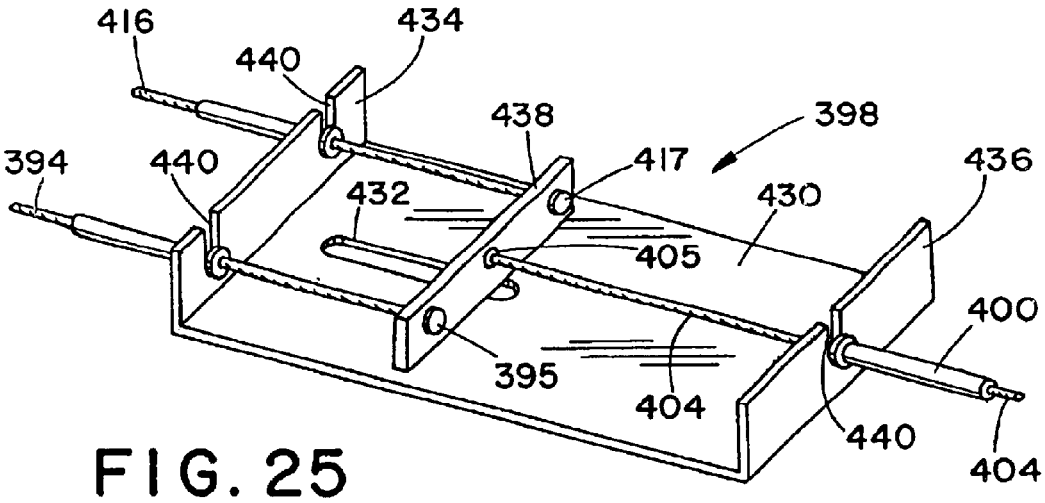
FIG. 25 illustrates the adapter shown in FIG. 24 in a stationary configuration.
Figure 26:
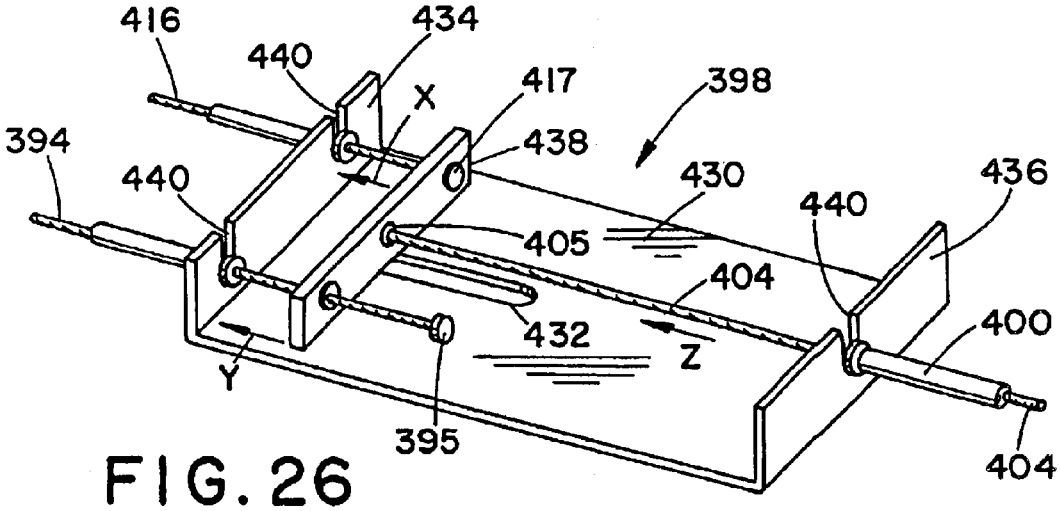
FIG. 26 illustrates the adapter shown in FIG. 24 during actuation from a second or other side or end of a seating unit.

FIGS. 24, 25, and 26 illustrate in greater detail the preferred dual cable control adapter utilized in the first alternate actuation mechanism 380. It is to be understood that the following description of the preferred embodiment adapter is given with respect to the first side dual cable control adapter 398, and so all references are with regard to that adapter and its associated cables and latching assembly at the first end of the sofa E. FIG. 25 illustrates the adapter 398 in a stationary configuration, i.e. in which neither control knob 390 or 410 has been actuated to change the position of the seat. The control adapter 398 comprises an adapter housing 430 having a first end 434 and a second, opposite end 436. Preferably, the first and second ends 434 and 436 are angled upwardly as shown in the referenced drawings. The adapter 398 further comprises a slidable actuator member 438, generally movable along a longitudinally oriented track 432 defined in, or provided along, the housing 430. The first end 434 preferably provides a pair of cable engagement slots 440 for receiving a pair of cables such as the first side direct cable 394 and the second side remote cable 416. The slots 440 are preferably sized so that they releasably engage an outer sheathing member or conduit enclosing the movable cable portion. The second end 436 similarly provides a cable engagement slot 440 for receiving a latch cable such as the first side latch cable 404. Each of the three cables 394, 416, and 404 extend toward and operably engage the actuator member 438. At each cable end is a retention member, preferably in the form of a ball or bulbous portion affixed to the cable end. The end 395 of the cable 394 extends through an aperture defined in the actuator member 438. Similarly, the end 417 of the cable 416 extends through a second aperture defined in the member 438. The enlarged end of each cable prevents the cable from being pulled through the respective aperture and away from the member 438. The latch cable 404 also extends to the member 438 and preferably, through an aperture defined in the member 438. Operation of the control adapter is as follows.

Referring to FIG. 24, in the event that the control knob 390 is actuated to thereby pull or place tension upon cable 394, the distal end 395 of the cable is pulled toward the first end 434 and engages the movable member 438. Movement of the cable 394 in the direction of arrow U causes movement of the member 438 along the track 432 in the direction of arrow V. Since the pulling force is applied through the cable 394 and not the other cable 416, the distal end 417 of the cable 416 remains stationary, or substantially so, as shown in FIG. 24. This configuration minimizes inducing excessive slack in the cable not being tensioned. However, it is contemplated to securely affix the end 417 of the cable 416 to the member 438 so that the cable end 417 is displaced along with the member 438 at all times. Movement of the member 438 in the direction of arrow V pulls the latch cable 404 in the direction of arrow W. Movement of the latch cable 404 actuates the latching assembly 400 as described in greater detail below.

Referring to FIG. 26, actuation by the other control knob, i.e. control knob 410 is shown. Upon actuation by the control knob 410, the cable 416 is pulled in the direction of arrow X. This causes displacement of the member 438 in the direction of arrow Y along the track 432. Linear movement of the member 438 pulls the cable 404 in the direction of arrow Z as shown in FIG. 26, thereby actuating the latching assembly 400.

Figure 27:
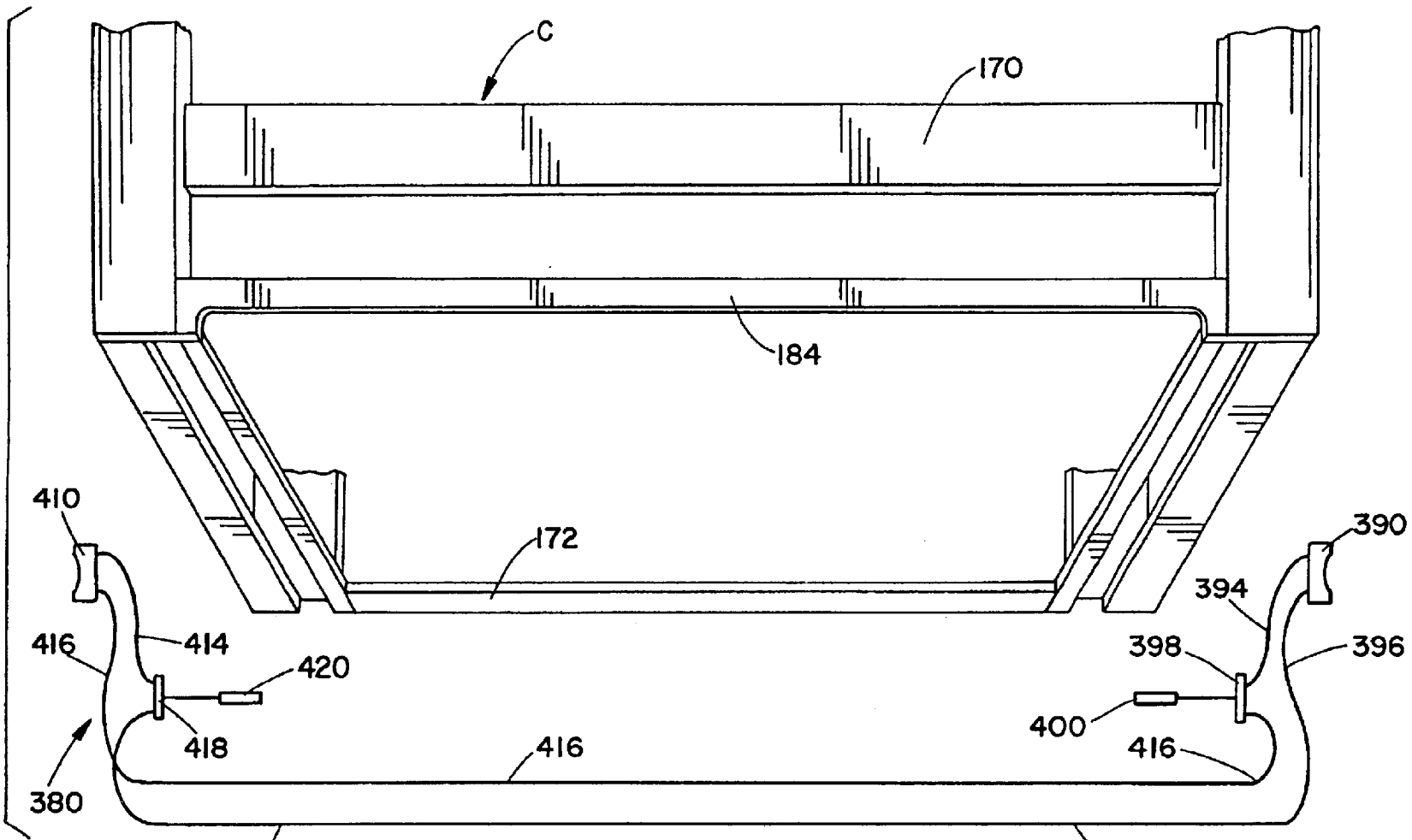
FIG. 27 is a partially exploded, perspective view of the third preferred embodiment sofa utilizing the first alternate actuation mechanism according to the present invention.

FIG. 27 is a partially exploded, perspective view of the third preferred embodiment sofa C utilizing the first alternate actuation mechanism 380. FIG. 27 more clearly illustrates the cable connection and configuration. It is to be understood that the use of the previously described dual cable control adapters and unique cable routing configuration enables simultaneous actuation of multiple latching assemblies from a single control knob. That is, both latching assemblies 400 and 420, located at opposite ends of the seating unit, may be simultaneously actuated at either end of the seating unit.

Figure 28:
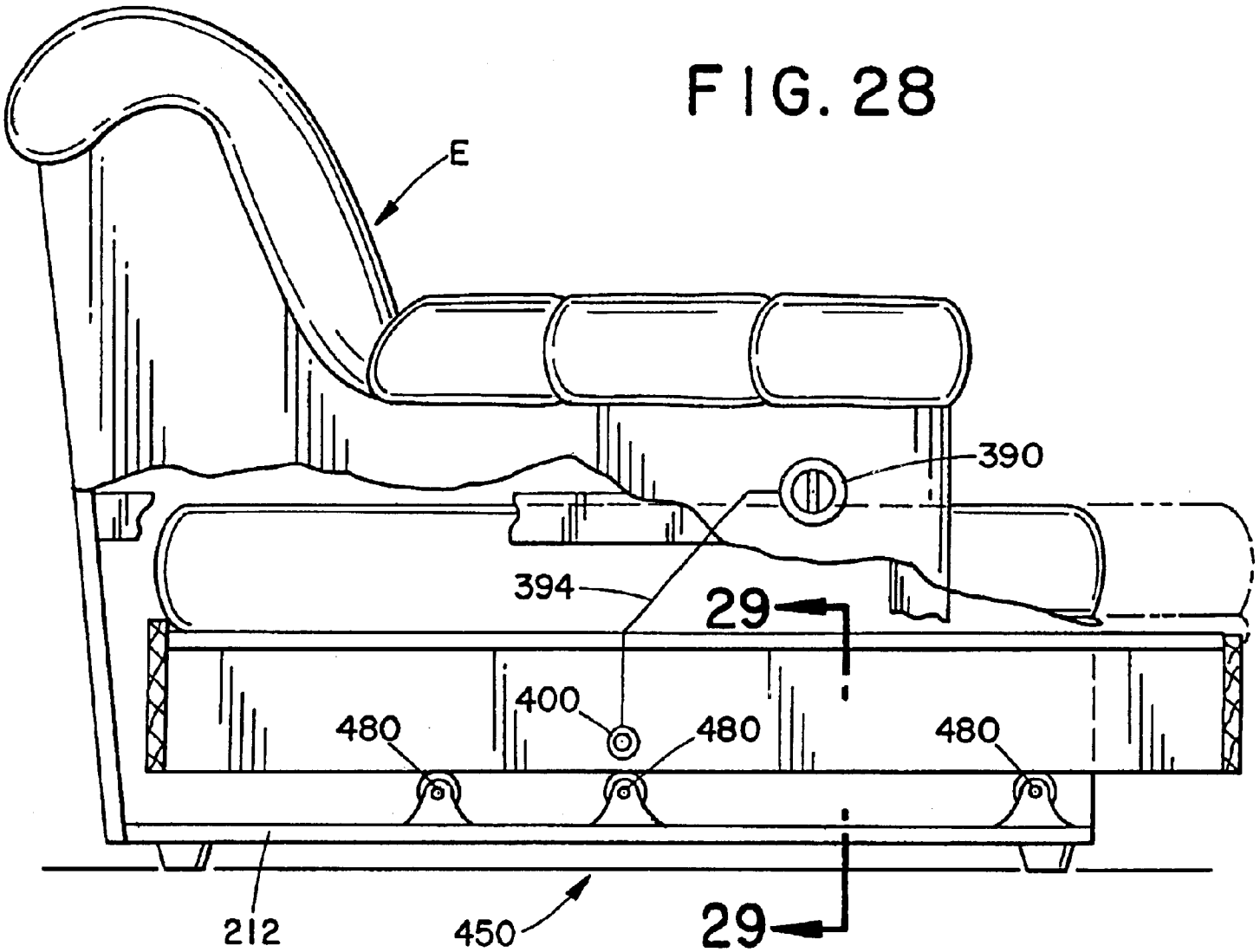
FIG. 28 is a side elevational view, partially broken away, of the fifth preferred embodiment sofa utilizing a second alternate frame assembly according to the present invention.

The present invention also provides a second alternate frame assembly 450, that can be incorporated in any of the seating units described herein. FIG. 28 illustrates the fifth embodiment sofa E utilizing the second alternate frame assembly 450 in accordance with the present invention. This second alternate frame assembly utilizes a plurality of caster rollers that facilitate extension or retraction of the seat within the seating unit. FIG. 28 also illustrates the first control knob 390 and its associated first side direct cable 394 in operable engagement with the first side latching assembly 400.

Figure 29:
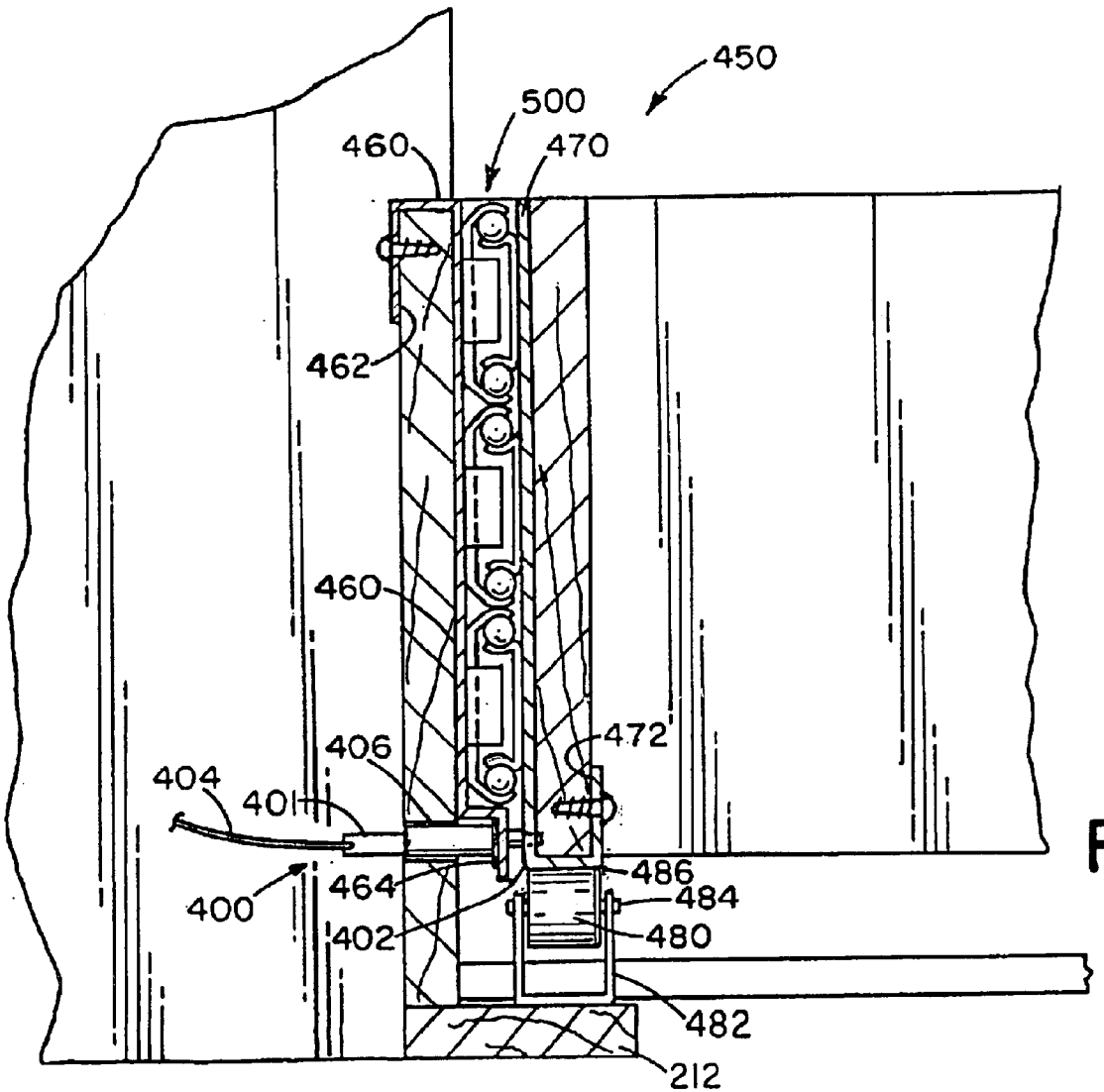
FIG. 29 is a partial cross-sectional view taken along line 29—29 in FIG. 28, illustrating in greater detail the second alternate frame assembly according to the present invention.

FIG. 29 is a partial cross-sectional view taken along line 29—29 in FIG. 28, illustrating in greater detail the second alternate frame assembly 450. The frame assembly 450 comprises longitudinal front and rear frame members, similar to the frame members 352 and 350 of the previously described first alternate frame assembly 340. In place of, or in addition to, two transverse frame members 354, each disposed at opposite ends of the resulting assembly, such as shown in FIG. 21, the frame assembly 450 comprises a stationary arm side bracket 460 and a movable seat side bracket 470. The frame assembly 450 further comprises a plurality of caster rollers 480. The stationary bracket 460 is affixed or otherwise incorporated within the main frame of the seating unit such as along the arm side. The bracket 460 comprises a first end 462 and a second end 464. It may be preferred to form the first end 462 to more readily engage a frame or support member of the seating unit, such as is shown in FIG. 29. The movable bracket 470 also has a first end 472 and a second end.

Disposed between the brackets 460 and 470 is a roller glide assembly 500 that facilitates movement between the brackets 460 and 470 and members attached thereto, and maintains orientation and alignment of the movable seat section with the seating unit. In the embodiment shown in FIG. 29, each caster roller 480 is rotatably supported along a caster axle 484 by a caster carriage 482. The caster carriage 482 is stationary and preferably secured to one or more frame members of the seating unit. The caster roller 480 contacts a caster race 486 defined along the underside of the first end 472 of the movable bracket 470. It is also preferred to secure or otherwise mount the latch assembly 400 to the stationary bracket 460, and preferably along the second end 464 of the bracket 460.

As described in greater detail below, one or more locking or latching assemblies are utilized to releasably secure the movable seat at a desired location upon extension or retraction of the seat relative to the seating unit. The following description is given with regard to a latching assembly as utilized along the first side of the seating unit such as shown in FIG. 23. Referring further to FIG. 29, the first side latching assembly 400 comprises a latch pin 401 that releasably engages a first side latch rail 402. The latch rail 402 is secured to the movable seat portion. The latching assembly 400 further comprises the first side latch cable 404 secured to the latch pin 401, and a latch spring 406. The latch spring 406 urges the latch pin 401 into engagement with the latch rail 402. The latch pin 401 engages the latch rail 402 along a distal end of the pin 401. The pin 401 is linearly movable within a pin housing. A pin travel guide may also be utilized to facilitate movement of the pin within the housing, and most preferably maintain alignment and orientation of the pin within the pin housing. Details of the components and their configuration within the latching assembly 400 are described in greater detail below in conjunction with FIGS. 36–38.

Figure 29A:
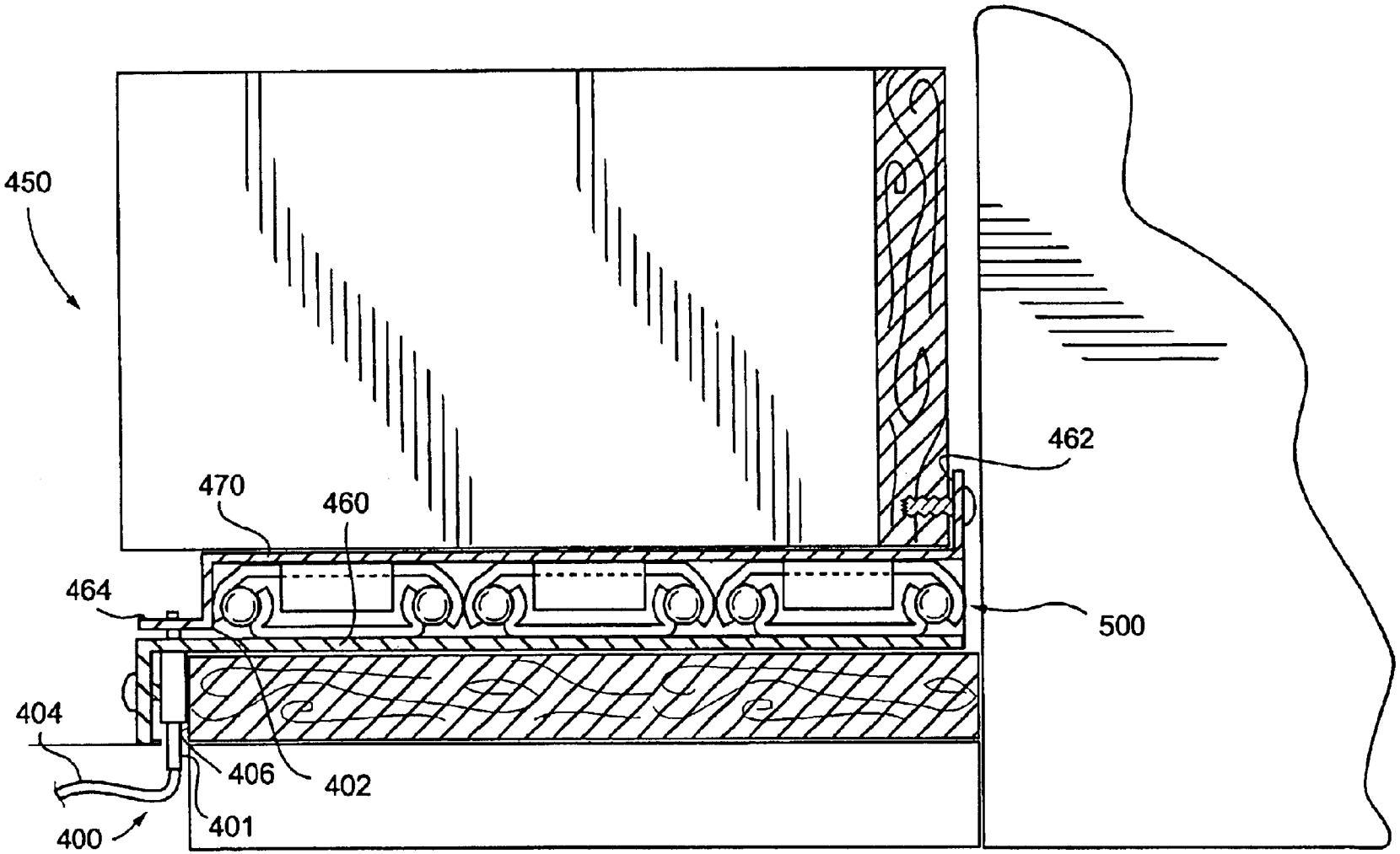
FIG. 29A illustrates an alternative preferred frame assembly in which a roller glide assembly is oriented horizontally to thereby avoid the use of one or more weight supporting rollers.

FIG. 29A illustrates an alternative preferred embodiment frame assembly. Essentially, the assembly shown in FIG. 29A corresponds to assembly 450 depicted in FIG. 29, however the assembly being rotated by ninety degrees. This orientation places the weight of the seating unit directly on the mechanism shown in FIG. 29A and thus eliminates the need for the castor rollers shown in FIG. 29.

Figure 30:
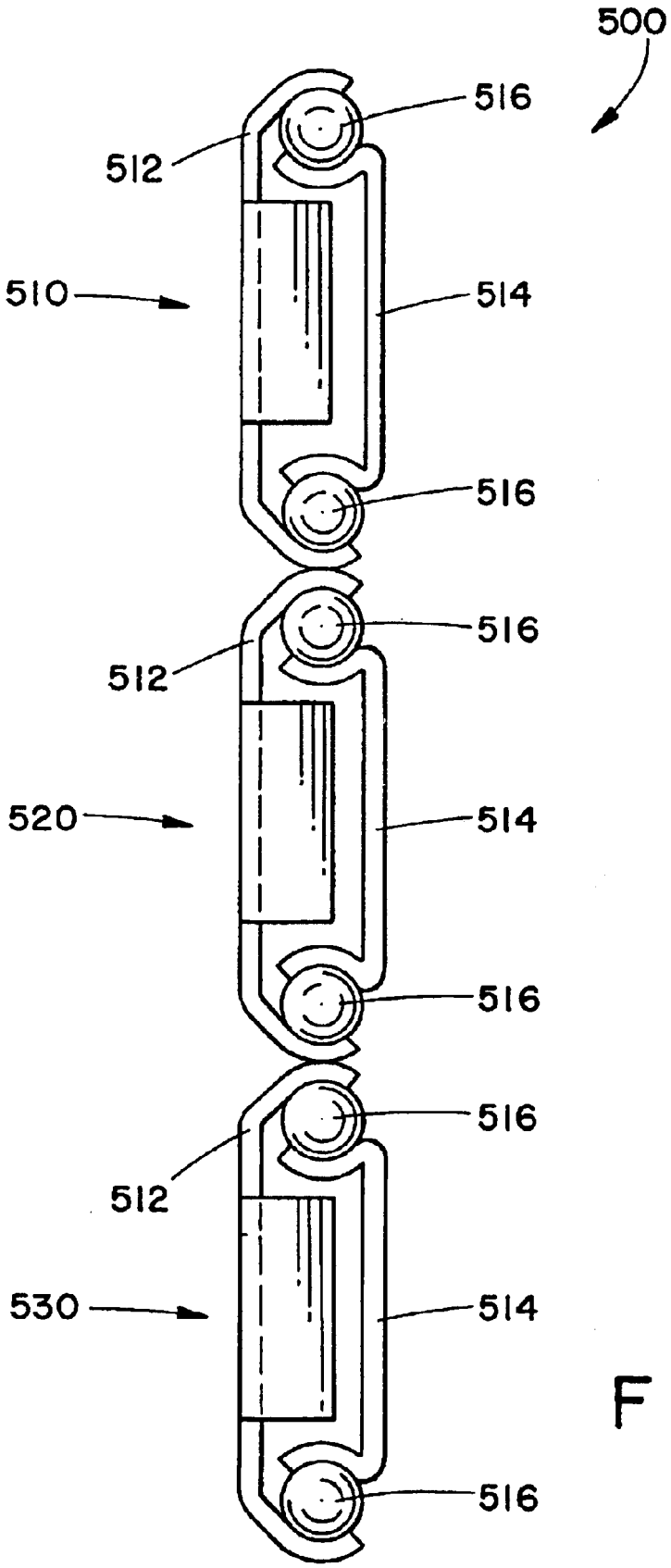
FIG. 30 is an end view of a roller glide assembly utilized in the second alternate frame assembly according to the present invention.

FIG. 30 illustrates the roller glide assembly 500 as used in the second alternate frame assembly 450. The roller glide assembly 500 comprises a first roller portion 510, a second roller portion 520, and a third roller portion 530. Each roller portion comprises an outer track 512, an inner nested or telescoping track 514. One or more bearings 516 facilitate movement between the tracks 512 and 514. The portions 510, 520, and 530 are preferably configured so that each portion extends concurrently and in parallel with the other portions. The use of such an arrangement of roller portions, that is, in a multiple and parallel configuration, significantly increases the load bearing capacity of the movable seat portion. The present invention includes other configurations for the roller portions 510, 520, and 530. For example, the portions can be arranged and operably engaged with each other so that only upon full or near extension between tracks 512 and 514 of one of the portions, such as the first roller portion 510, does extension occur between another set of tracks 512 and 514 of one or both of the other portions, such as the second roller portion 520.

Figure 31:
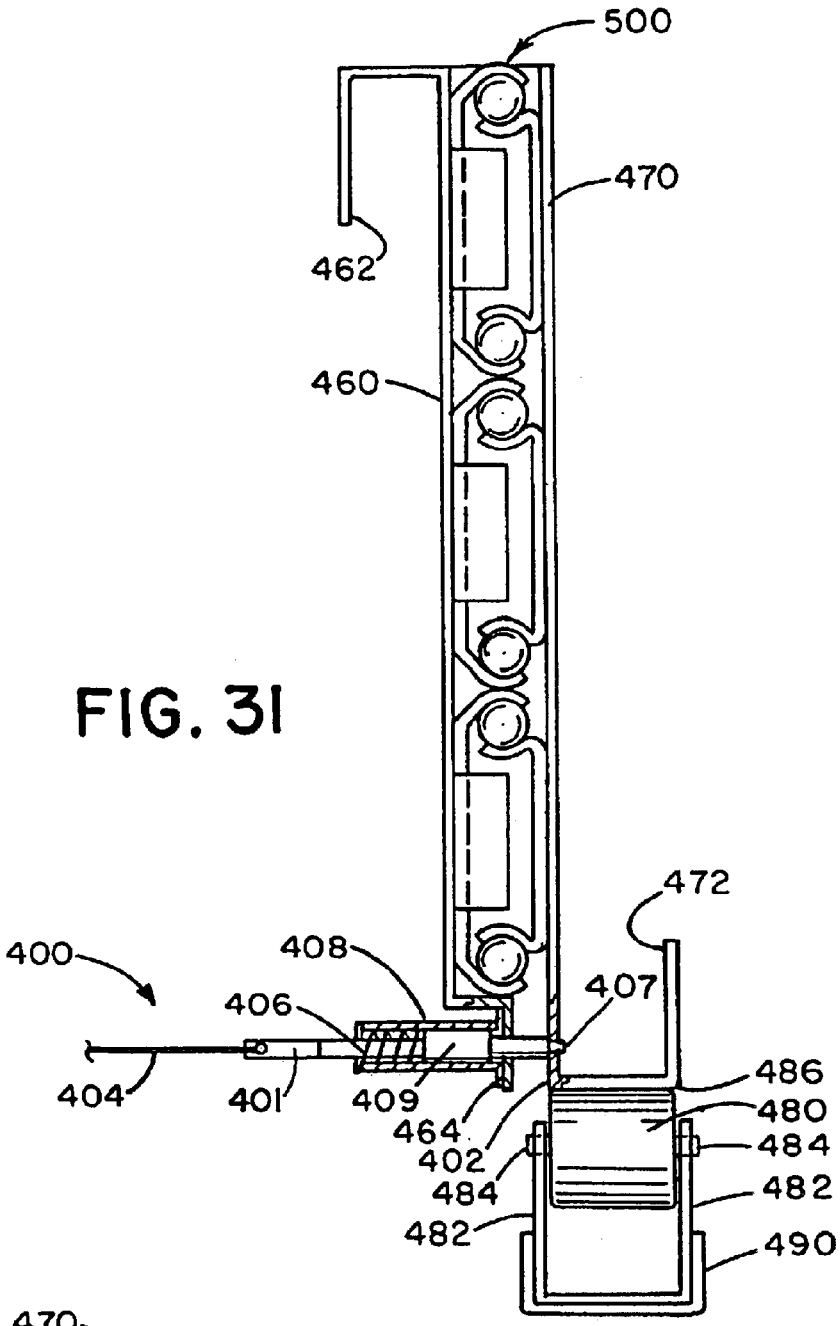
FIG. 31 illustrates in greater detail the roller glide assembly depicted in FIG. 30, a latching pin assembly, and a caster roller assembly employed in the second alternate frame assembly according to the present invention.

FIG. 31 illustrates in greater detail the roller glide assembly 500, latching pin assembly 400, and caster roller assembly employed in the second alternate frame assembly 450 according to the present invention. Upon actuation of a control knob, such as the control knob 390, and pulling or tensioning of cable 404, the latch pin 401 is linearly displaced away from the latch rail 402 until the distal end 407 of the latch pin 401 is disengaged from the latch rail 402. This action compresses the latch spring 406. Although a wide array of configurations may be used for the latch rail, it is preferred to utilize a rail or planar member having a plurality of spaced apertures defined along its length that are each sized to receive and engage the distal end of the latch pin. Once freed, the seat may then be moved, i.e. retracted or extended. Movement of the seat results in movement of the seat side bracket 470. Movement of the bracket 470 is facilitated by the glider assembly 500 and by one or more caster rollers 480. Upon release of the control knob, the spring 406, under compression, urges the pin 401 into engagement with the latch rail 402 to prevent further movement.

Figure 32:
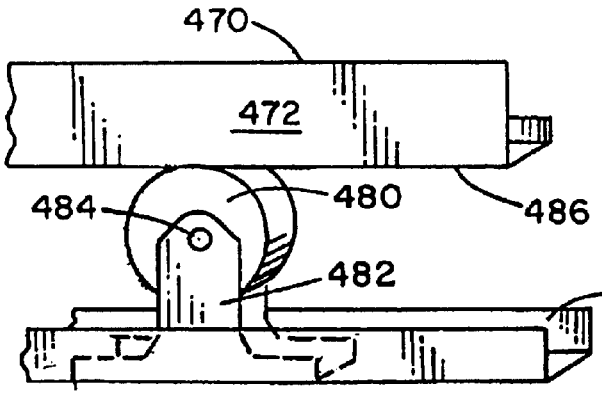
FIG. 32 is a partial side elevational view of the caster roller assembly illustrated in FIG. 31.

FIG. 32 is a partial side elevational view of the caster roller assembly illustrated in FIG. 31. In this configuration, movement of the seat causes movement of the seat side bracket 470. The caster 480 and caster carriage 482 are secured to a stationary support bracket 490. Movement of the seat side bracket 470 is facilitated by the caster roller 480 rotating along and contacting the caster race 486 defined along the underside of the bracket 470.

Figure 33:
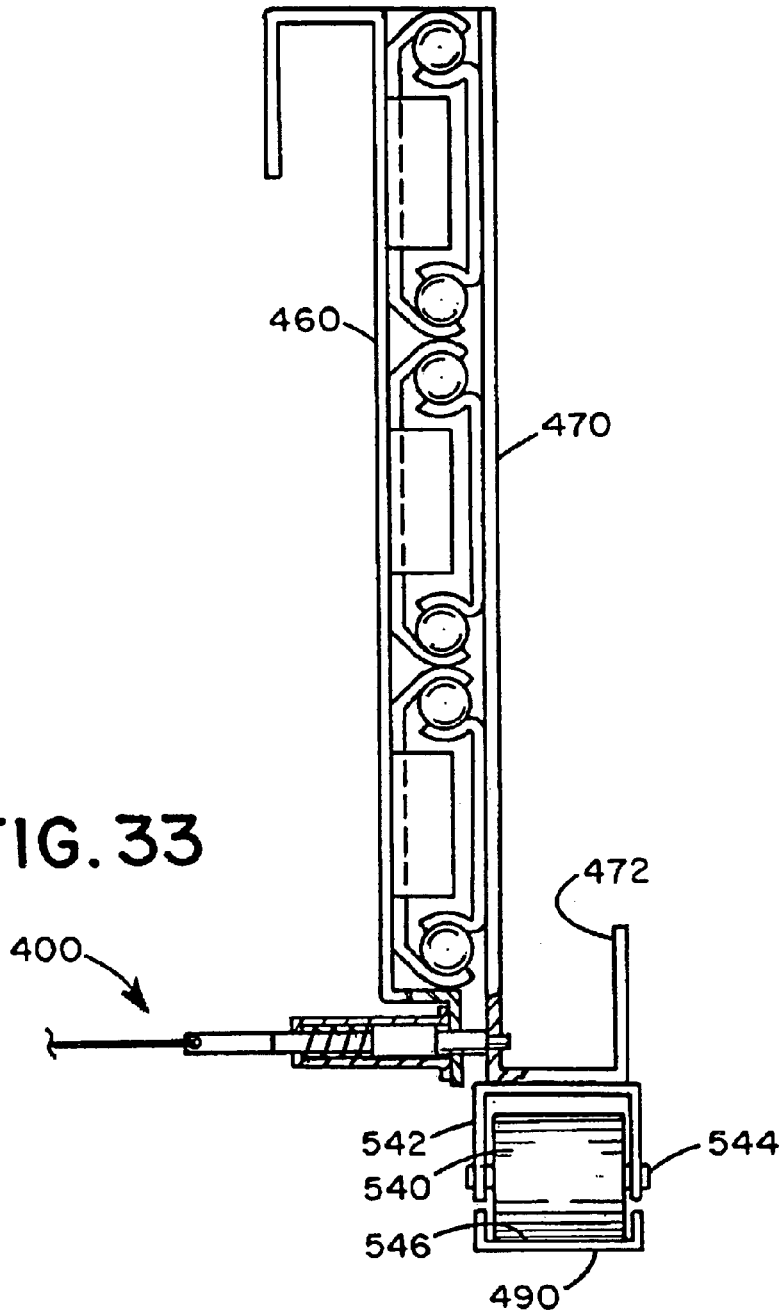
FIG. 33 illustrates the second alternate frame assembly depicted in FIG. 31 utilizing a second version of a caster roller assembly according to the present invention.
Figure 34:
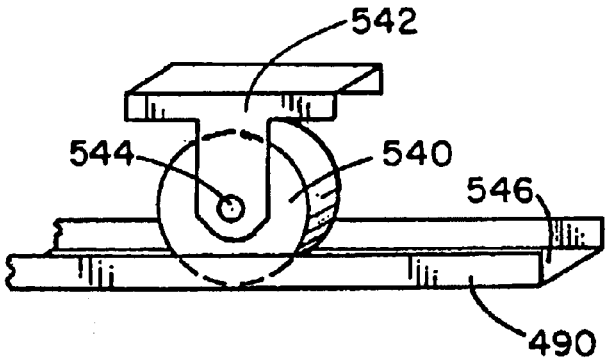
FIG. 34 is a partial side elevational view of the second version caster roller assembly shown in FIG. 33.

FIGS. 33 and 34 illustrate the second alternate frame assembly 450 utilizing a second version of a caster roller assembly according to the present invention. This second caster roller version utilizes a downwardly extending caster carriage 542 for housing a caster roller 540 along a rotatable axle 544. In this version, the caster carriage 542 is affixed to the lower region 472 of the movable seat side bracket 470. The caster roller 540 contacts a caster race 546 defined along an upwardly facing surface of a support bracket 490 which is stationary. It may be desirable to provide one or more upwardly projecting side walls alongside the caster race 546 to promote alignment between the seat frame and the seating unit as the seat is extended or retracted in relation to the stationary support bracket 490. It is to be understood that similar sidewalls could be provided along the caster race 486 of the first caster roller assembly version shown in FIGS. 31 and 32.

Figure 35:
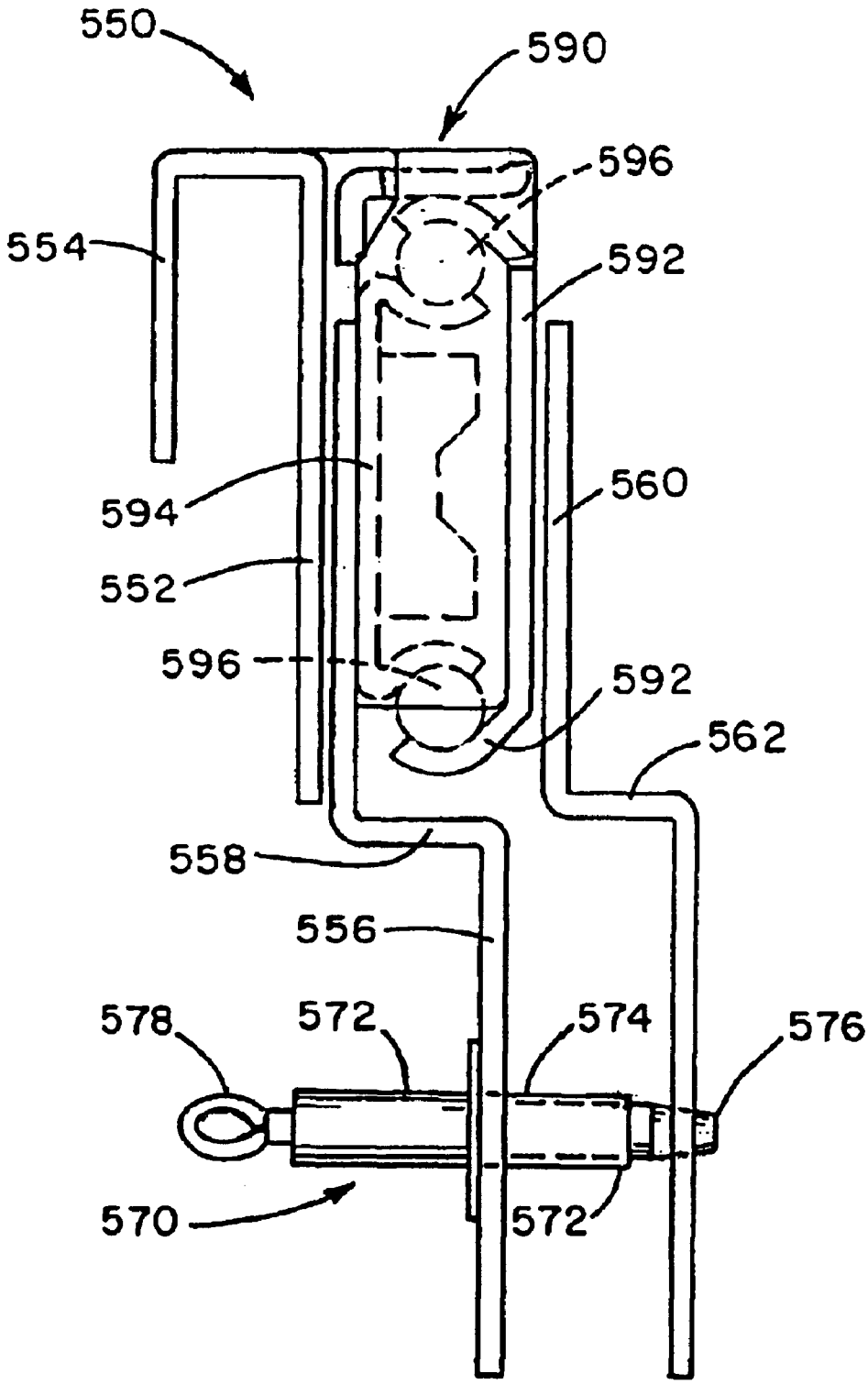
FIG. 35 is an end view of a third alternate frame assembly utilizing another roller glide assembly and yet another latching pin assembly according to the present invention.

The present invention further provides a third alternate frame assembly 550 as shown in FIG. 35. The frame assembly 550 comprises an upper stationary bracket 552, a lower stationary bracket 556, and a movable seat side bracket 560. The stationary bracket 552 has an upper end 554 adapted to be incorporated within or affixed to a portion of the main frame of the seating unit. The lower stationary bracket 556 includes a transverse portion 558 that preferably extends horizontally between an upper end of the lower stationary bracket 556 and a lower portion of that bracket. Similarly, the movable bracket 560 includes a transverse portion 562. It is contemplated that a single bracket could be utilized instead of the upper and lower brackets 552 and 556. A latching assembly is also used in conjunction with the frame assembly 550. The latching assembly may be similar to that latching assembly 400 previously described or may be as follows and in accordance with an alternate latching assembly 570. This alternate latching assembly 570 comprises a latch housing 572 preferably extending between the lower portions of the lower stationary bracket 556 and proximate to the movable seat side bracket 560. The latching assembly 570 further comprises a latch pin 574 movably disposed within the latch housing 572 and having a latch pin engaging end 576 and a latch pin actuating end 578. The frame assembly 550 further comprises a roller glide assembly 590 comprising an outer track 592, an inner track 594, and a plurality of bearings 596 that facilitate movement, preferably telescoping movement, between the tracks 592 and 594. The assembly enables the seat side bracket 560 to be moved, or linearly displaced, relative to the stationary brackets 552 and 556.

Figure 36:
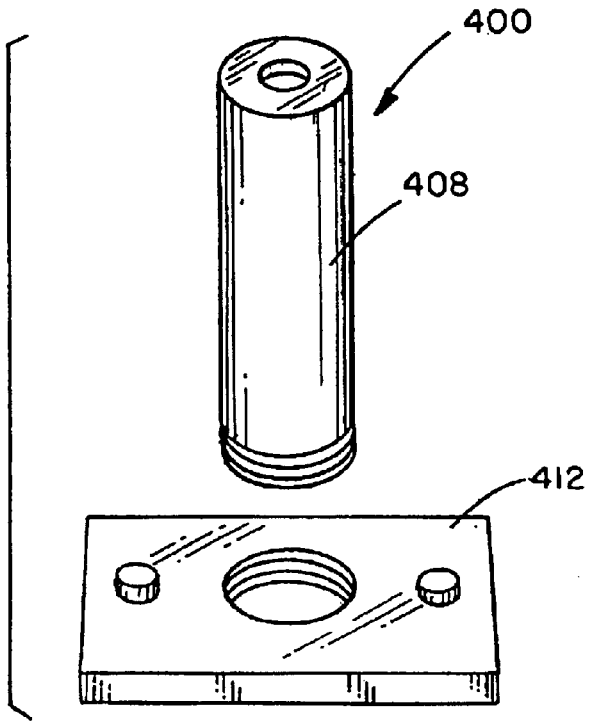
FIG. 36 illustrates in greater detail engagement of the latching pin assembly shown in FIG. 31.
Figure 37:
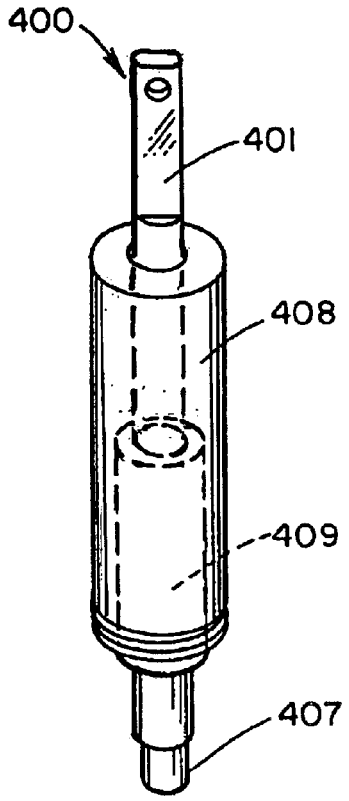
FIG. 37 is a perspective view of the latching pin assembly depicted in FIG. 36.
Figure 38:
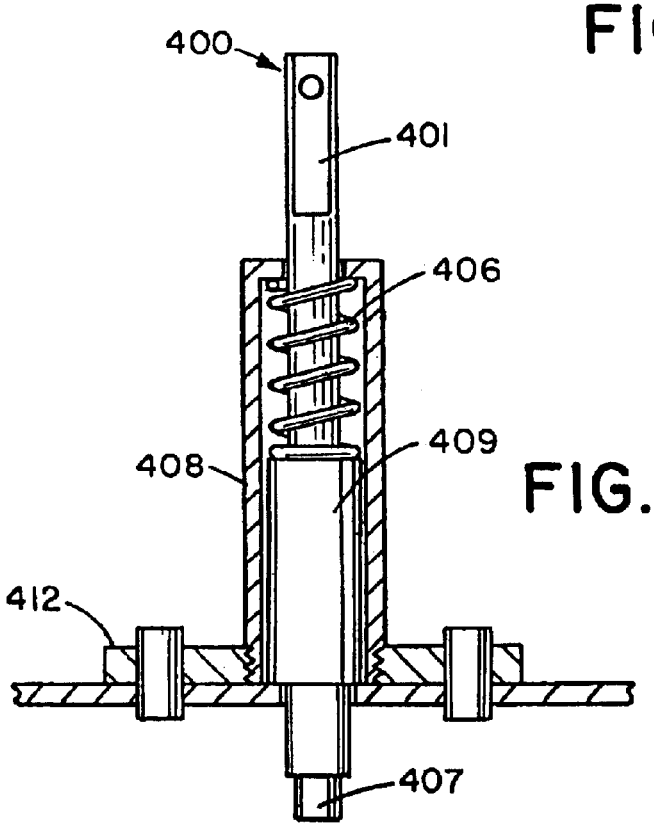
FIG. 38 is a cross-sectional view of the latching pin assembly shown in FIG. 36.

FIGS. 36, 37 and 38, further illustrate the previously noted latching assembly 400. As shown in FIG. 36, the latching assembly 400 comprises a pin housing 408 and a support plate 412. Referring to FIG. 37, the support plate 412 may be secured to the lower region 464 of the stationary bracket 460. The pin housing 408 is preferably a hollow cylindrical body having a threaded end for releasably engaging a corresponding threaded aperture defined in the support plate 412. As shown in FIG. 37, the latch pin 401 is disposed within a cylindrical bore in the pin housing 408. The latch pin 401 extends through the housing 408 so that the engaging distal end 407 of the pin extends out the other end of the housing 408. Optionally, a pin travel guide 409 may be utilized within the housing 408 to facilitate movement and maintain alignment of the pin 401 within the housing 408. FIG. 38 illustrates a cross-sectional view of the latching assembly 400. A latch spring 406 is disposed within the housing 408 between the pin travel guide 409 and end of the housing 408.

Figure 39:
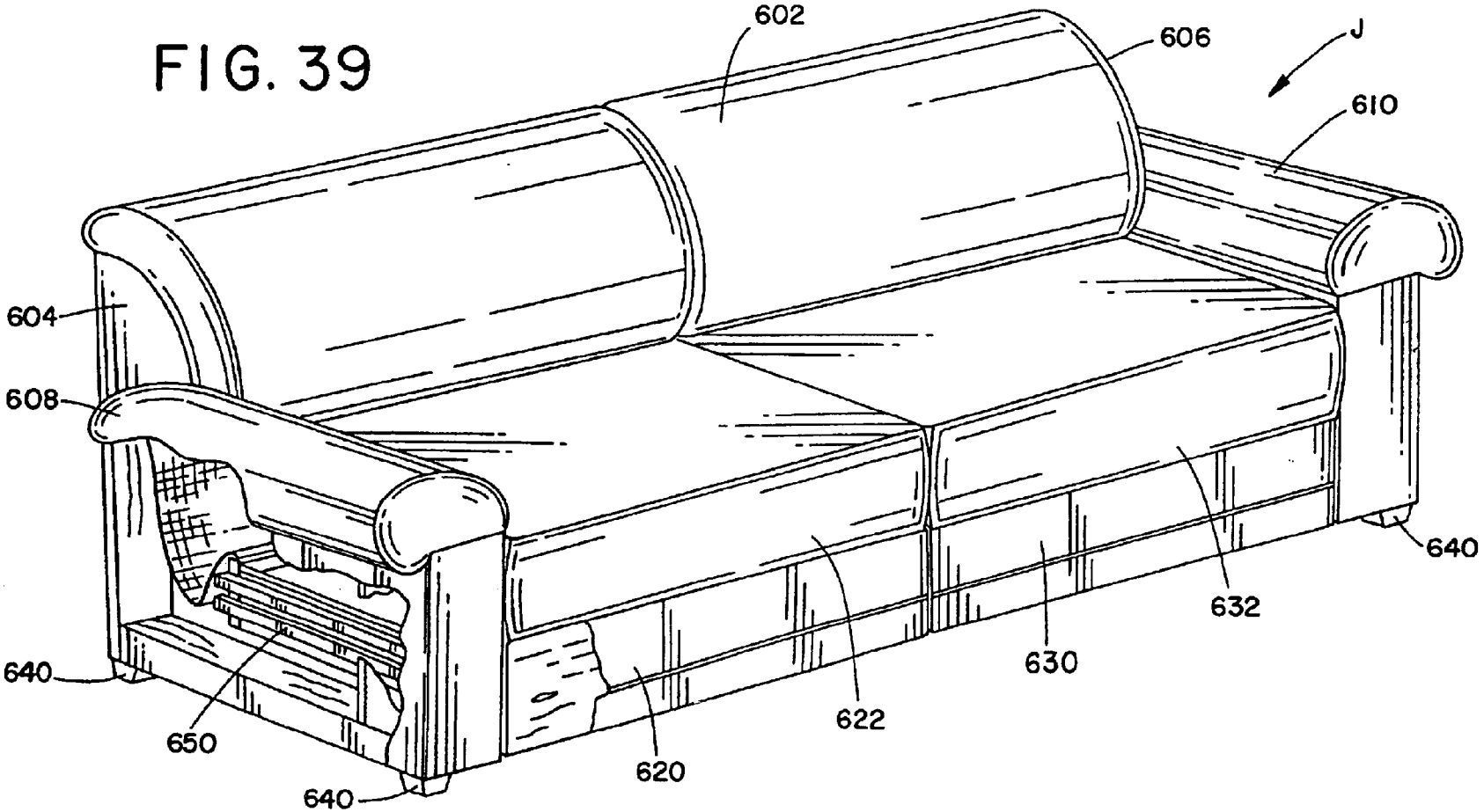
FIG. 39 is a perspective and partially broken away view of a first preferred embodiment seating unit having two sliding seat sections, the unit illustrated in a fully retracted position.

The present invention also provides a seating unit having two or more individually movable seat sections. FIGS. 39 to 39*c* illustrate a first preferred embodiment multiple seating unit J. The first preferred embodiment seating unit J comprises a first movable seat section 620 and a second movable seat section 630. The second movable seat section 630 is independently movable with respect to the first movable seat section 620, and vice-versa. The first preferred embodiment seating unit J further comprises a backrest 602 generally extending between a first end 604 and a second end 606. Located at the first end 604 is a first armrest 608. Similarly, located at the second end 606 is a second armrest 610. The first movable seat section 620 preferably includes a first cushion 622 and the second movable seat section 630 preferably includes a second cushion 632. The first preferred embodiment seating unit J also comprises a plurality of legs 640 or other support members. One or more legs 640, or other support members such as caster wheels, may be utilized for supporting each seat section also. Preferably, two legs are provided along the underside of the frontward portion of each of the seat sections 620 and 630. Nearly any number of legs along the frontmost region of the seating unit may be utilized. For example, in a multiple sliding seat unit, having two sliding seat sections, a leg may be provided on each frontward corner of the seating unit, and two additional legs may be provided generally at the midsection of the seat unit, each secured to a respective seat section and along the front underside of the unit. The two additional legs at the midsection of the seat unit may be relatively narrow in appearance and positioned adjacent to one another so that when the two seat sections are retracted, the two thin legs have a combined thickness equivalent to either of the end legs. This creates the appearance of the seating unit having a total of three legs along its front. The use of such legs or other support provisions under a seat section promotes stability of the seating unit particularly when the seat section is fully extended and weight or other downward force is placed on the extended seat. Each of the movable seat sections 620 and 630 include, or utilize, a separate sliding track assembly 650. The sliding track assembly 650 may utilize a configuration or mechanism similar to, or identical to, the assembly illustrated in FIGS. 29 and 30 and previously described herein. Moreover, the sliding track assembly 650 may correspond to any of the previously noted support track 60; glide tracks 174, 176; track assembly 360; and roller glide assembly 500.

Figure 39A:
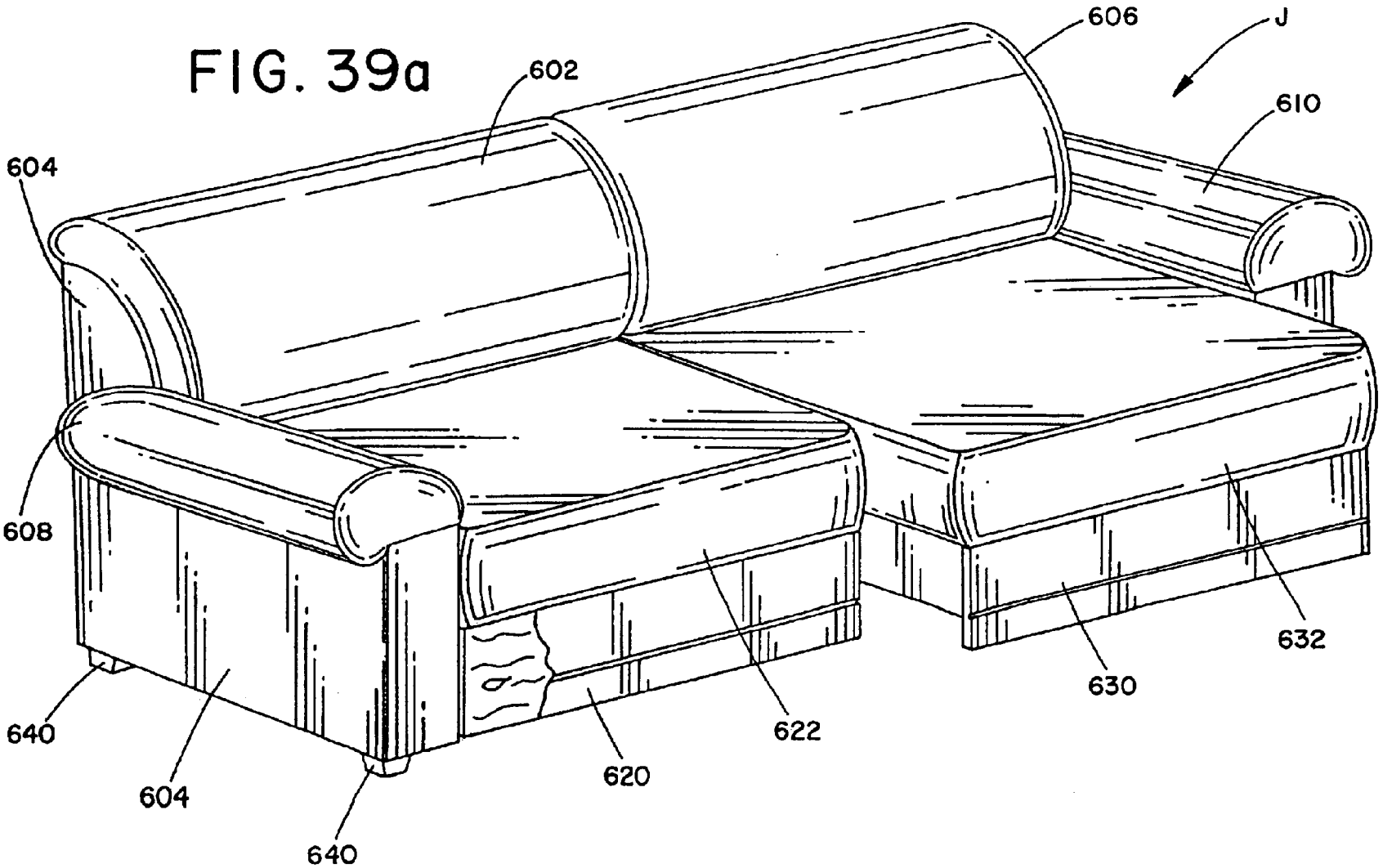
FIG. 39*a* is a perspective view of the first preferred embodiment seating unit illustrated in FIG. 39, the unit illustrated as having one of the seat sections partially extended.
Figure 39B:
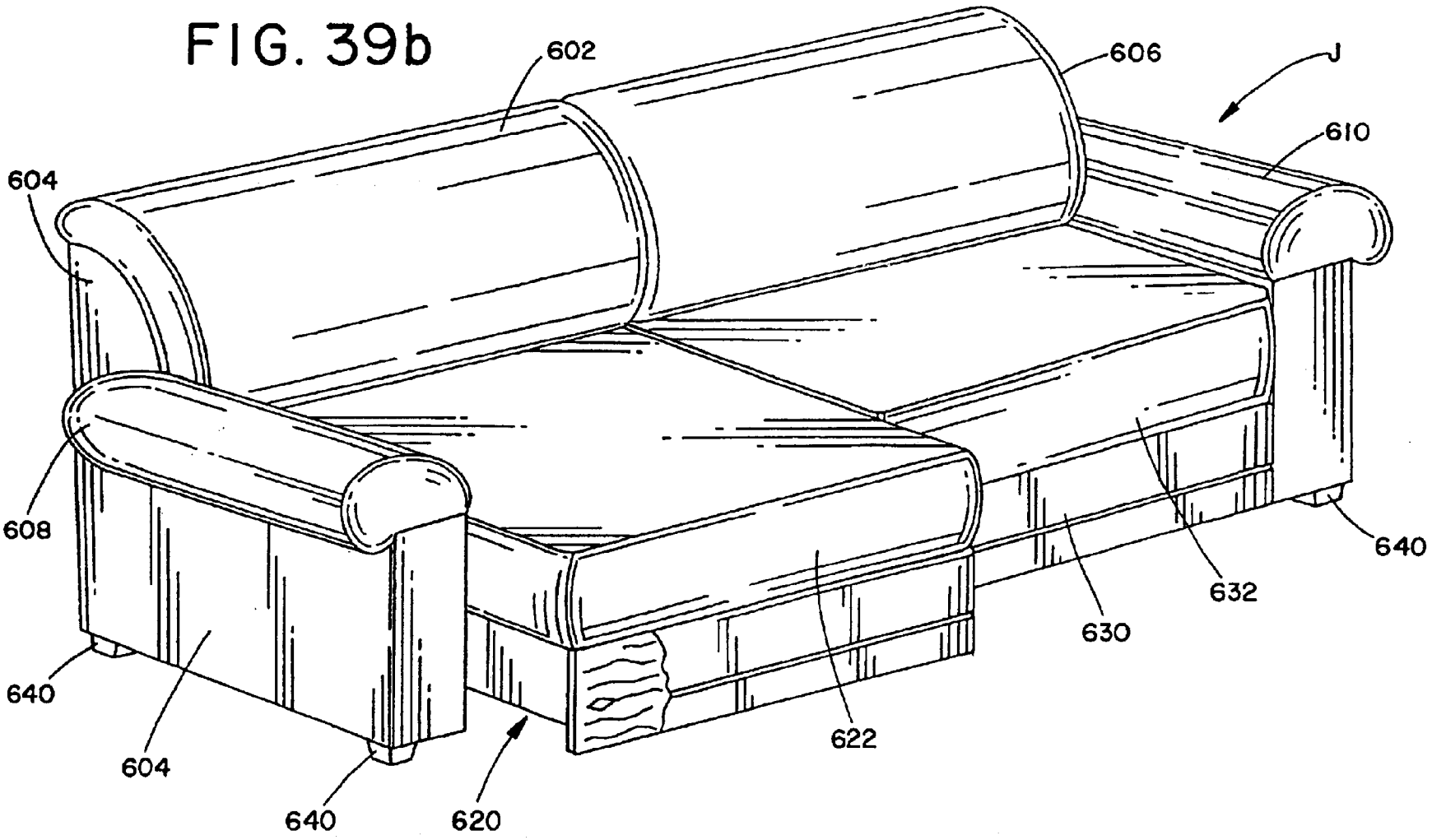
FIG. 39*b* is a perspective view of the first preferred embodiment seating unit illustrated in FIG. 39, the unit illustrated as having the other seat section partially extended.
Figure 39C:
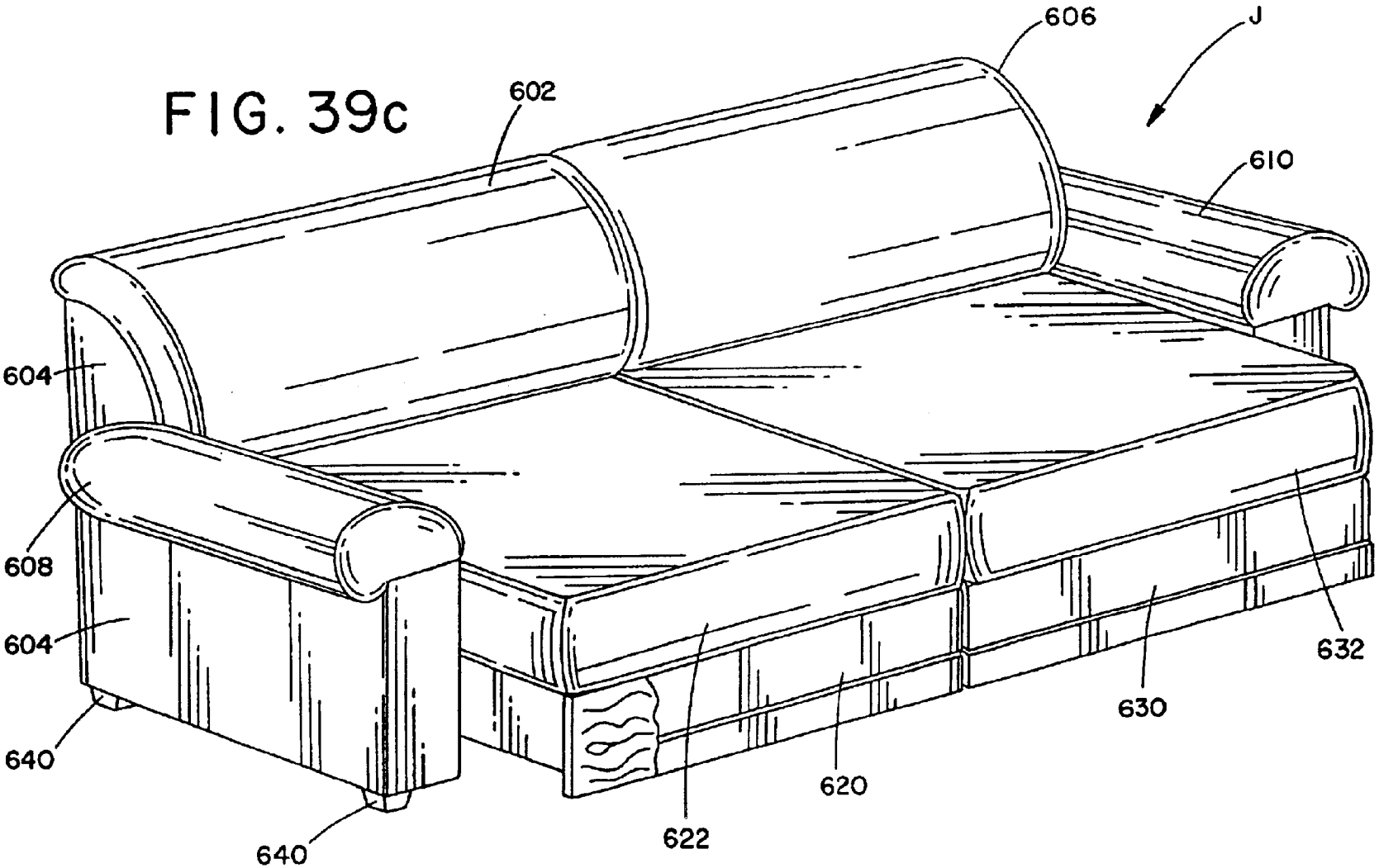
FIG. 39*c* is a perspective view of the first preferred embodiment seating unit illustrated in FIG. 39, the unit illustrated as having both seat sections fully extended.

FIGS. 39*a* to 39*c* illustrate the first preferred embodiment seating unit J in various positions of seat extension and retraction. FIG. 39*a* shows the seating unit J in a state in which the second seat section 630 is partially extended while the first seat section 620 is fully retracted. It will be appreciated that the respective seat cushions 622 and 632 move along with, or remain stationary, with their respective movable seat section. FIG. 39*b* illustrates the first preferred embodiment seating unit J in a configuration in which the first movable seat section 620 is fully extended and the second movable seat section 630 is fully retracted. FIG. 39*c* illustrates the seating unit J in a state in which both the first and second seat sections 620 and 630 are fully extended.

It will be understood that the sliding track assemblies 650 utilized in the first preferred embodiment seating unit J include a latching or securing mechanism as previously described, that enables an individual seat section 620 or 630, to be secured at any position. Specifically, the latching or securing mechanism enables a seat section to be locked or otherwise secured in place when the seat section is fully retracted, fully extended, or at any position in between the positions of the seat section when fully retracted and fully extended. In addition, the first preferred embodiment seating unit J may utilize any of the components from other preferred embodiments described herein, such as any of the cable based actuation assemblies if the seating unit is manually extended or retracted.

Figure 40:
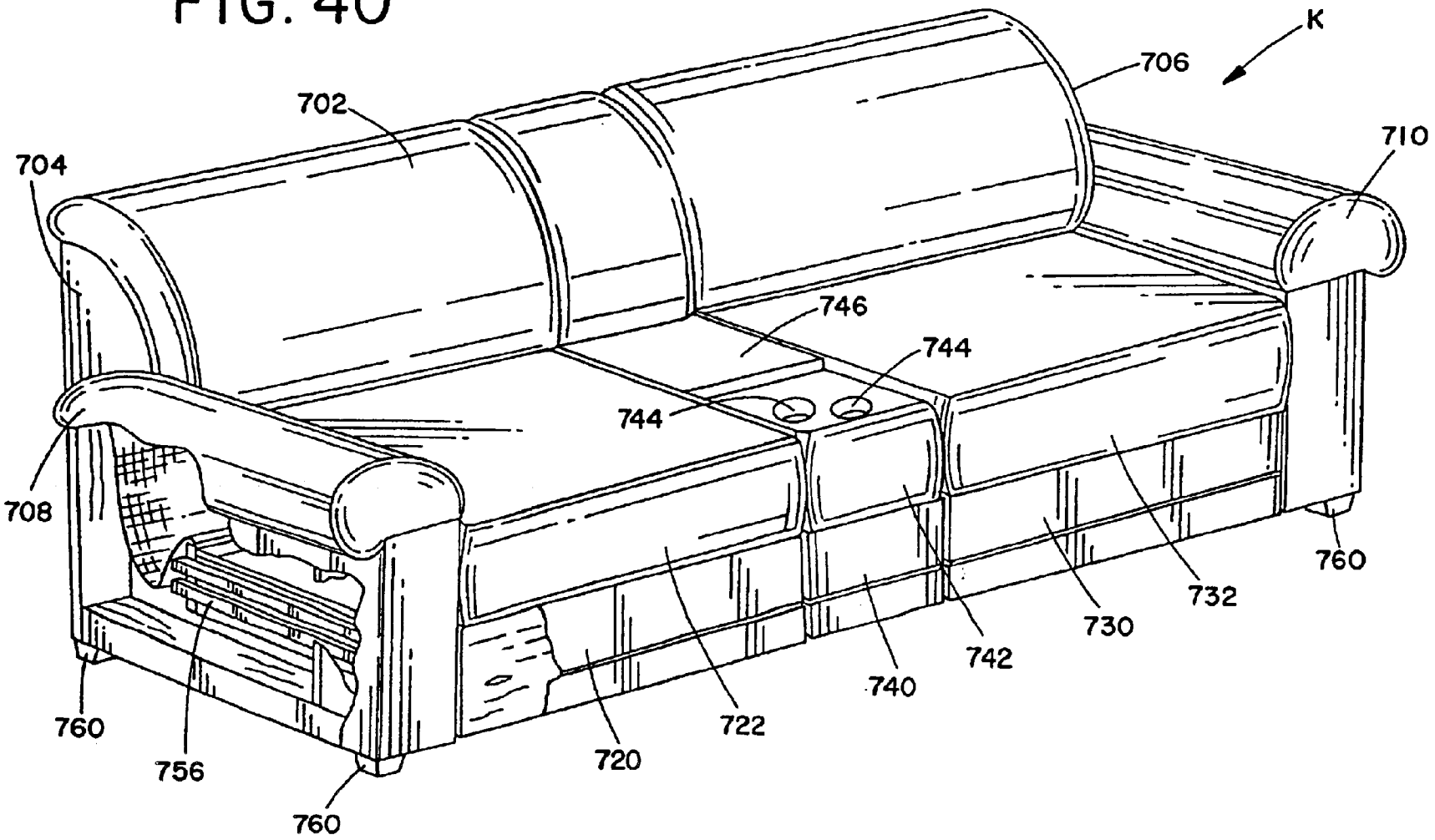
FIG. 40 is a perspective and partially broken away view of a second preferred embodiment seating unit having two sliding seat sections and an interior stationary console, the unit illustrated in a fully retracted position.
Figure 40A:
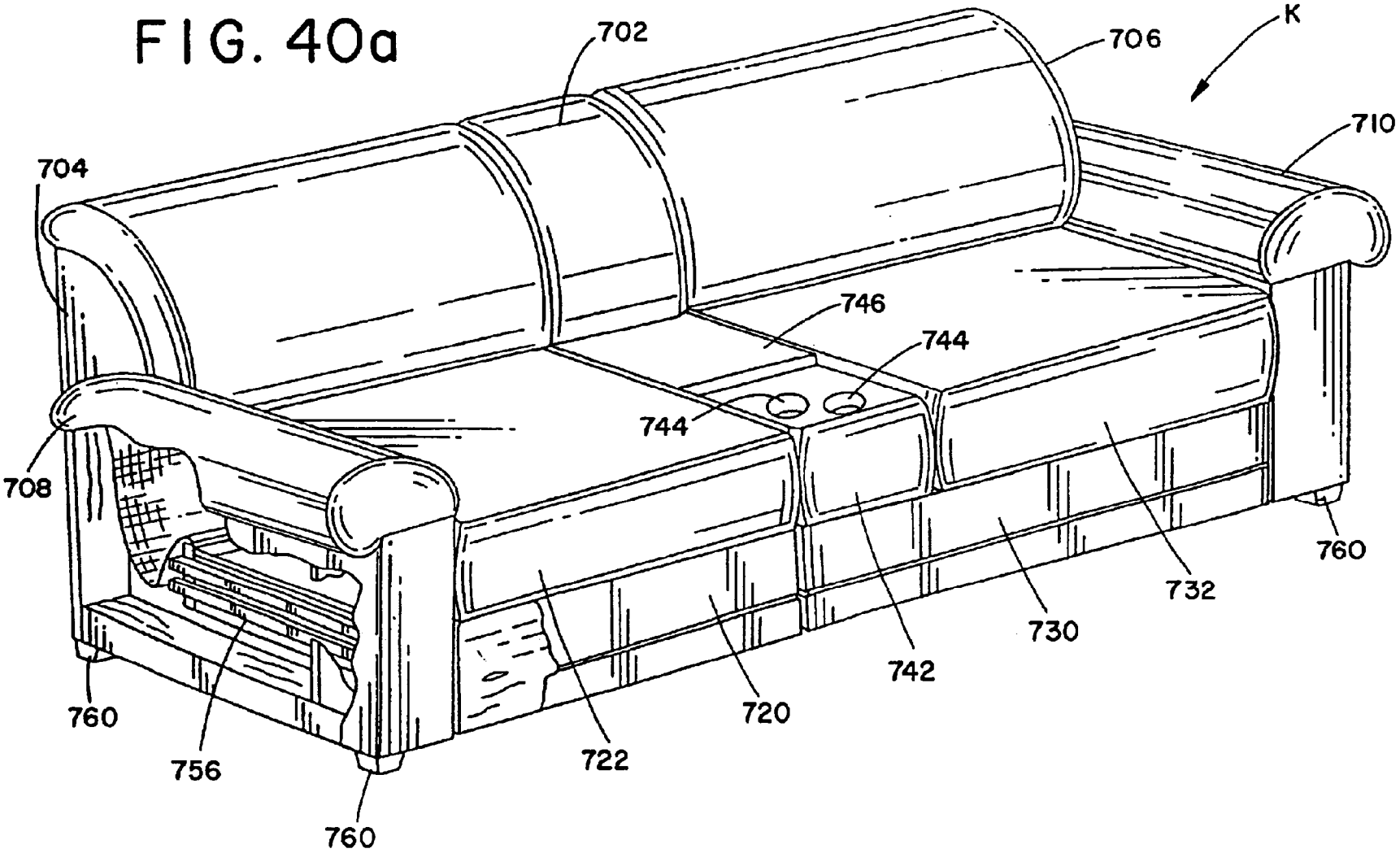
FIG. 40*a* is a perspective and partially broken away view of a variant of the second preferred embodiment seating unit having two sliding seat sections and an interior console movable with one of the sliding seat sections, the unit illustrated in a fully retracted position.
Figure 40B:
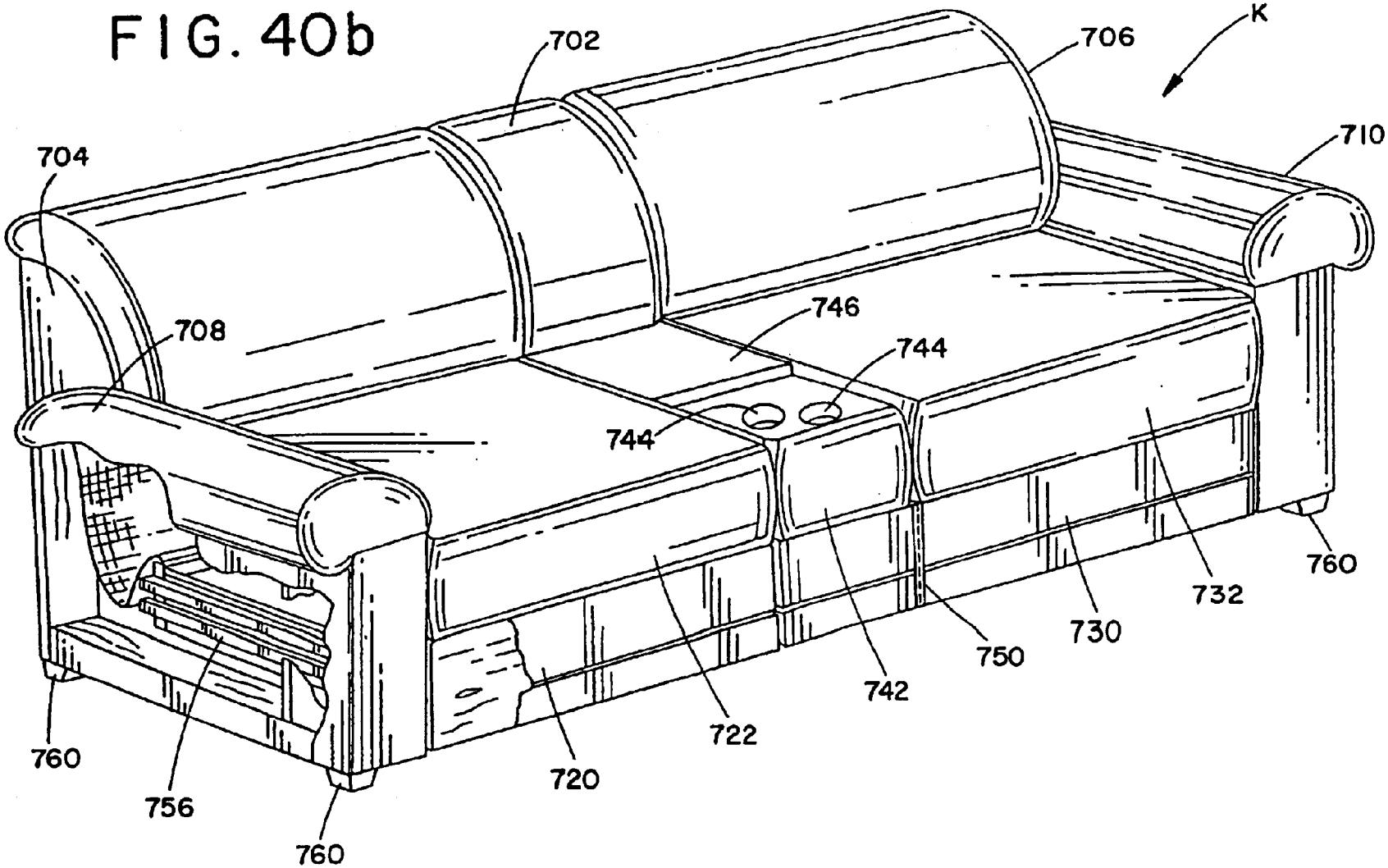
FIG. 40*b* is a perspective and partially broken away view of another variant of the second preferred embodiment seating unit having two sliding seat sections and an interior console movable with one of the sliding seat sections but disguised to appear as if stationary.

FIGS. 40 to 40*b* illustrate a second preferred embodiment multiple seating unit K. The second preferred embodiment seating unit K comprises a first movable seat section 720 and a second movable seat section 730. The second movable seat section 730 is independently movable with respect to the first movable seat section 720, and vice-versa. The second preferred embodiment seating unit K further comprises a backrest 702 generally extending between a first end 704 and a second end 706. Disposed at the first end 704 is a first armrest 708. Similarly, located at the second end 706 is a second armrest 710. The first movable seat section 720 preferably includes a first cushion 722 and the second movable seat section preferably includes a second cushion 732. The second preferred embodiment seating unit K also includes a plurality of legs 760 or other support members. Each of the movable seat sections 720 and 730 include, or utilize, a separate sliding track assembly 756. The sliding track assembly 756 may utilize a configuration or mechanism similar to, or identical to, the previously described sliding track assembly 650 of the first preferred embodiment multiple seating unit J.

The second preferred embodiment multiple seating unit K further comprises a console 742. Typically, the console 742 is disposed between the seat sections 720 and 730, however the present invention includes variant embodiments in which the console 742 is located proximate or adjacent to one of the armrests 708 or 710. The console 742 preferably includes one or more cup holders 744 and a support surface 746, upon which may be placed objects. Although not shown in FIGS. 40 to 40*b*, it will be understood that the console 742 may comprise one or more storage compartments, shelves, or other provisions customary in residential furniture.

Another feature of the second preferred embodiment seating unit K relates to the console 742 being movable with one of the seat sections 720 or 730. Alternatively, the console 742 can be configured so that it is stationary and does not move with either of the seat sections 720 or 730.

In this version, both the console 742 and its supporting section 740 remain stationary along with other components of the seating unit K, as either or both of the seating sections 720 and 730 are moved.

FIG. 40*a* illustrates a version of the seating unit K in which the console 742 is movable along with the second seat section 730. As shown in FIG. 40*a*, the width of the seat section 730 is preferably increased to accommodate the console 742. Thus, upon extension of the second seat section 730, the console 742 is moved along with the seat section 730 and the cushion 732. It will be understood that instead of configuring the second seat section 730 to accommodate the console 742, the first seat section 720 could be modified to accommodate the console 742.

FIG. 40*b* illustrates another variant embodiment of the seating unit K. In this version, the second seat section 730 is configured to accommodate the console, i.e. as previously described in conjunction with FIG. 40*a*, however, the seat section 730 is formed to appear as if the console 742 is separate from, and likely not movable with, the seat section 730. This can be accomplished by providing a fabric or decorative seam 750 along the exposed or visible regions of the seat section 730. As will be appreciated, if the first seat section 720 and the console 742 are configured to move together, the first seat section 720 could include such a seam 750 or other line of demarcation.

Figures 41, 41A, 41B:
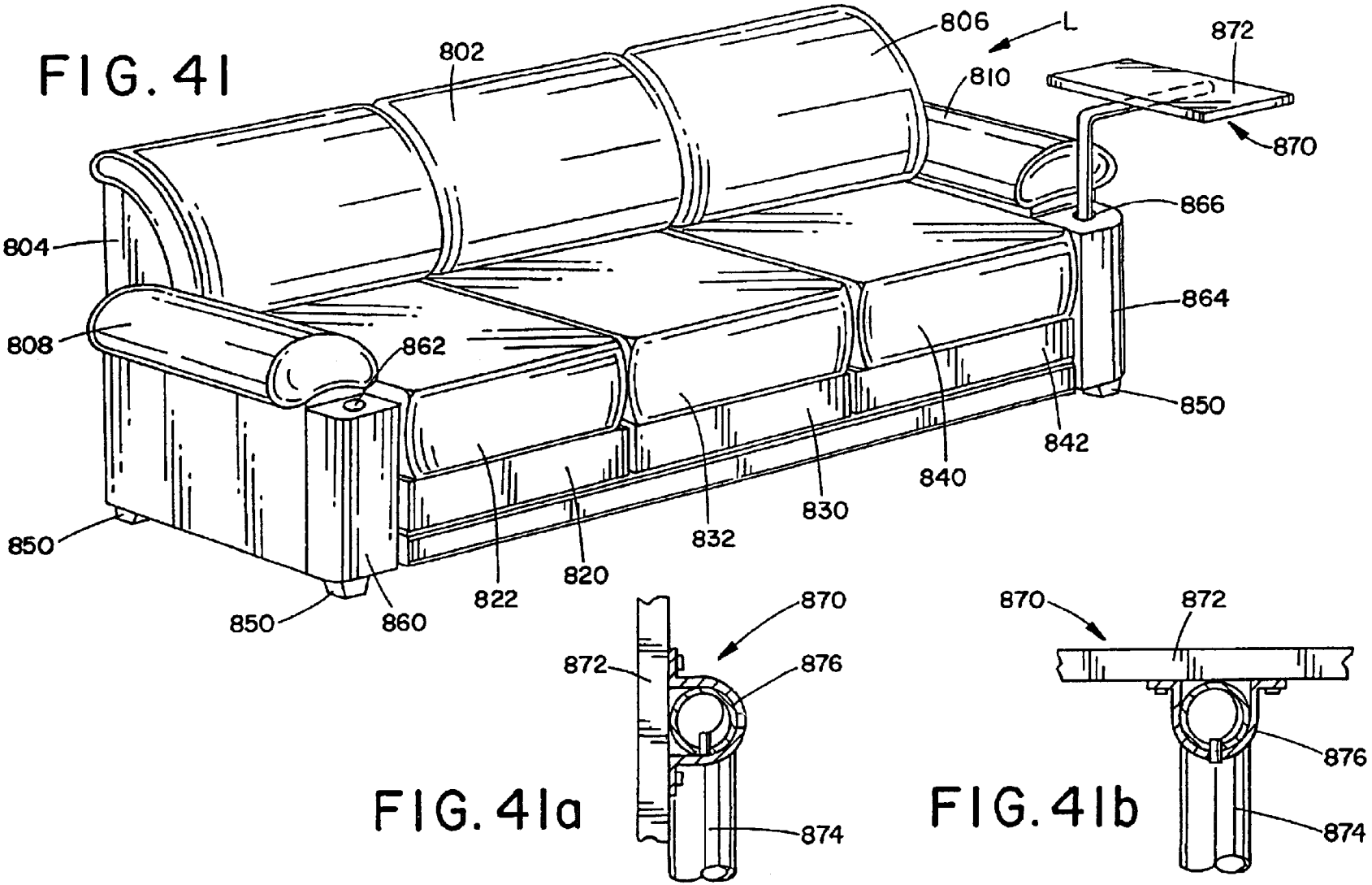
FIG. 41 is a perspective view of a third preferred embodiment seating unit having three sliding seat sections and an optional accessory tray disposed at one end of the unit, the unit illustrated in a fully retracted position.
FIG. 41*a* is a detail end view of the accessory tray illustrated in FIG. 41.
FIG. 41*b* is another detail end view of the accessory tray illustrated in FIG. 41.

FIGS. 41 to 41*b* illustrate a third preferred embodiment multiple seating unit L. This unit L is similar to the previously described seating units J and K, but comprises three independently movable seat sections and provisions for accommodating various accessories along each end of the seating unit L. These aspects are described in greater detail as follows.

The third preferred embodiment seating unit L comprises a first movable seat section 820, a second movable seat section 830, and a third movable seat section 840. The first seat section 820 is independently movable from the second and third seat sections 830 and 840, respectively. Similarly, the second seat section 830 is independently movable from the first and third seat sections 820 and 840, respectively. And, the third seat section 840 is independently movable from the first and second seat sections 820 and 830, respectively. The third preferred embodiment seating unit L further comprises a backrest 802 generally extending between a first end 804 and a second end 806. Located at the first end 804 is a first armrest 808. Similarly, located at the second end 806 is a second armrest 810. The first movable seat section 820 preferably includes a first cushion 822. The second movable seat section 830 preferably includes a second cushion 832. And the third movable seat section 840 includes a third cushion 842. Each of the movable seat sections 820, 830, and 840 include, or utilize, a separate sliding track assembly (not shown) similar to the previously noted assemblies 650 and 756. The third preferred embodiment seating unit L also comprises a plurality of legs 850 or other support members.

The third preferred embodiment seating unit L further comprises one or more provisions for accommodating accessory tables or other optional attachments. For example, the seating unit L in FIG. 41 is shown as comprising a first accessory base 860 located proximate or adjacent to the first armrest 808, and a second accessory base 864 located proximate or adjacent to the second armrest 810. Other typical accessory furniture components include, but are not limited to, snack trays, assemblies for supporting television and computer hardware, footrests, headrests, and lighting fixtures. The first accessory base 860 includes a first accessory receiver 862 that is adapted to receive and retain an accessory such as an accessory table 870. Similarly, the second accessory base 864 includes a second accessory receiver 866 that is adapted to receive and retain an accessory such as the accessory table 870. Preferably, the accessory receivers 862 and 866 releasably engage the accessory coupled thereto, and may, in some applications, allow movement of the accessory relative to the accessory base 860 or 864. For example, it is preferred that the second accessory receiver 866 is adapted to releasably engage and retain the accessory table 870 however, allow movement, such as rotational or vertical movement, of the table 870 relative to the base 864.

The accessory table 870 preferably comprises a table member 872 or other planar member that is engaged or secured to a support member 874. The table member 872 is preferably attached to the support member 874 by one or more movable brackets 876. The brackets 876 enable the table member 872 to be rotated about the support member 874 to various orientations such as depicted in FIGS. 41*a* and 41*b*. Such movement also facilitates storage of the table 870, such as when the accessory table 870 is removed from the seating unit L and base 860 or 864.

Figure 42:
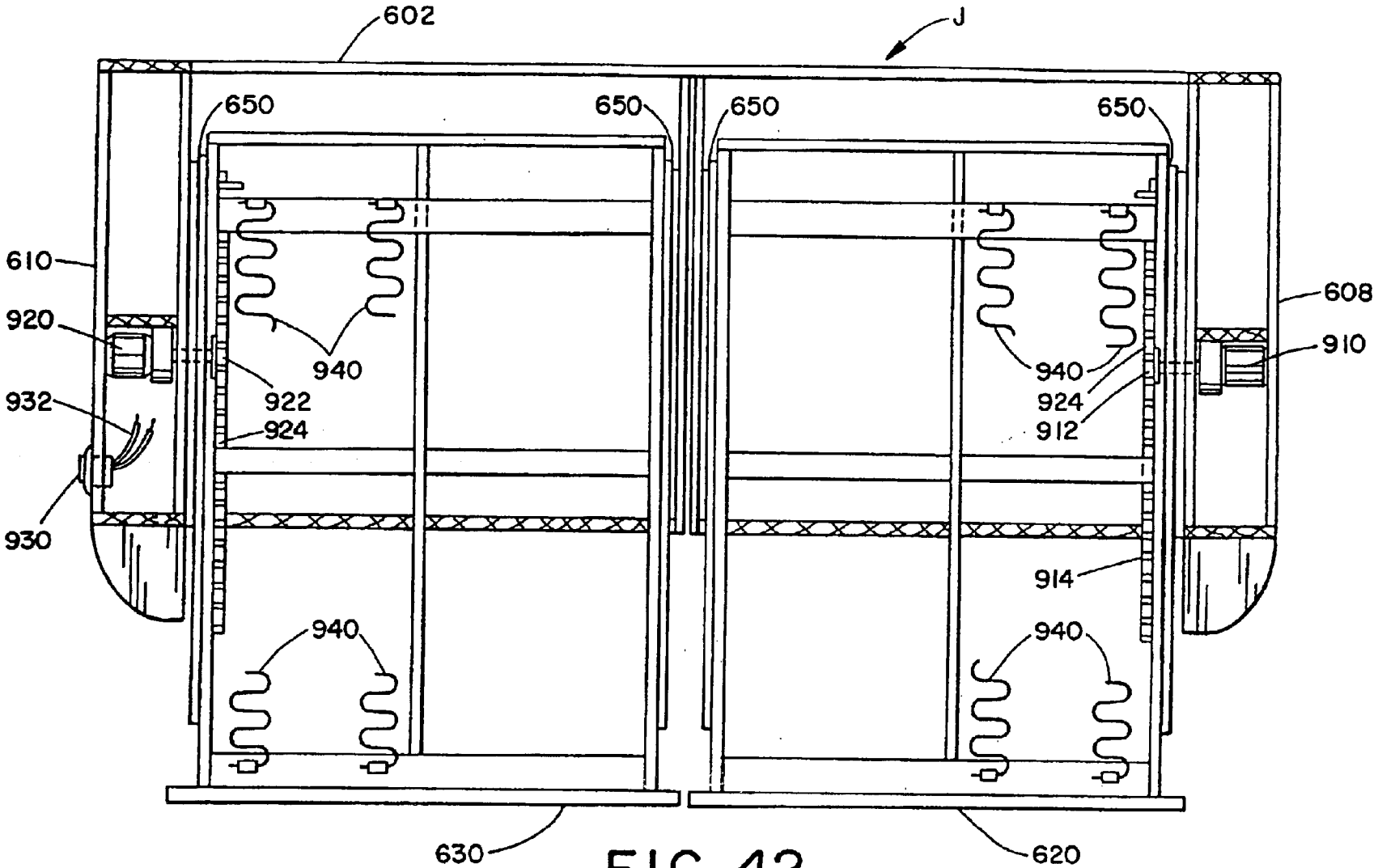
FIG. 42 is a bottom plan view of the first preferred embodiment seating unit having two sliding seat sections.

FIG. 42 illustrates the bottom or underside of the first preferred embodiment seating unit J having two independently movable seat sections 620 and 630. Extending across, or at least partially so, a respective seat section 620 and 630, are a plurality of springs 940. It will be understood that other cushioning or shock absorbing provisions could be employed either in the place of, or in combination with the springs 940. Disposed along each side of a seat section 620 and 630, is the sliding track assembly 650. It will be noted that such an assembly 650 is disposed along the side of a seat section proximate to an end of the seating unit J and, that another assembly 650 is disposed along the other side of the seat section proximate to the middle or interior region of the seating unit J.

The particular version of the seating unit J illustrated in FIG. 42 is shown as comprising electrically powered movable seat sections 620 and 630. Pursuant to this version, the seating unit J comprises a first electric motor 910 disposed proximate to the first end of the seating unit J, and a second electric motor 920 disposed proximate to the second end of the seating unit J. Each motor 910 and 920 includes a rotary gear or pinion 912 or 922, respectively, attached to its drive shaft that is engageable with a rack or linear gear 914 or 924, respectively, affixed to a movable seat section 620 or 630, respectively. One or both motors 910 and 920 are controlled by one or more control switches 930. Although the control switch 930 is shown as located on the second armrest 610, it will be appreciated that one or more control switches 930 can be located in other different locations along the seating unit J. Upon connection to an appropriate power source, operation of the electrically powered version of the seating unit J is as follows. One or both of the motors 910 and 920 are activated by appropriate selection and activation of the control switch 930. Communication between the motors 910 and 920 and the control switch 930 is provided by a plurality of electrical conductors 932. Upon activation of the motor 920, for example, the rotary gear 922 is rotated thereby causing linear displacement of the rack 924, which in turn causes linear displacement of the seat section 630.

Preferably, the control switches 930 are in the form of a three (3) position momentary rocker switch. A first position, maintainable only by holding the switch in that position, activates the respective motor to operate in one direction. Such first position may correspond to extending a seat section. A second position, to which the switch defaults to, does not activate the motor. A third position, opposite from the first and maintainable only by holding the switch in that position, activates the motor in an opposite direction. This second position may correspond to retracting the particular seat section. Instead of utilizing a geadred rack and pinion assembly, it may be preferable to utilize a screw and gear configuration, as previously described in conjunction with love seat D. It is also contemplated that a chain and sprocket assembly could be utilized to extend and/or retract a seat section. A wide array of motors and gear reducers may be utilized. Both 110 V.A.C. motors and 12, 24 V.D.C. motors can be utilized. Preferred gear ratios typically range from about 10:1, 20:1, and 40:1. Typical stroke lengths for the screw members range from about two (2) inches to about twenty-four (24) or more inches. As will be appreciated, it may also be preferred to include adjustable stops along the length of the screw drive.

It will be appreciated that a mechanical locking assembly may be eliminated if certain types of electrically powered drives are employed to move the seat(s) in a seating unit. That is, upon deactivation and stopping of a moving seat, most types of drives will also serve to prevent movement of the seat until the drive is again activated.

It is particularly preferred to utilize a ball screw drive. Such drives are commercially available and feature an electrically powered motor that rotates a geared member which, upon rotation, causes linear displacement of a long screw member. As will be appreciated, the screw member is affixed or otherwise secured to one or more moveable seats. It is preferred that such ball screw drives have automatic stops at both ends of travel, i.e. full extension and full retraction of the screw member. Adjustable stops may also be used. It is also preferable, in some applications, to incorporate one or more sensors to stop operation of the motor in the event that a person accidentally places an object or limb in the travel path of a retracting component such as a seat. Upon deactivation, a ball screw drive serves to secure or lock the seat in position.

In the event that an AC motor is used, a preferred RPM is from about 1500 to about 3500. In the event a DC motor is used, it is preferred that the motor RPM be from about 3000 to about 6000. Appropriate gearing can be utilized to achieve a desired rate of displacement of the screw member.

Representative stroke speeds, i.e. linear displacement along the length of the screw member, are shown below in Table 1:

TABLE 1

| Gear Ratio | Stroke Speed 10:1 | 20:1 | 40:1 |
|---|---|---|---|
| AC Motors: | | | |
| 115, 220 VAC 1700 RPM | .55/.45 | .27/.25 | .14/.14 |
| 115, 220 VAC 3400 RPM | 1.10/.90 | .55/.50 | .28/.28 |
| DC Motors: | | | |
| 12, 24 VDC(PM) 3000 RPM | .90/.70 | .45/.35 | .22/.20 |
| 12, 24 VDC(PM) 6000 RPM | 1.80/1.35 | .90/.65 | .45/.35 |
| 115 VDC(PM) 6000 RPM | 1.80/1.35 | .90/.65 | .45/.35 |

Note:
stroke speeds are in./sec. with no load speed shown first and 500 lb. load speed shown second.

Figure 43:
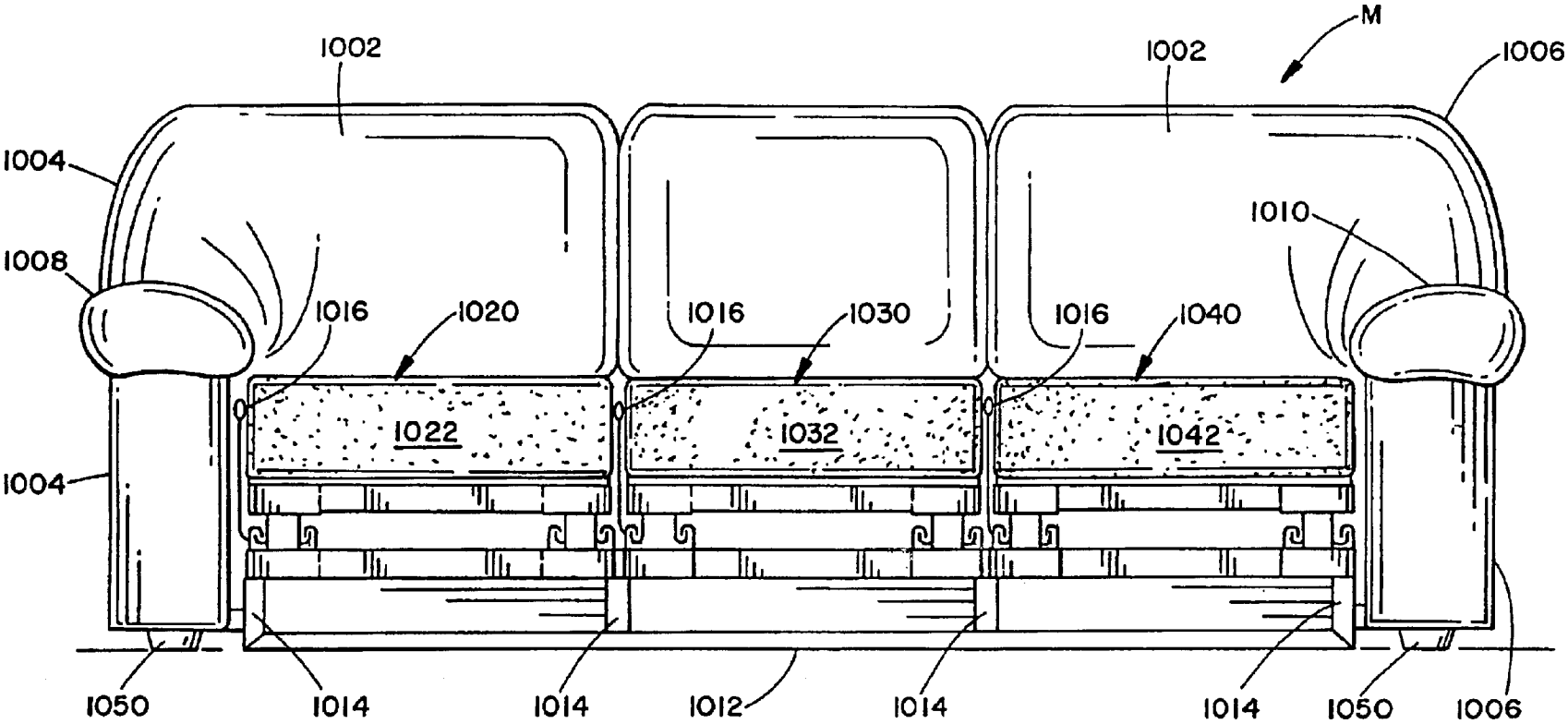
FIG. 43 is a front elevational view of a fourth preferred embodiment seating unit having three sliding seat sections, the unit illustrated in partial schematic form.
Figure 44:
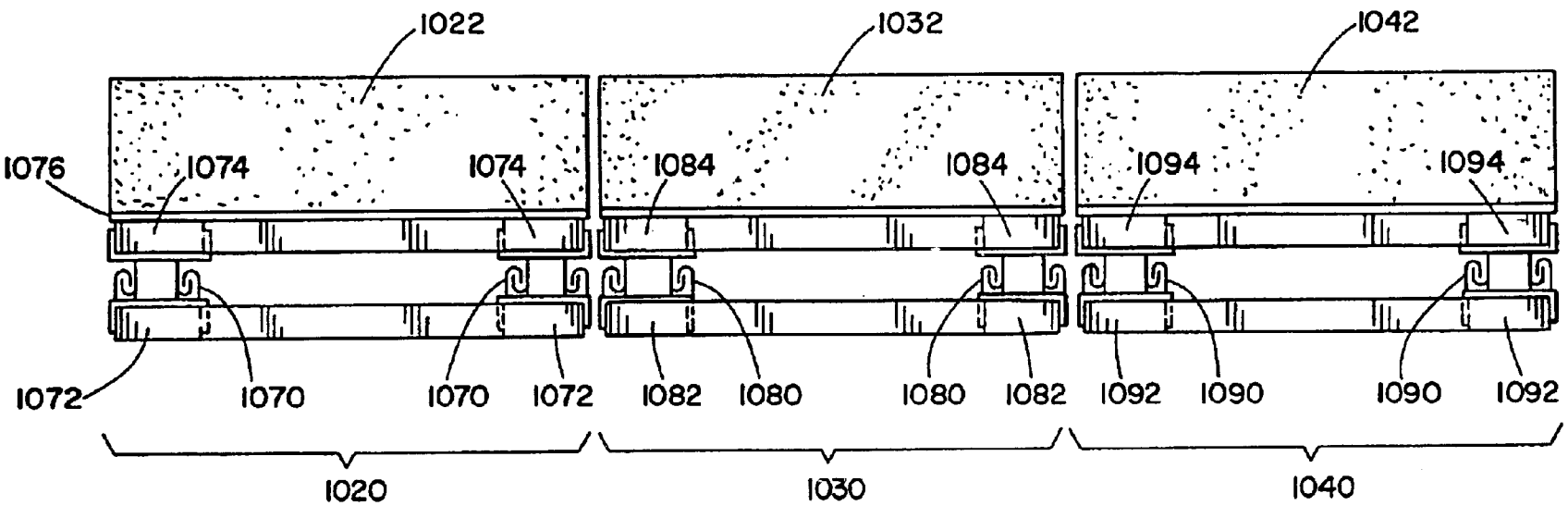
FIG. 44 is a front elevational detail of the three sliding seat sections depicted in FIG. 43.
Figure 45:
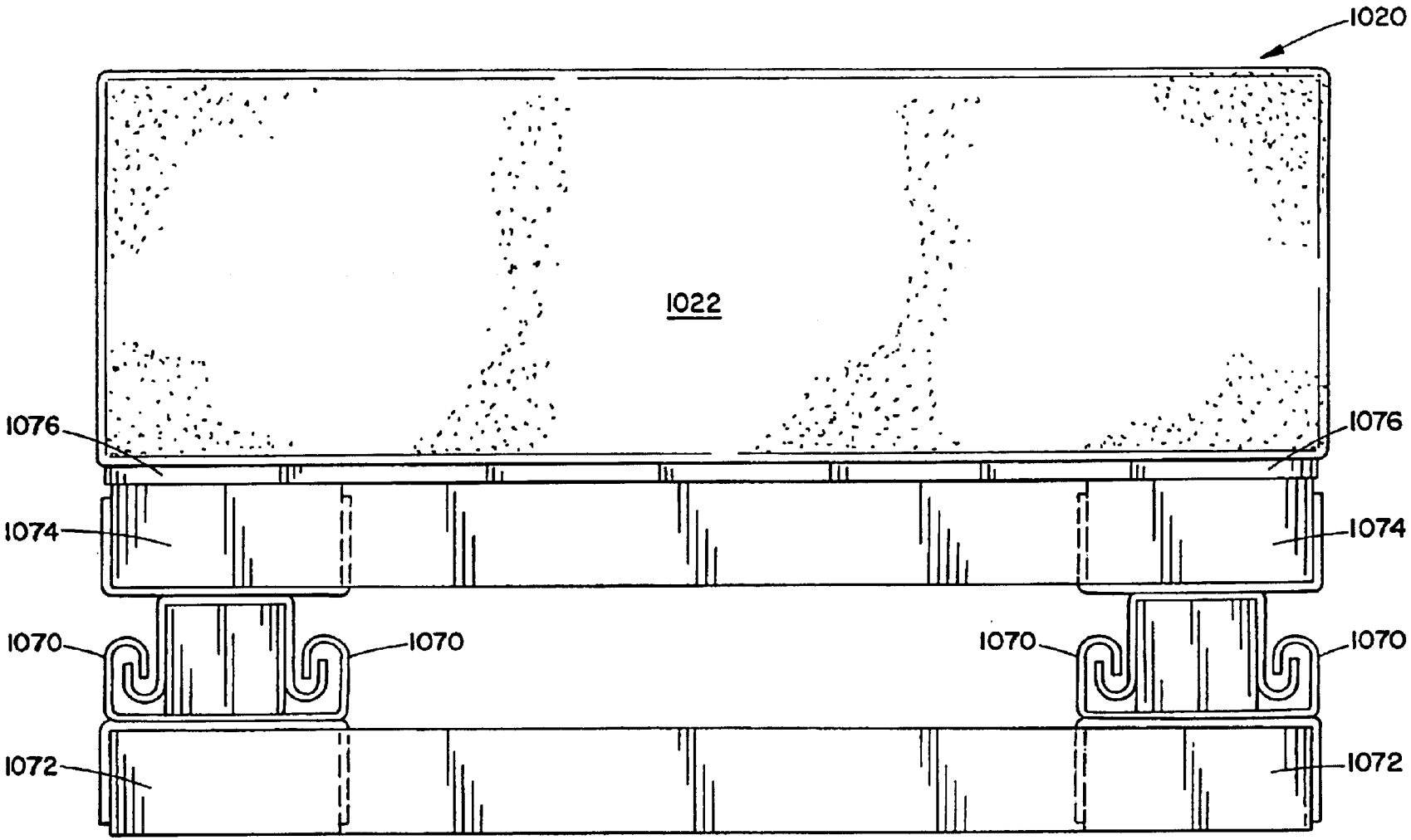
FIG. 45 is a front elevational detail of one of the sliding seat sections shown in FIG. 44.

FIGS. 43 to 45 depict a fourth preferred embodiment multiple seating unit M. This embodiment is characterized by utilizing a sliding track assembly directed under each movable seat section. The seating unit M comprises one or more backrests 1002 generally extending between a first end 1004 and a second end 1006. The seating unit M further comprises a first armrest 1008 disposed along the first end 1004 and a second armrest disposed along the second end 1010. The seating unit M further comprises a plurality of individually movable seat sections such as a first seat section 1020, a second seat section 1030, and a third seat section 1040. One or more cushions are preferably provided with each movable seat section such as a first cushion 1022 for the first seat section 1020, a second cushion 1032 for the second seat section 1030, and a third cushion 1042 for the third seat section 1040.

One significant feature of this seating unit M is that a stationary frame assembly is disposed under each of the movable seat sections. Thus, this seating unit M may be characterized as utilizing a stationary base upon which each of the movable seat sections extends from, and are linearly displaced over. Referring to FIG. 43, the seating unit M comprises a stationary frame assembly comprising one or more horizontal members 1012 that contact the floor. Extending between the members 1012 and the seat assemblies are a plurality of vertical, or at least generally vertical, support members 1014. The frame assembly of the seating unit M may be formed from a variety of materials including for example metal, i.e., steel and wood.

As shown in greater detail in FIGS. 44 and 45, the seating unit M further comprises a first sliding track assembly 1070 enabling movement of the first seat section 1020, a second sliding track assembly 1080 enabling movement of the second seat section 1030, and a third sliding track assembly 1090 enabling movement of the third seat section 1040. The first sliding track assembly 1070 comprises a first set of lower support members 1072, a first set of upper support members 1074, and a planar support 1076 disposed between the first cushion 1022 and the first set of upper support members 1074. Similarly, the second sliding track assembly 1080 comprises a second set of lower support members 1082 and a second set of upper support members 1084. Similarly, the third sliding track assembly 1090 comprises a third set of lower support members 1092 and a third set of upper support members 1094. It will be understood that in each sliding track assembly, the lower support members slidably cooperate and engage the upper support members. The sliding track assemblies preferably utilize metal or polymeric wheels or rollers that travel along a receiving channel or surface. Each sliding track assembly is oriented such that the respective seat section may be linearly displaced from a retracted position to an extended position, vice-versa, and to a plurality of positions in between the retracted and extended positions. Each, some, or all of the track assemblies 1070, 1080, and 1090, can utilize roller bearings, ball bearings, slide assemblies, glide assemblies, linear glides, bearing glides, roller glides, and caster assemblies to achieve the noted movable engagement function. As illustrated in FIG. 43, each movable seat section 1020, 1030 and 1040 may be provided with its own cable-based actuator or motor activator 1016 to releasably lock a respective seat in its desired position.

In an alternate variant of the preferred embodiment seating unit M, the track assemblies 1070, 1080, and 1090 are located closer to the floor or lower region of the unit. Preferably, the previously noted vertical support members 1014 are eliminated, or significantly reduced in height. In addition a corresponding number of intermediate seat frames are located between the seat cushions 1022, 1032, and 1042, and the track assemblies 1070, 1080, and 1090.

Figure 46:
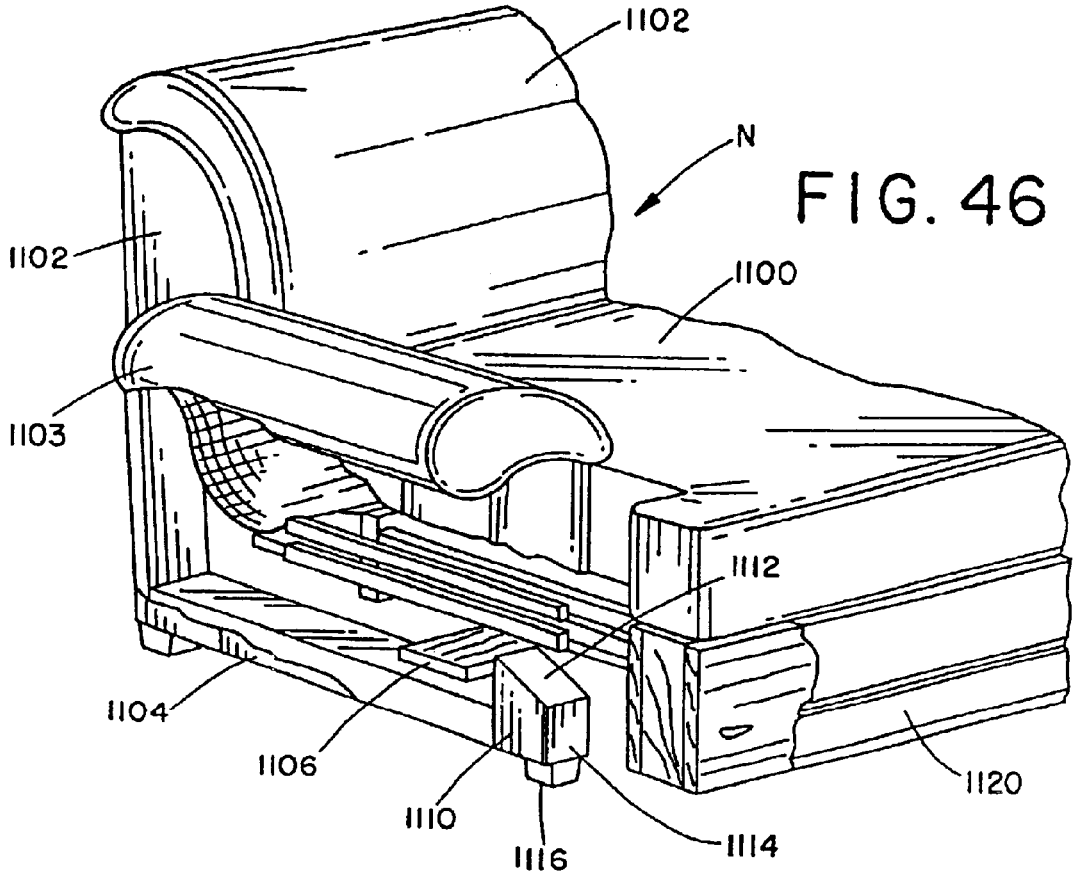
FIG. 46 is a partial perspective view of another preferred embodiment seating unit, revealing a preferred embodiment leg extension feature in accordance with the present invention.
Figure 47:
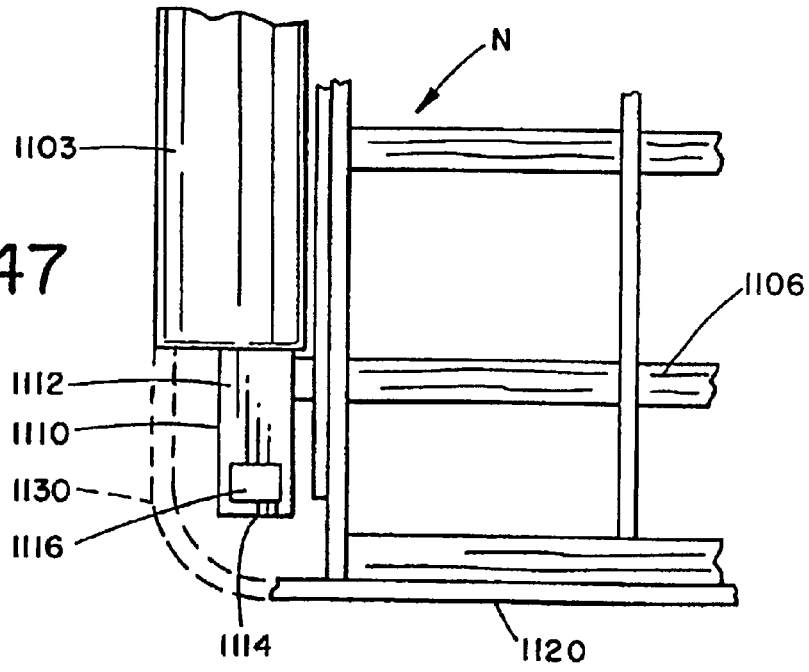
FIG. 47 is a partial view of the underside of the preferred embodiment seating unit depicted in FIG. 46.

Referring to FIGS. 46 and 47, another feature of the present invention is illustrated. This feature, designated as a "forward leg extension" or "leg extension" relates to a configuration in which the front legs or support members are forwardly located thereby increasing the distance between the front legs and the rear legs, and generally increasing the stability of the seating unit. FIGS. 46 and 47 generally illustrate another preferred embodiment seating unit N having this leg extension feature. Specifically, the preferred embodiment seating unit N comprises a cushion 1100, a backrest 1102, an armrest 1103, a lower main frame 1104, at least one main frame cross member 1106, a front fascia or breast board 1120, and the leg extension 1110. The leg extension 1110 is affixed to the main frame, and preferably extends forwardly from the lower main frame 1104. The leg extension 1110 includes a top face 1112, a front face 1114, and a floor contacting region 1116. FIG. 47 is a view of the underside of the portion of the preferred embodiment seating unit N illustrated in FIG. 46. FIG. 47 also illustrates an optional wrap-around fascia or optional breast board portion 1130 that may extend from the fascia 1120 and that at least partially encloses the leg extension 1110. Most preferably, the wrap-around fascia extends entirely around and conceals the leg extension 1110 as shown in FIG. 47.

Figure 48:
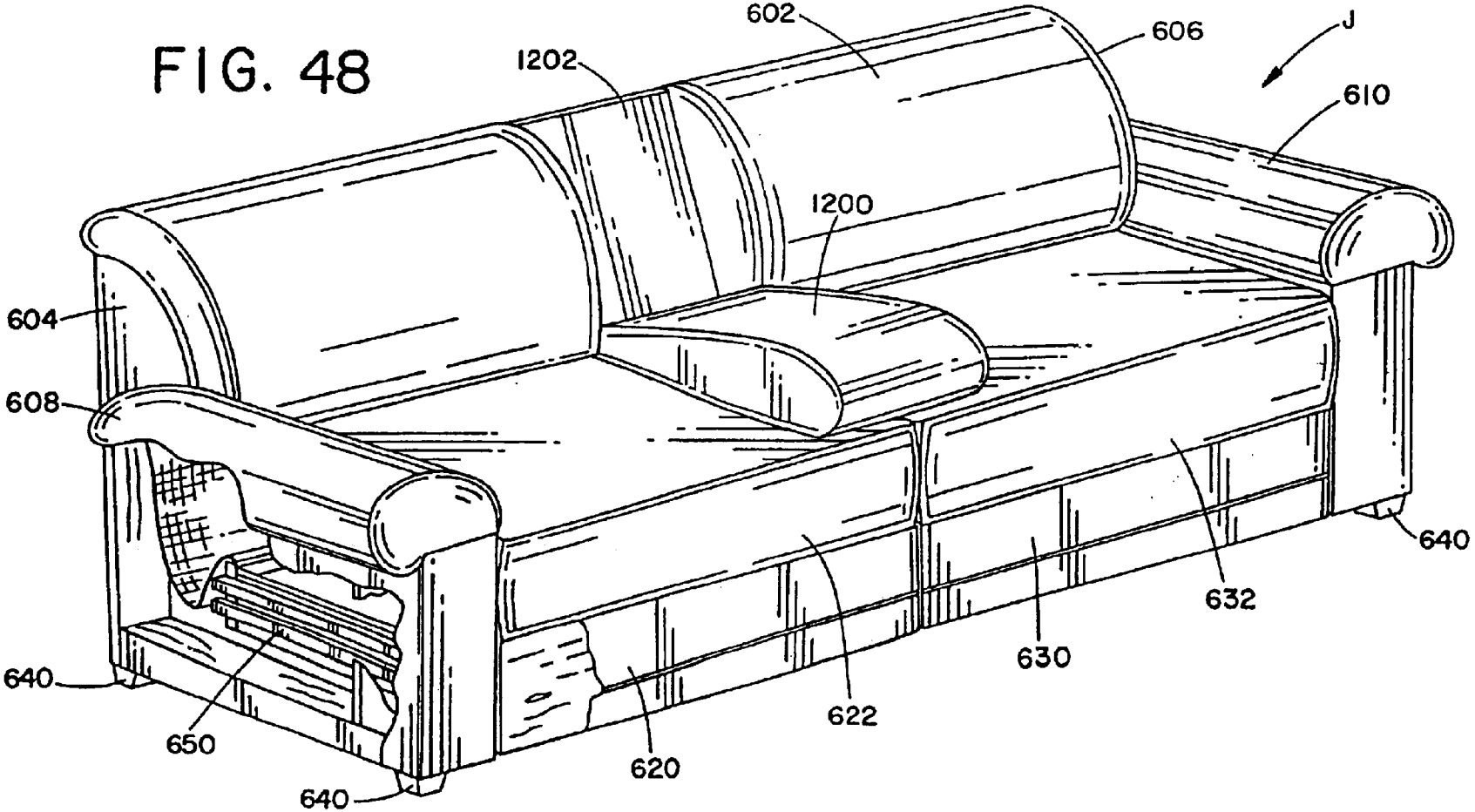
FIG. 48 is a perspective view of the first preferred embodiment seating unit illustrated in FIG. 39, including a preferred embodiment drop-down section in accordance with the present invention.

In yet another aspect, the present invention provides a feature of a "fold-down" or "drop-down" section as shown in FIG. 48. In accordance with this aspect of the present invention, a seating unit is provided with a section or cushion, typically residing along the backrest portion, that may fold or drop downward to provide an armrest, secondary cushion, or other support surface as shown in FIG. 48. Specifically, the previously described preferred embodiment seating unit J, illustrated in FIG. 39, is shown in FIG. 48 and including a drop-down section 1200. That section 1200 may be placed along the backrest of the unit, generally within a cavity 1202 defined along the backrest and preferably between the two backrest cushions. It is also preferred that the section 1200 be affixed along its lowermost edge to thereby form a hinge about which the section 1200 may be pivoted, or otherwise positioned from a generally vertical orientation along the backrest of the unit, and a generally horizontal orientation upon one or more seat sections as shown in FIG. 48. Furthermore, the drop-down section could serve as a console or be provided with a relatively hard work surface such that when the section 1200 was placed into position as shown in FIG. 48, the upwardly directed face of the section 1200 may define one or more cup holder cavities, storage compartments, or writing surfaces. When the section 1200 is placed in its vertical orientation along the backrest of the seating unit, the cupholders, compartments, and/or work surfaces would be hidden from view.

It will be further understood that any of the previously described features and components of any of the assemblies and seating units described herein, may be combined or utilized with, any of the other assemblies and seating units described herein. For example, the console 742 of the seating unit K may be provided in any of the seating units J, L, M, or N. Similarly, one or both of the accessory bases 860 or 864, and the accessory tray 870, may be provided with the seating units J, K, M, or N. The electrically powered version of the seating unit J illustrated in FIG. 42 may be implemented in any of the previously described seating units K, L, M, or N. And, one or more of the sliding track assemblies 1070, 1080, and 1090 utilized in the seating unit M could be utilized in one or more other seating units. In addition, the leg extension 1110 can be incorporated in any of the seating units described herein.

It is worth reiterating that it may in some instances be desirable to orient the movable seat or seat section at a slight inclination for comfort purposes. This may be accomplished in several ways. First, the seat frame could be oriented at a slight angle of inclination relative to the floor, such as 1° to 3° degrees. In addition, or alternatively, the tracks or assembly providing linear displacement of the seat could be oriented such that as the seat is extended outward, it extends along a line that is slightly inclined relative to the floor. In this version, it will be understood that as the seat is extended from the main unit or frame, the distance between the underside of the seat and the floor increases. Accordingly, if legs, casters or other support members are utilized for supporting the extended seat, it would be necessary to accommodate that change in seat height relative to the floor. A more preferred arrangement is to orient the seat tracks generally parallel to the floor such that the seat extends parallel to the floor, and form the upper portion of the seat to provide an inclined seating surface. Related to this, a seat cushion of varying thickness may be utilized to provide an upwardly facing inclined seating surface. Yet another technique for providing an inclined seat, which extends horizontally outward and which utilizes a seat cushion of uniform thickness, is to orient the support member upon which the cushion resides, at some slight angle of inclination, such as 1° to about 3°. In these versions in which the seats move generally parallel to the floor, the present invention seating unit may be characterized as having seats whose movements are generally limited within one or more horizontal planes.

Seating units in accordance with the present invention have several significant features and characteristics. A first feature relates to the use of one or more cavities defined within the rearward interior region of the couch. Referring to FIG. 3 for example, a cavity 138 is defined below the upholstered back 54 of the sofa A. This cavity 138 is unique in that it receives the rearward end of a cushion or seat section when the seat section, such as represented by the cushion 50, is retracted into the seating unit. Generally, most of the preferred seating units as described herein utilize a cavity that is generally defined below the lower portion of the upholstered back of the unit. The cavity typically extends across the length of the unit, i.e. the distance from one arm rest to the other, and is sufficiently sized to receive one or more of the cushions or seat sections when retracted, and preferably fully retracted, into the seating unit.

It is also significant that the cavity is oriented and sized such that a relatively large portion of the seat section or cushion may reside in the cavity when the seating unit is in a retracted state. The portion of the seat section that may be inserted and essentially stored within the cavity may be up to one-half of the front-to-back dimension of the seat section or cushion. The present invention includes configurations in which even greater portions of the seat sections may reside within the cavity. Typically, the portion of the seat section that resides within the cavity when the seat is fully retracted, is about one-third of the seat's front-to-back dimension. It is also important and significant, that the cavity is sized such that when the seat is retracted therein, there is no deformation of the seat or cushion. And, preferably, the seat retracts horizontally directly into the cavity.

The provision of one or more cavities in the seating units of the present invention greatly improves the functionality and aesthetics of the overall seating unit. Relatively long cushions or seat sections may be provided and utilized since the cavity feature accommodates a significant portion of the length, i.e. the front-to-back dimension, of these cushions or sections when retracted into the seating unit. Without the cavity, the relatively long cushions or seat sections would extend outward beyond the front face of the seating unit. The cavity feature of the present invention promotes the compactness of the overall seating unit, particularly when the unit is in a retracted position.

Another benefit and characteristic of the cavity feature is that the movable cushions and seat sections are generally received within and essentially stored when retracted into the cavity, without any manipulation or changing of their position. This greatly facilitates ease of use of the unit. Moreover, the cavity also receives the relatively rigid seat frame, such as seat frame 40 illustrated in FIGS. 3 and 5. The cavity is preferably sized and shaped to receive and accommodate the entire collection of relatively rigid and movable seat frame(s) and all cushions or seat sections disposed thereon. Most preferably, the rearward portion of the collection of seat frame(s) and cushions or seat sections, when fully retracted, are positioned immediately adjacent to the frontward facing interior face along the rear of the seating unit. This frontward facing interior face generally defines the rearward-most portion of the cavity. In some applications, it may be desirable that the rearward portion of either the seat frame(s) and/or the cushions or seat sections contact the frontward facing interior face along the rear of the seating unit, when the unit is placed in its fully retracted position.

In yet another aspect, if the rear back of the seating unit is tilted or otherwise angled with respect to a vertical plane along the rear of the unit, particularly if such configuration causes the interior surfaces of the seating unit defining the cavity to also tilt rearwardly, it may be desirable to form the rearward edge of the seat frame to match the angle of inclination. Accordingly, when the seat section(s) is (are) fully retracted into the cavity, and possibly contacting the frontward facing interior face along the rear of the seating unit, additional clearance and retraction distance is achieved. That is, by utilizing a seat frame having a rearward face that is angled to match the angle of inclination of the backrest, significantly greater portions of the movable seat or seat section may be retracted into the cavity, as compared to if the rearward face of the seat frame does not match the configuration of the rear of the cavity.

Related to this, additional retraction distances may be obtained by positioning one or more horizontal braces along the rear of the unit, such as horizontal brace 32 depicted in FIG. 3, upward and thus out of the way from the rear portion of the sliding seat. This practice may provide still further clearance by which the cavity accommodates the movable seat or seat section(s).

Another significant feature of the present invention seating unit relates to the counterbalanced aspect of the unit. In many of the preferred embodiment seating units described herein, the distal end of the one or more seat sections provided in the seating unit, is essentially cantilevered from the seating unit. That is, the seat sections do not require any support member such as legs or caster assemblies under the distal end of the seat section. The distribution of weight of the seating unit is such that even when the respective seat section(s) are fully extended from the seating unit, the seating unit will not tip, tilt, or rock forward. In many embodiments, the weight of the backrest and associated frame will promote the counterbalance feature of the present invention. Also, the counterbalance feature may be accomplished by the selection of particular materials for certain components of the seating unit. For instance, if the seating unit is faced with an upper limit on its weight, relatively heavy materials could be utilized for its rearward components, such as the backrest frame, and lighter materials employed for components that are disposed in the frontward region of the unit, such as for example, aluminum or certain grades of wood. In addition, it is contemplated that weights could be added along the rear of the seating unit.

Specifically, in accordance with this counterbalance feature, the center of gravity (or center of mass) of the seating unit is always located behind the frontmost support members, which referring to FIG. 3, correspond to legs 36. Further in this regard, it will be understood that when the seating unit is in a retracted position, the center of gravity of the seating unit is located somewhere within the interior of the unit and generally between the front and rear faces of the unit. When the seating unit of the present invention is extended, such that the one or more seat sections are extended outward from the front portion of the unit, the center of gravity of the unit, although having moved toward the front of the seating unit as a result of the seat section(s) being extended, still remains behind the frontmost support members, e.g. legs 36 in FIG. 3.

This counterbalance feature of the present invention is beneficial in that it eliminates the requirement of providing support members on the underside of the seat sections. And, this feature enables the seat sections to be extended over an uneven floor surface, such as resulting from loose or bunched carpeting. Of course, it will be understood that the present invention encompasses seating units utilizing such support members, if so desired. The counterbalance feature of the present invention contributes to improved stability of the unit, particularly when one or more people are seated in the unit and one or more seat sections are extended.

In all of the foregoing embodiments, the track, rail, or glide assemblies providing horizontal movement of the seat or seat sections, may be biased or spring tensioned to urge the seat or seat section to either an extended position or a retracted position. In addition, in all of the embodiments, it may be preferred to mount or otherwise locate the track, rail, or glide assemblies along the lower portion of the armrests, or frame members therefor. This configuration will likely result in a strengthening effect and promote the overall rigidity of the seating unit.

All of the previously noted seating units may utilize seat cushions that are unattached, i.e. are freely movable. In addition the seat cushions may be temporarily or releasably attached to the one or more seat frames by the use of releasable fasteners such as velcro, or snaps. It is also contemplated that one or more of the seat cushions may be permanently attached to the movable seat frames. A permanent attachment configuration may be desirable for some applications as the seat cushions are less likely to shift or otherwise move relative to the seat frame, as the seat frame is being moved.

Figure 49:
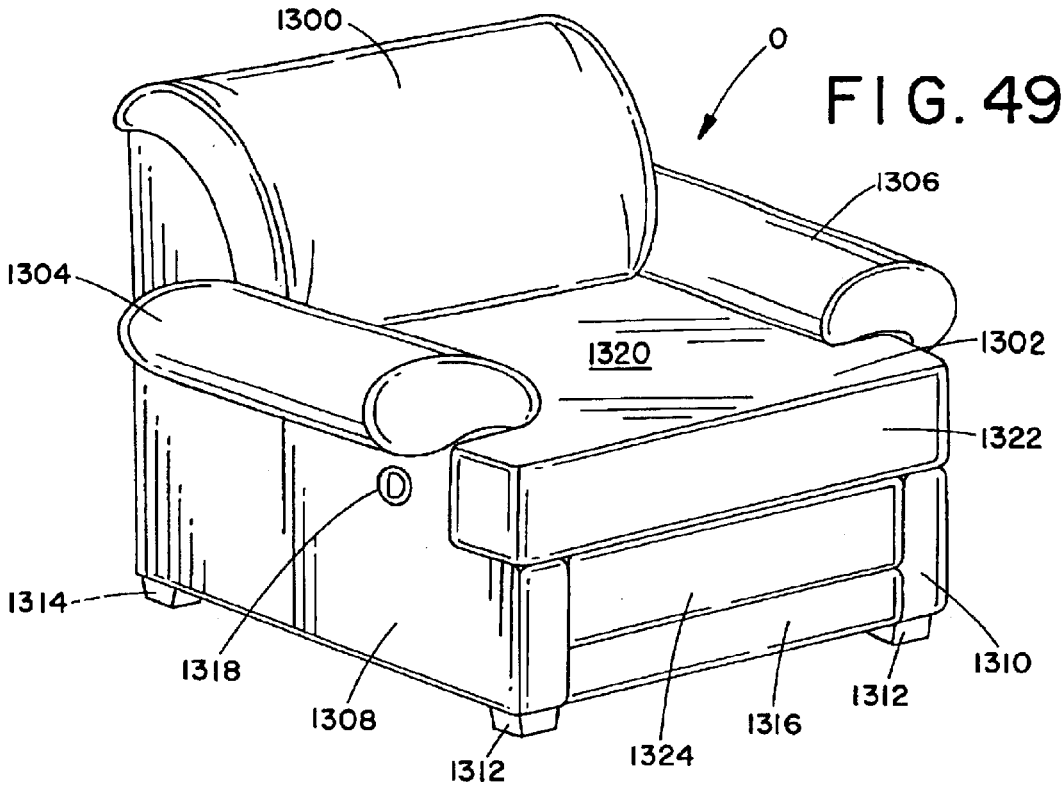
FIG. 49 is a perspective view of yet another preferred embodiment seating unit in accordance with the present invention, the seating unit being depicted in a retracted state.

FIG. 49 illustrates another preferred embodiment seating unit in accordance with the present invention. A single seating unit 0 comprises a backrest 1300, a horizontally positionable seat 1302, a first armrest 1304 proximate a first side 1308, and a second armrest 1306 proximate a second side 1310, opposite from the first side 1308. The single seating unit 0 further comprises one or more front legs 1312 and one or more rear legs 1314. It will be appreciated that other leg or base configurations may be utilized. The seating unit further comprises a front face 1316, a seat cushion 1320 disposed on a seat frame 1324. A seat control 1318 is provided for enabling movement and selecting a position for the movable seat frame 1324 and the cushion 1320 disposed thereon. The seat cushion 1320 has a frontmost portion 1322.

Figure 50:
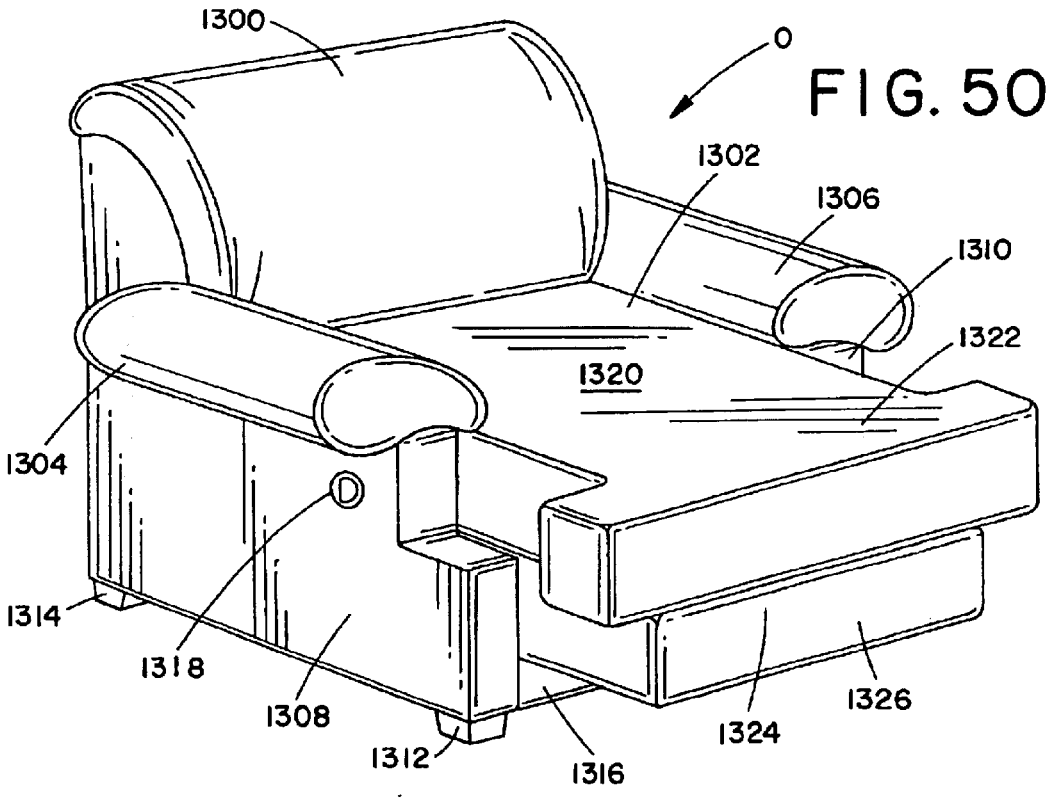
FIG. 50 is a perspective view of the preferred embodiment seating until shown in FIG. 49, in an extended state.

FIG. 50 is a perspective view of the seating unit 0 depicted in FIG. 49, however in an extended state. In this state, it can be seen that the movable seat frame 1324 and seat cushion 1320 disposed thereon, are extended outward from the front of the unit. As will be appreciated, this state of extension provides significantly greater seat surface area for supporting an individual. And, the depth, i.e. the distance from the front to the rear, of the seat is increased. Most preferably, the seat frame 1324 does not utilize any supports along its front face, such as proximate a frame front member 1326. Thus, upon extension, the seat is essentially cantilevered out from the front of the seating unit 0.

Figure 51:
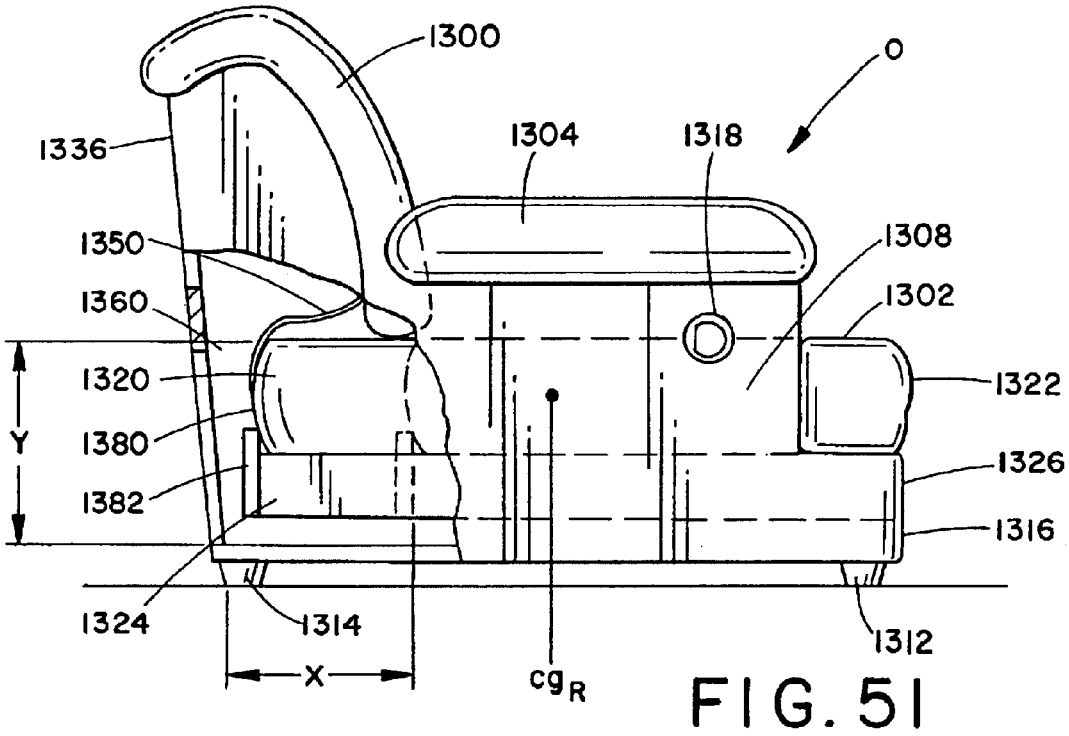
FIG. 51 is a side elevational view of the preferred embodiment seating unit shown in FIG. 49.
Figure 52:
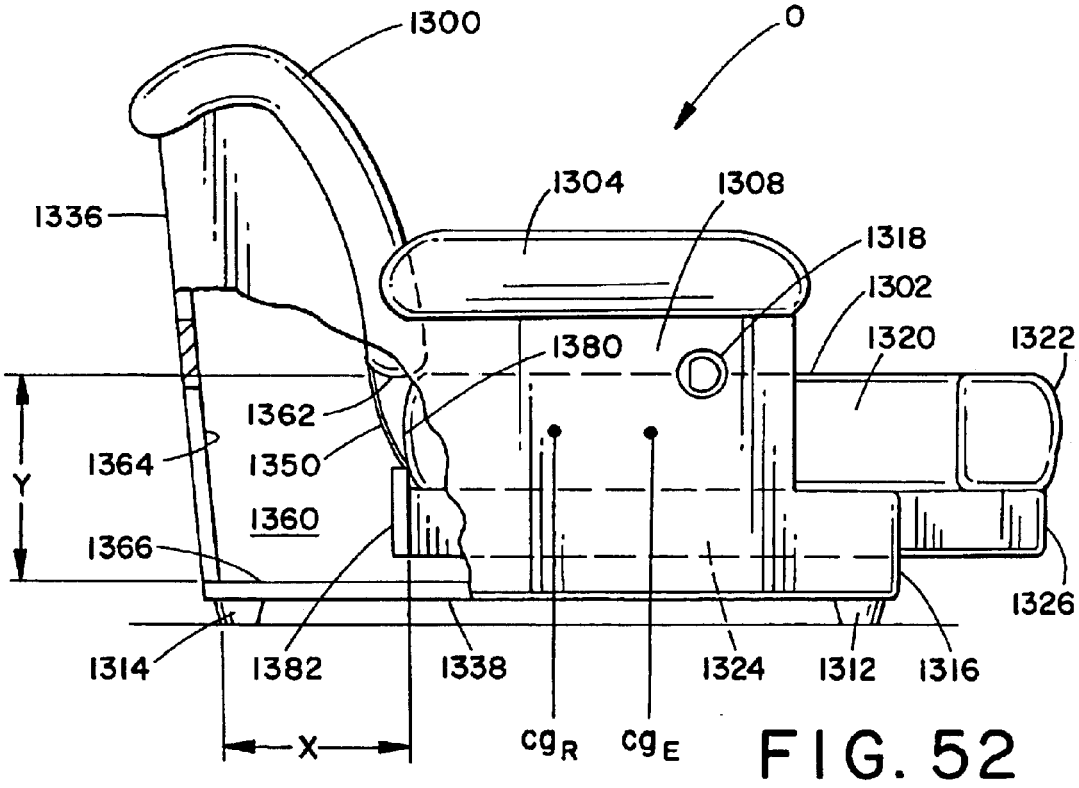
FIG. 52 is a side elevational view of the preferred embodiment seating unit shown in FIG. 50.

Referring to FIGS. 51 and 52, additional aspects of the preferred embodiment seating unit 0 are disclosed. These figures are side elevational views of the preferred embodiment seating unit 0 in a fully retracted state (FIG. 51) and in a fully extended state (FIG. 52).

As previously noted with regard to other preferred embodiment seating units described herein, the seating units of the present invention define a cavity within a rearward portion of their interior. That open interior region or cavity as referred to herein accepts and receives the seat frame and cushion when retracted into the unit. Referring to FIG. 52, the seat and frame being fully extended from the front of the seating unit 0, a cavity 1360 is defined within the rearward interior, generally having the dimensions X, Y, and a length corresponding to the length of the seating unit. The vertical dimension Y is the distance between the interior face 1366 of the bottom member 1338, to the lowermost edge 1362 of the backrest 1300. The horizontal dimension X is the distance between the interior face 1364 of the rear wall 1336 and generally, the vertical plane intersecting the backrest lowermost edge 1362. The horizontal dimension X of the cavity may be increased by providing for the seat frame 1324 to be extended farther.

Upon retraction of the seat, i.e. seat frame 1324 and the cushion 1320, the rear portion of the seat is received within the cavity 1360, as shown in FIG. 51. Although FIG. 51 depicts separation between the interior face 1364 of the rear wall 1336 and the seat frame rearmost member 1382, it may in some applications be desirable that contact occurs between these components. It is also evident from a comparison of FIGS. 51 and 52 that the apron 1350 extending from the rear edge of the seat to the backrest 1300 be long enough to allow full retraction and full extension of the seat.

Referring to FIG. 51, when the seating unit 0 is fully retracted, the unit has a center of gravity $Cg_R$ located at about the center of the unit. Referring to FIG. 52, it will be noted that upon extension of the seat, the center of gravity shifts to a new location, $Cg_E$, i.e. the center of gravity of the seat upon extension. As previously described herein, it is significant that the center of gravity always be defined at a location between the front legs 1312 and the rear legs 1314. Particularly when the seat is extended, it is important that the center of gravity $cg_E$ be located behind the front legs 1312 as shown in FIG. 52.

Another desirable feature provided by the present invention and exemplified by the preferred embodiment seating unit 0, is the use of a raised rear seat frame member 1382. Referring to FIGS. 51 and 52, it can be seen that the uppermost or top edge of the rear frame member 1382 is raised above the other seat frame members. This is desirable to provide a stop or backstop in essence, for the seat cushion 1320. Such a configuration greatly reduces the potential for the seat cushion 1320 from becoming displaced or otherwise separated from the seat frame 1324 during seat extension.

And, as previously noted, the use of releasable fasteners between the seat cushion 1320 and the seat frame 1324 is preferred. Such releasable fasteners may be in the form of snaps, buttons, hook and loop systems commonly known as Velcro, zippers, other hook and loop or eyelet systems, and tie cords. The use of Velcro is most preferred.

Figure 53:
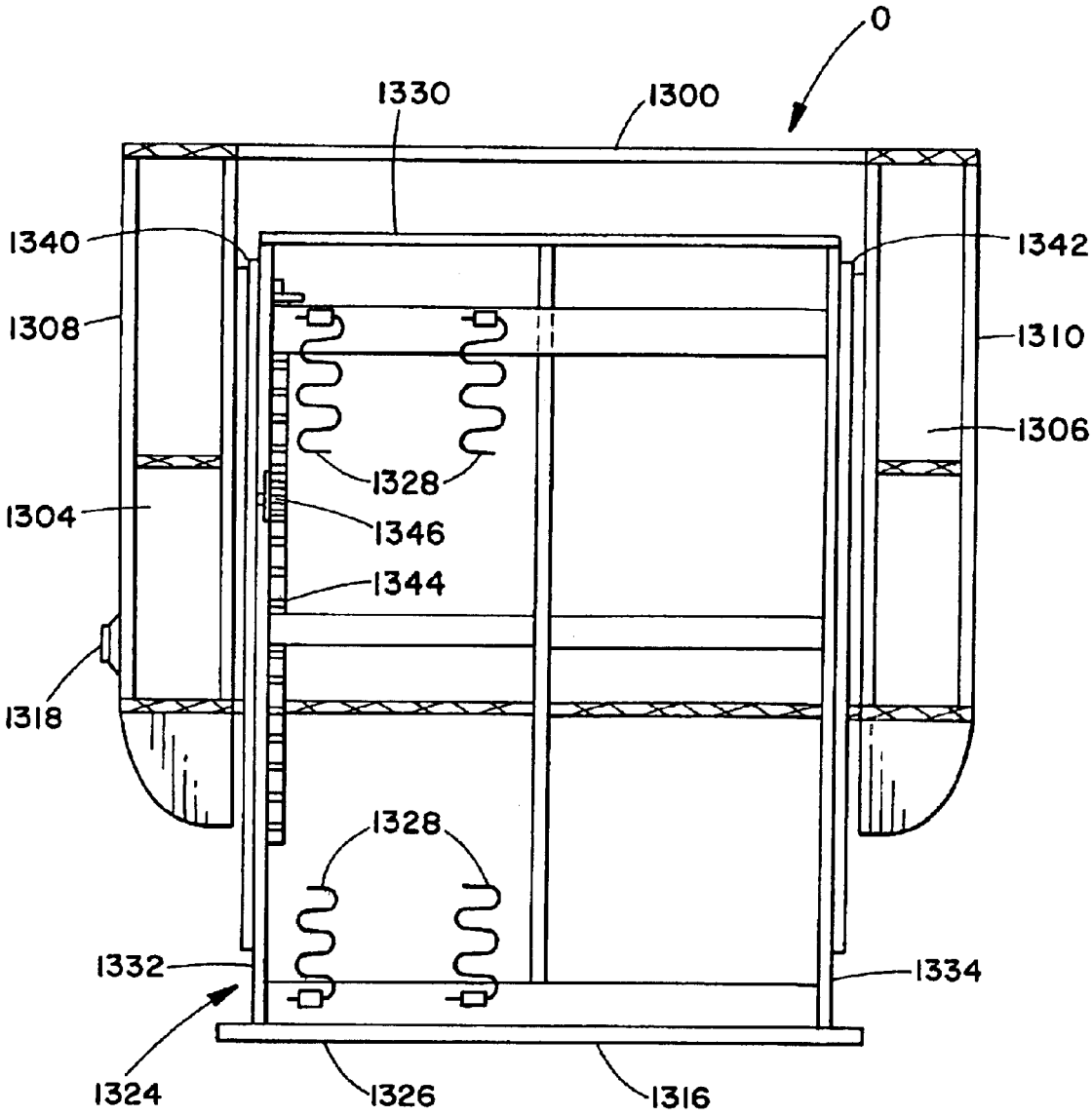
FIG. 53 is a view of the underside of the seating unit illustrated in FIG. 49.

FIG. 53 illustrates the underside of the preferred embodiment seating unit 0. The components of the seat frame 1324 are shown as a frame front member 1326, a first frame side member 1332, a second frame side member 1334, and a frame rear member 1330. The members 1326, 1330, 1332, and 1334 are preferably secured to one another as shown in FIG. 53 and at right angles to form a rigid square or rectangular shaped seat frame 1324. A plurality of biasing or cushioning members 1328 are provided within the seat frame 1324 to promote or provide additional cushioning for the seat cushion 1320. The seat frame 1324 is horizontally movable with respect to the back rest 1300, sides 1308 and 1310, and bottom member 1338 of the seating unit 0. A first and a second extension assembly 1340 and 1342, similar to other assemblies and mechanisms described herein for providing movement of a seat, are provided. The assemblies 1340 and 1342 enable the seat, i.e. the seat frame 1324, to move inward and outward, generally within a horizontal plane, from the front of the seating unit. An engagement rail 1344 is provided, that together with an engagement element, such as a positionable pin or latch 1346, enable the seat frame 1324 to be secured in one of a plurality of positions between a fully extended state and a fully retracted state. As will be understood, the engagement rail is affixed to either the movable seat frame or the stationary frame or carriage of the seating unit. The engagement element is attached to the other component, such that upon engagement between the two, the rail and element are temporarily coupled together, thereby temporarily securing the seat frame to the remainder of the seat. As will be understood, the engagement rail and element may take a variety of forms, however typical forms for the rail include a rail with a plurality of notches or apertures defined along its length, and typical forms for the element include a pin or moveable member that may engage a notch or aperture defined in the rail.

All of the foregoing aspects and features, particularly those associated with the single seating unit 0, may be incorporated or provided in any of the other seating units described herein. Furthermore, it is to be understood that although the seating unit 0 is depicted as a single seating unit or chair, the preferred embodiment seating unit 0 could readily be embodied in a longer unit such as a loveseat, sofa, or couch.

The present invention also provides, in yet another aspect, a system for remote extension or retraction of one or more seat sections or other moveable components of a seating unit. Preferably, this system includes a seating unit having an electrically operated drive for extending and retracting a moveable seat or seat section. This system further includes a remote control or remote activation system for activating the electrically operated drive. Most preferably, this system utilizes a wireless hand held remote control unit. That remote control unit, upon activation, transmits an activation signal to a receiver unit which may be mounted within the interior or underside of the seating unit. Upon receiving such activation signal, the receiving unit activates the electrically operated drive to appropriately move the seat or seat section.

The use of a remote control system in a motion furniture product is particularly advantageous because it allows the user to activate the product while in nearly any position. That is, the user does not have to sit up, search for a release handle, and pull or otherwise release that handle. Instead, the user merely pushes a button or otherwise activates a switch to initiate operation.

In a most preferred embodiment, a remote control system is provided for each electrically driven moveable seat. Thus, a single hand held control unit can be used for selective control and operation of each seat or moveable component of a seating unit.

The term "selective operation" is utilized to refer to the ability to extend and retract a seating unit, and to stop at any position in between full extension and full retraction.

The remote control unit may take a variety of forms and embodiments. For instance, the unit may be integral with, or incorporated into, the seating unit. The unit could be in the form of a keypad located on one or both arm rests. Alternatively, the unit could be in the form of a hand held unit that is attached to the seating unit by one or more flexible cables or extension members. More preferably, the remote control unit is a wireless unit that communicates with the seating unit by radio frequency (RF) or infrared signals. An RF based system is most preferred.

Although not wishing to be bound or limited to any particular system, an exemplary remote control system and electrically operated drive system could utilize the following components. A 12 VDC remote control RF based system is used such as a two channel codelock transmitter available under the designation Velleman™ Kit K6727 (receiver) and Velleman™ Kit K6706A (transmitter). A screw drive, as explained in greater detail herein, may be driven by a 115 VAC, 1.8 amp motor available from Motion Systems, Inc., under the designation 7164-0945 T4P64B1.

It is also contemplated to utilize a second remote control unit. Such secondary unit could be configured to operate the seating unit in parallel with a first or primary remote control unit. In addition, two remote control units could be provided in which one is a wireless unit and the other is cabled to the seating unit.

Furthermore, it is fully contemplated that the one or more remote control units employed by the present invention seating unit could also be configured to operate or activate other components of the seating unit. Such other components include for example, a tilting mechanism for adjusting the inclination of a moveable back section, electrically operated massage units in the seating unit, one or more heating pads or areas of the seating unit, moveable trays or support pieces, lights, extendable ottomans or foot rests, tables, integrated coolers or refrigerators, telephones and other communication equipment, and computer equipment.

In the event that one or more wireless remote control units are provided, a variety of structures and techniques are provided for retaining, storing, and maintaining the unit(s).

In one preferred embodiment, a pocket or retaining area is built into the seating unit, which pocket being sized to receive the remote control unit. It is also envisioned to provide a dual holder assembly for the remote with accommodations to also receive one or more other remote control units such as are typically used width conventional televisions.

Furthermore, it is also contemplated that the present invention remote control system could be configured such that it could be operated by a universal remote control unit.

In a particularly preferred embodiment, the present invention provides a system for activating an electrically operated drive system with one or more remote control units that are incorporated within the seating unit and serve to replace activation cables, rods, levers, and/or other mechanical components. This is described in greater detail below.

Figure 54:
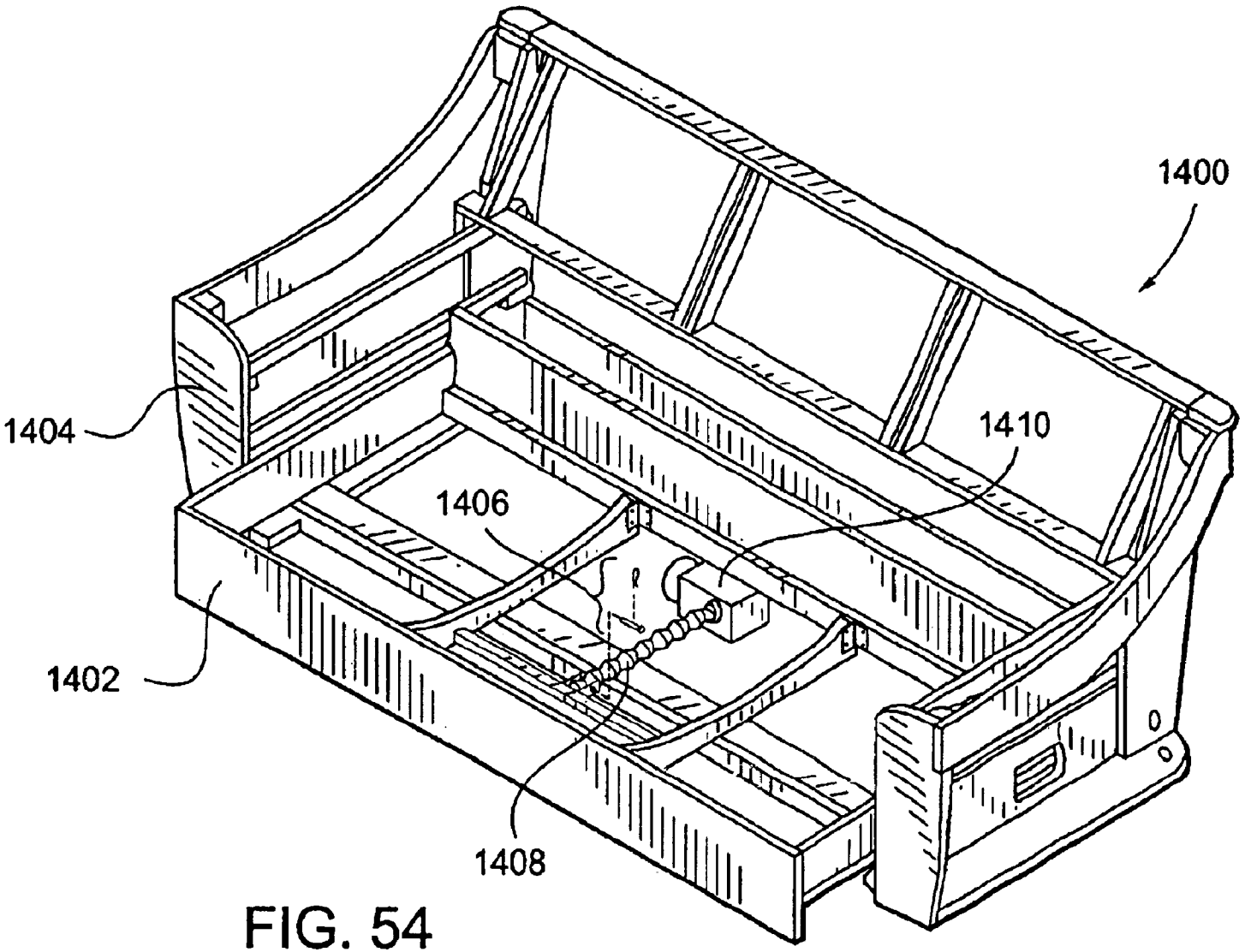
FIG. 54 is a perspective view of another preferred embodiment frame for a seating unit, the figure illustrating an electrically operated drive mechanism.

FIG. 54 is a perspective view of a frame assembly including a preferred embodiment electrically operated screw drive assembly for extending and retracting the seat. FIG. 54 illustrates an assembly 1400 comprising a frame and a movable seat disposed within the frame. The seat 1402 may be extended outward from the frame 1404 or may be retracted and received within the frame 1404. The seat and frame are coupled to one another by an electrically powered drive system that includes a motor 1410 secured to the frame 1404, and a screw member 1408 secured to the seat 1402. Upon activation of the motor 1410, a geared member driven by the motor output shaft is rotated. That geared member is engaged with the screw member 1408. Accordingly, upon rotation of the geared member, the screw member is linearly displaced, thereby causing linear movement of the seat, i.e. extension and retraction of the seat 1402. Most preferably, the screw member 1408 is releasably attached to the seat 1402 by use of a set of cotter key and retaining pin designed as 1406. Upon disengagement of the screw member 1408 from the seat 1402, the seat may be freely moved. This releasable feature may be of significant advantage in the event of a power failure since it readily releases the seat and enables movement.

Figure 55:
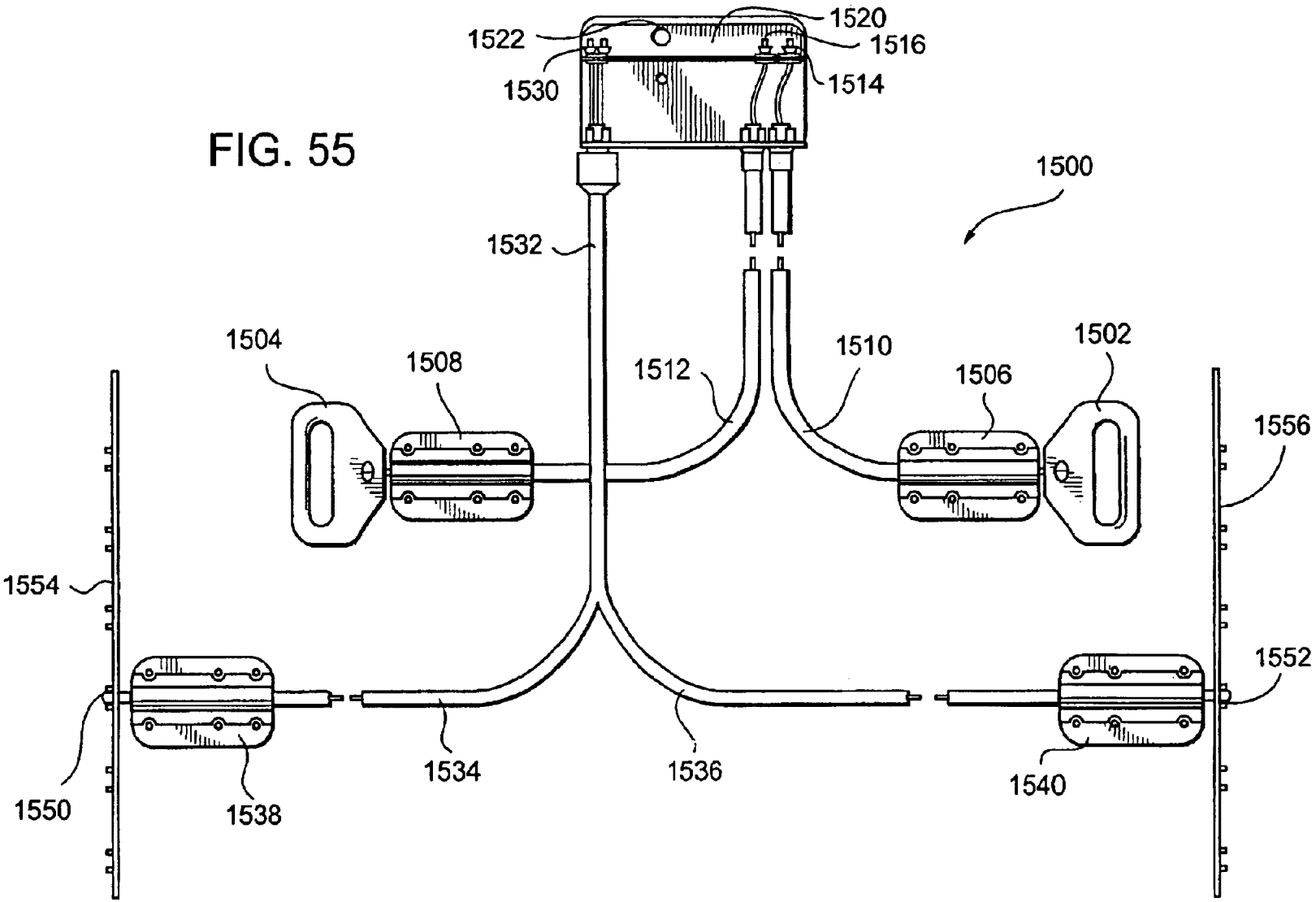
FIG. 55 is a schematic of a preferred embodiment cable assembly for selective release of one or more independently moveable seat sections.

FIG. 55 is a schematic representation of another cable assembly that is suitable for use in a preferred embodiment seating unit having two independently moveable seating sections. As shown in FIG. 55, pulling one of the handles causes pivoting or partial rotation of a plate about a hinge or axis point. That movement in turn, pulls or tensions one or more release cables that retract release pins. Upon release or disengagement of those pins from brackets of a slide mechanism, the one or more seat section(s) may be moved to a desired position.

Specifically, FIG. 55 illustrates a preferred cable actuation system 1500. This preferred system 1500 comprises one or more actuation handles or levers, such as pull handles 1502 and 1504. As will be appreciated, pull handles 1502 and 1504 may be accessible at opposite ends or sides of a seating unit. The handles 1502 and 1504, and corresponding ends of cables 1510 and 1512, are preferably secured to the seating unit by retainers 1506 and 1508. Cables, preferably sheathed cables, 1510 and 1512 are secured to corresponding pull handles 1502 and 1504 as shown and extend to an actuator plate 1520 at which they are secured by adjustable tensioning fasteners 1514 and 1516. Actuator plate 1520 is secured to an interior component of the seating unit such as a frame member of the seating unit such that the plate 1520 may pivot about an axle or pivot point 1522. Details of the operation and function of plate 1520 are provided below.

Also secured to plate 1520, opposite from cables 1510 and 1512, is a cable 1532. Cable 1532 is secured to plate 1520 by an adjustable tensioning fastener 1530. Cable 1532 extends from the plate 1520 to a junction at which the cable 1532 splits into two or more cables, such as cables 1534 and 1536, that are in communication with corresponding mechanical actuators. Specifically, referring further to FIG. 55, cable 1536 terminates at, and is secured to, a release pin 1552 that engages a slide assembly 1556. Similarly, cable 1534 terminates at, and is secured to, a release pin 1550 that engages a slide assembly 1554. The release pins 1552 and 1550, and corresponding ends of cables 1536 and 1534, are preferably secured by retainers 1540 and 1538.

The operation of the cable actuation system 1500 is as follows. A user, wishing to change the position of a seat in a preferred embodiment seating unit according to the present invention, pulls one of the handles 1502 or 1504. Pulling of a handle results in a pulling or tension in a corresponding cable 1510, 1512. That force is applied to one side of the actuator plate 1520, i.e. at the location of attachment of cables 1510 and 1512. Application of that force results in plate 1520 pivoting about pivot point 1522. Referring to FIG. 55, plate 1520 pivots in a clockwise fashion. As will be understood, the opposite side of plate 1520 is then displaced such that cable 1532 is pulled or tensioned. Application of such force is then transmitted to both release pins 1550 and 1552 by cables 1532, 1534 and 1536. Tensioning or pulling of cables 1534 and 1536 results in retraction of pins 1550 and 1552 from corresponding slide assemblies 1554 and 1556. Upon retraction, the assemblies 1554 and 1556 enable a corresponding seat (not shown) to be moved to a desired position.

An alternate actuation system may be utilized, however similar in many respects to a manual actuation system such as that depicted in FIG. 55. In this alternate actuation system, one or more of cables 1510, 1512, 1532, 1534, and 1536; retainers 1506, 1508, 1538, and 1540; plate 1520; and associated hardware; are replaced by electrical actuation components. In a most preferred aspect, all of the noted cables, pull handles, actuator plate, retainers, and associated hardware are replaced with remote control units that transmit an actuation signal to electrically operated actuators engaged with the release pins 1550 and 1552. Accordingly, upon activation of a remote control unit (which could be integral with the seating unit or remote therefrom), an actuation signal is transmitted to a pair of actuators that either extend or retract the release pins from the slide assemblies 1556 and 1554. The remote control units may be wired to the actuators, or may be wireless. If the remote control units are wireless, it is most preferred that they utilize a radio transmission to activate the actuators.

FIG. 55 also illustrates a preferred aspect or configuration of the slide assemblies 1554 and 1556. On each track or bar member of the assemblies 1554 and 1556, a plurality of outwardly extending projections are shown. These small projections are most preferably portions of the track member surrounding an aperture formed in the track member for receiving a release pin 1550 and 1552. These portions project and extend away from the longitudinal axis of the track member. These portions also contain a curved region between the track member and the projection that facilitates engagement and disengagement of a release pin with a track member. As will be appreciated, these curved regions provide a transition between engagement and disengagement of the release pins and serve to guide the pins into a respective aperture defined in the track member. As shown in FIG. 55, the track members having the plurality of projections are oriented such that the projections extend away from the side of the track members which face the release pins.

Figure 56:
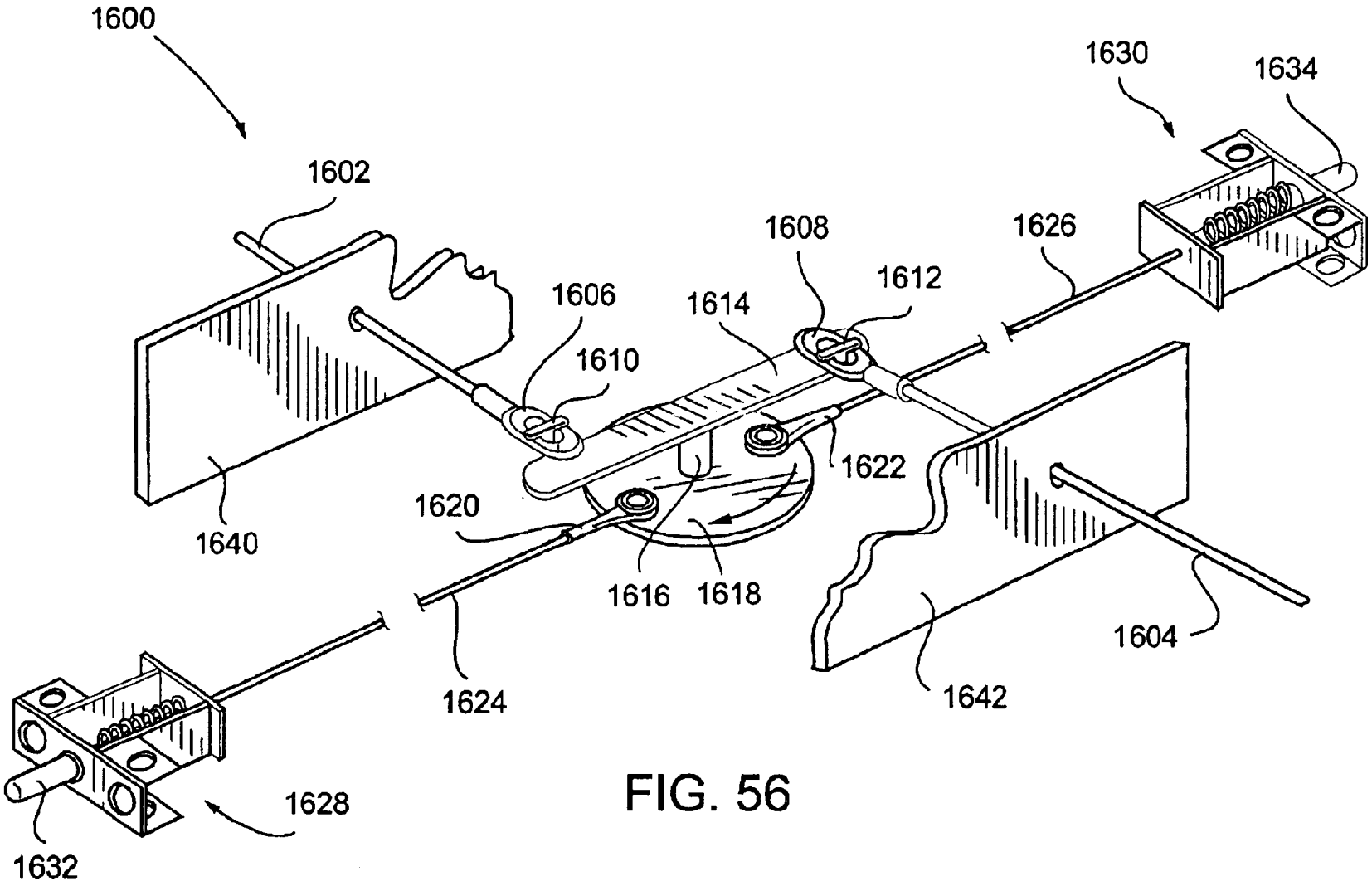
FIG. 56 is a perspective view of yet another preferred embodiment cable assembly for selective activation of a slide mechanism employed in a seating unit.

FIG. 56 illustrates another preferred embodiment mechanical activation assembly for use in a seating unit. Specifically, FIG. 56 illustrates yet another preferred embodiment actuation system in accordance with the present invention. This system 1600 comprises one or more actuating cables or rods, such as cables 1602 and 1604. These may extend from corresponding actuators such as pull handles or levers of a seating unit. The cables 1602 and 1604 may extend through one or more structural or frame members such as members 1640 and 1642. The cables 1602 and 1604 extend and are secured to a rotatable actuator plate 1618. Preferably, the cables 1602 and 1604 are releasably attached to an actuator bar 1614 by use of slotted ends 1606 and 1608; and corresponding posts 1610 and 1612 engageable therewith. The actuator bar 1614 is affixed to the actuator plate 1618 by use of a standoff 1616. Attached to the actuator plate 1618 are cables 1624 and 1626 which are connected to release assemblies 1628 and 1630. Each release assembly includes a retractable release pin 1632 and 1634. As will be understood, the pins 1632 and 1634 are engageable with sliding mechanisms as described herein.

The operation of the system 1600 is as follows. Upon pulling or tensioning of either cable 1602 or 1604, the actuator plate 1618 is rotated in the direction of the arrow as shown in FIG. 56. Rotation of plate 1618 in turn, results in pulling or tensioning of cables 1624 and 1626 which in turn retract release pins 1632 and 1634.

It will be appreciated that the present invention actuation systems, especially those utilizing a plurality of cables, may also employ one or more components that produce a mechanical advantage such as a pulley system similar to a block and tackle system. Specifically, in some applications it may be particularly beneficial to incorporate such a component into a cable based system. For instance, a relatively short travel, high force release pin (such as may engage with a sliding assembly) may be retracted by use of a mechanical advantage component requiring a long travel, low force actuation pull or movement. Other mechanical advantage components or force translation components can be utilized in the various preferred embodiment actuation systems described herein, such as cams, pulleys, inclined ramping surfaces and the like.

A preferred embodiment seating unit according to the present invention was subjected to a series of durability testing trials. Specifically, is a sofa type seating unit with a single sliding seat assembly with a manual actuation assembly as described herein, was subjected to repetitive seat extending and seat retraction tests while a static load was applied to the seat. A 750 pound load was placed on the seat and the seat was extended and retracted throughout its full range of motion. The seating unit was subjected to 200,000 cycles of this repeated motion without any observed failure. This is remarkable and believed to result from the unique and efficient design of the present invention seating unit. Moreover, this is incredible in view of the fact that furniture industry testing standards for motion furniture are typically based upon 25,000 cycles without any weight or load applied to the seat or unit.

Although the present invention seating units have been described and illustrated as stand alone units that may be used in nearly any location or setting, the present invention also provides nonmobile seating units that are built into a room or living space. Such "built in" seating units may be desirable for lounges or theaters. The backrest portions of such seating units could be incorporated directly into a wall or other fixture of a building or room.

Although the present invention has been primarily described in terms of various seating units, it will be appreciated that the present invention also encompasses other types of furniture units such as beds, futons, and hybrid units that feature combinations of various aspects of sofas, couches, chairs, beds, futons and the like.

The present invention will provide significant use in many areas besides residential furniture application. In addition to that prime utility, other contemplated applications include, but are not limited to uses or applications in hotels, motels, inns, cottages, chalets, lodges, airplanes, airliners, recreational vehicles, mobile homes, campers, trailers, dormitories, schools, lounges, office lobbies, cruise ships, boats, marine staterooms and decks, retail stores including book stores, legal and medical officers, casinos, nightclubs, rapid transit terminals, airports, train stations, shelters, jails, prisons and nearly any office or administration center.

The invention has been described with reference to several preferred embodiments. Obviously, alterations and modifications will occur to others upon a reading and understanding of this specification. It is intended to include all such modifications and alterations insofar as they come within the scope of the appended claims or the equivalents thereof. Moreover, it will be understood that features of a previously described preferred embodiment may be utilized in any of the other preferred embodiments described herein.

I claim:

1. A seating unit having a movable seat, said unit comprising:

a support frame;

a backrest member extending upward from said support frame, said movable seat disposed on said support frame such that the entirety of said seat may be displaced within a horizontal plane outward from said support frame to one of a plurality of extended positions relative to said support frame;

a locking assembly to selectively engage said seat to said support frame to thereby secure said seat to said support frame after displacing said seat to one of a plurality of extended positions;

a first actuator handle, affixed to said support frame;

a second actuator handle affixed to said support frame and spaced from said first actuator handle;

an actuator assembly disposed on said support frame, said actuator assembly in communication with said locking assembly, whereby upon activation of said actuator assembly, said locking assembly engages said seat to said support frame;

a first cable extending between said first actuator handle and said actuator assembly;

a second cable extending between said second actuator handle and said actuator assembly;

whereby (i) upon activating said first actuator handle, said first cable is tensioned thereby activating said actuator assembly to engage said seat to said support frame, or (ii) upon activating said second actuator handle, said second cable is tensioned thereby activating said actuator assembly to engage said seat to said support frame.

2. The seating unit of claim 1 further comprising:

a caster roller and corresponding caster race, said caster roller affixed to said movable seat and said caster race defined in said support frame.

3. The seating unit of claim 1 further comprising a third cable extending between said actuator assembly and said locking assembly to thereby provide communication between said actuator assembly and said locking assembly.

4. The seating unit of claim 3 wherein said locking assembly includes a retainer and a release pin movably retained between a release position and a lock position within said retainer, said retainer secured to said support frame and said release pin secured to a distal end of said third cable, said release pin configured to engage said movable seat when in said lock position.

5. The seating unit of claim 4 wherein said locking assembly further includes a spring in engagement with said release pin, said spring configured to urge said pin toward said lock position.

6. The seating unit of claim 1 wherein both said first and second cables are sheathed cables.

7. The seating unit of claim 1 wherein said first and second actuator handles are disposed at opposite ends of said seating unit.

8. The seating unit of claim 1 wherein said seat is movably coupled to said support frame by use of at least one roller glide assembly, said roller glide assembly including (i) a first bracket affixed to said movable seat, (ii) a second bracket affixed to said support frame; and (iii) a plurality of bearing members that enable movement between said first and second brackets.

9. The seating unit of claim 8 wherein said seat is movably coupled to said support frame by a first plurality of roller glide assemblies disposed at a first end of said seat and a second plurality of roller glide assemblies disposed at a second end of said seat member, opposite from said first end.

10. A seating unit including:

a stationary base;

a linearly positionable seat movably coupled to said stationary base, said seat movable within a horizontal plane, and movable between a fully retracted position and a fully extended position in which at least a portion of said seat is cantilevered out from said base, said seat being selectively positionable to one of a plurality of positions between said fully retracted position and said fully extended position;

a locking assembly to selectively engage said seat to said stationary base after positioning said seat to one of a plurality of positions;

a first actuator disposed at a first end of said stationary base;

a second actuator disposed at a second end of said stationary base;

an actuator assembly in operable engagement with both said first actuator and said second actuator, and said locking assembly whereby upon activation of either said first actuator or said second actuator, said actuator assembly engages said locking assembly to thereby release said seat from said stationary base and allow movement of said seat with respect to said stationary base.

11. The seating unit of claim 10 further comprising:

a caster roller affixed to said seat; and a caster race defined in said stationary base;

wherein said caster roller contacts and moves within said caster race as said seat moves with respect to said base.

12. The seating unit of claim 10 further comprising:

a first cable extending between said actuator assembly and said first actuator; and a second cable extending between said actuator assembly and said second actuator.

13. The seating unit of claim 10 further comprising:

a cable extending between said actuator assembly and said locking assembly.

14. The seating unit of claim 13 wherein said cable is sheathed.

15. The seating unit of claim 13 wherein said locking assembly includes a stationary retainer and a pin movable therein, said cable extending between said actuator assembly and said pin.

16. The seating unit of claim 10 wherein said locking assembly comprises:

a retainer affixed to said base;

a release member movably retained within said retainer, said release member movable between a lock position in which said release member engages said seat, and a release position in which said release member is free of contact with said seat;

a spring in communication with said release member and positioned with respect to said release member such that said spring urges said release member toward said lock position;

wherein said release member is in operable engagement with said actuator assembly such that upon activation of either said first actuator or said second actuator, said actuator assembly moves said release member from said lock position to said release position to thereby release said seat from said stationary base and allow movement of said seat with respect to said stationary base.

17. The seating unit of claim 10 wherein said seat is movably coupled to said stationary base by use of a first plurality of roller glide assemblies disposed at a first side of said seat, and a second plurality of roller glide assemblies disposed at a second side of said seat opposite from said first side.

* * * * *